US008387411B2

(12) United States Patent
Fujimoto et al.

(10) Patent No.: US 8,387,411 B2
(45) Date of Patent: Mar. 5, 2013

(54) REFRIGERATION APPARATUS

(75) Inventors: Shuji Fujimoto, Sakai (JP); Atsushi Yoshimi, Sakai (JP); Yoshio Ueno, Sakai (JP); Ryusuke Fujiyoshi, Sakai (JP); Toshiyuki Kurihara, Sakai (JP); Shun Yoshioka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 393 days.

(21) Appl. No.: 12/744,963

(22) PCT Filed: Nov. 28, 2008

(86) PCT No.: PCT/JP2008/071620

§ 371 (c)(1),
(2), (4) Date: May 27, 2010

(87) PCT Pub. No.: WO2009/069732

PCT Pub. Date: Jun. 4, 2009

(65) Prior Publication Data

US 2010/0300141 A1 Dec. 2, 2010

(30) Foreign Application Priority Data

Nov. 30, 2007 (JP) ..... 2007-311493

(51) Int. Cl.
*F25B 31/00* (2006.01)

(52) U.S. Cl. ..... 62/505; 621/513

(58) Field of Classification Search ..... 62/498, 62/510, 513, 505; 165/181, 201, 248
See application file for complete search history.

(56) References Cited

U.S. PATENT DOCUMENTS

| | | | | |
|---|---|---|---|---|
| 3,680,973 | A * | 8/1972 | Pilarczyk | 415/58.1 |
| 3,719,057 | A * | 3/1973 | Grant | 62/193 |
| 4,660,384 | A * | 4/1987 | Pallanch | 62/81 |
| 4,947,655 | A * | 8/1990 | Shaw | 62/200 |
| 5,150,581 | A * | 9/1992 | Smith | 62/115 |
| 5,769,610 | A * | 6/1998 | Paul et al. | 417/228 |
| 6,658,888 | B2 * | 12/2003 | Manohar et al. | 62/498 |
| 7,028,491 | B2 * | 4/2006 | Horton | 62/158 |
| 7,096,679 | B2 * | 8/2006 | Manole | 62/115 |

(Continued)

FOREIGN PATENT DOCUMENTS

| | | |
|---|---|---|
| JP | 2005-214559 A | 8/2005 |
| JP | 2005-221205 A | 8/2005 |

(Continued)

OTHER PUBLICATIONS

International Preliminary Report of corresponding PCT Application No. PCT/JP2008/071620.

(Continued)

*Primary Examiner* — Mohammad Ali
(74) *Attorney, Agent, or Firm* — Global IP Counselors

(57) ABSTRACT

An air-conditioning apparatus uses carbon dioxide as a refrigerant, and includes a two-stage-compression-type compression mechanism, a heat source-side heat exchanger, an expansion mechanism, a usage-side heat exchanger, and an intercooler. The intercooler uses air as a heat source. The intercooler is configured and arranged to cool refrigerant flowing through an intermediate refrigerant tube that draws refrigerant discharged from the first-stage compression element into the second-stage compression element. The intercooler is integrated with the heat source-side heat exchanger to form an integrated heat exchanger, with the intercooler disposed in an upper part of the integrated heat exchanger.

14 Claims, 31 Drawing Sheets

U.S. PATENT DOCUMENTS

| | | | | |
|---|---|---|---|---|
| 7,131,294 | B2 * | 11/2006 | Manole | 62/513 |
| 7,331,196 | B2 * | 2/2008 | Itsuki et al. | 62/510 |
| 7,631,510 | B2 * | 12/2009 | Radermacher et al. | 62/196.2 |
| 7,721,569 | B2 * | 5/2010 | Manole | 62/513 |
| 2002/0014088 | A1 * | 2/2002 | Seki et al. | 62/498 |
| 2003/0177782 | A1 * | 9/2003 | Gopalnarayanan et al. | 62/505 |
| 2003/0192338 | A1 * | 10/2003 | Manohar et al. | 62/498 |
| 2005/0115260 | A1 * | 6/2005 | Yap | 62/238.6 |
| 2005/0132729 | A1 * | 6/2005 | Manole | 62/149 |
| 2005/0166626 | A1 | 8/2005 | Matsumoto et al. | |
| 2005/0178141 | A1 | 8/2005 | Matsumoto et al. | |
| 2005/0217296 | A1 | 10/2005 | Yamanaka et al. | |
| 2005/0279127 | A1 * | 12/2005 | Jia et al. | 62/510 |
| 2006/0083626 | A1 * | 4/2006 | Manole | 417/245 |
| 2006/0083627 | A1 * | 4/2006 | Manole | 417/245 |
| 2006/0086110 | A1 * | 4/2006 | Manole | 62/175 |
| 2007/0000281 | A1 * | 1/2007 | Manole | 62/513 |
| 2009/0044564 | A1 | 2/2009 | Okamoto | |
| 2009/0301109 | A1 * | 12/2009 | Manole | 62/79 |

FOREIGN PATENT DOCUMENTS

| | | | |
|---|---|---|---|
| JP | 2005-226912 | A | 8/2005 |
| JP | 2007-212108 | A | 8/2007 |
| JP | 2007-232263 | A | 9/2007 |
| JP | 2008-503705 | A | 2/2008 |

OTHER PUBLICATIONS

International Search Report of corresponding PCT Application No. PCT/JP2008/071620.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2007-311493, filed in Japan on Nov. 30, 2007, the entire contents of which are hereby incorporated herein by reference.

TECHNICAL FIELD

The present invention relates to a refrigeration apparatus, and particularly relates to a refrigeration apparatus which performs a multistage compression refrigeration cycle by using a refrigerant that operates in a supercritical range.

BACKGROUND ART

As one conventional example of a refrigeration apparatus which performs a multistage compression refrigeration cycle by using a refrigerant that operates in a supercritical range, Japanese Laid-open Patent Application No. 2007-232263 discloses an air-conditioning apparatus performs a two-stage-compression refrigeration cycle by using carbon dioxide as a refrigerant. This air-conditioning apparatus has primarily a compressor having two compression elements connected in series, an outdoor heat exchanger as a heat source-side heat exchanger, an expansion valve, and an indoor heat exchanger.

SUMMARY

A refrigeration apparatus according to a first aspect of the present invention is a refrigeration apparatus which a refrigerant that operates in a supercritical range is used, comprising a compression mechanism, a heat source-side heat exchanger that uses air as a heat source, an expansion mechanism for depressurizing the refrigerant, a usage-side heat exchanger, and an intercooler. The compression mechanism has a plurality of compression elements and is configured so that the refrigerant discharged from the first-stage compression element, which is one of a plurality of compression elements, is sequentially compressed by the second-stage compression element. The term "compression mechanism" herein means a compressor in which a plurality of compression elements are integrally incorporated, or a configuration including a compressor in which a single compression element is incorporated and/or a plurality of connected compressors in which a plurality of compression elements are incorporated in each. The phrase "the refrigerant discharged from a first-stage compression element, which is one of the plurality of compression elements, is sequentially compressed by a second-stage compression element" does not mean merely that two compression elements connected in series are included, namely, the "first-stage compression element" and the "second-stage compression element;" but means that a plurality of compression elements are connected in series and the relationship between the compression elements is the same as the relationship between the aforementioned "first-stage compression element" and "second-stage compression element." The intercooler has air as a heat source, the intercooler is provided to an intermediate refrigerant tube for drawing the refrigerant discharged from the first-stage compression element into the second-stage compression element, and the intercooler functions as a cooler of the refrigerant discharged from the first-stage compression element and drawn into the second-stage compression element. The intercooler constitutes a heat exchanger integrated with the heat source-side heat exchanger, and the intercooler is disposed in the upper part of the heat exchanger.

In cases in which a heat exchanger that uses air as a heat source is used as the outdoor heat exchanger in a conventional air-conditioning apparatus, the critical temperature (about 31° C.) of carbon dioxide used as the refrigerant is about the same as the temperature of the air used as the heat source of an outdoor heat exchanger functioning as a cooler of the refrigerant, which is low in comparison with R22, R410A, and other refrigerants, and the apparatus therefore operates in a state in which the high pressure of the refrigeration cycle is higher than the critical pressure of the refrigerant so that the refrigerant can be cooled by the air in the outdoor heat exchanger during an air-cooling operation as the cooling operation. As a result, since the refrigerant discharged from the first-stage compression element of the compressor has a high temperature, there is a large difference in temperature between the refrigerant and the air as a heat source in the outdoor heat exchanger functioning as a refrigerant cooler, and the outdoor heat exchanger has much heat radiation loss, which poses a problem in making it difficult to achieve a high operating efficiency.

In one considered possible countermeasure to this problem in this refrigeration apparatus, the intercooler which functions as a cooler of the refrigerant discharged from the first-stage compression element and drawn into the second-stage compression element is provided to the intermediate refrigerant tube for drawing the refrigerant discharged from the first-stage compression element into the second-stage compression element, whereby the temperature of the refrigerant drawn into the second-stage compression element is reduced. As a result, the temperature of the refrigerant discharged from the second-stage compression element of the compressor is reduced, and the heat radiation loss in the outdoor heat exchanger is also reduced. Moreover, in cases in which a heat exchanger that uses air as a heat source is used as the intercooler, the intercooler is preferably integrated with the outdoor heat exchanger in view the arrangement of the devices and other considerations.

In this refrigeration apparatus, since the refrigerant that operates in a supercritical range (carbon dioxide in this case) is used, sometimes a refrigeration cycle is performed in which refrigerant of a lower pressure than the critical pressure flows into the intercooler, and refrigerant of a pressure exceeding the critical pressure flows into the heat source-side heat exchanger, in which case the difference between the physical properties of the refrigerant whose pressure is lower than the critical pressure and the physical properties (particularly the heat transfer coefficient and the specific heat at constant pressure) of the refrigerant whose pressure exceeds the critical pressure leads to a tendency of the heat transfer coefficient of the refrigerant in the intercooler to be lower than the heat transfer coefficient of the refrigerant in the heat source-side heat exchanger. Therefore, in the case that the refrigeration apparatus is configured such that there is a connection between a usage unit and a heat source unit configured so as to draw in air from the side and to blow the air upward, for example, if an intercooler integrated with the heat source-side heat exchanger is disposed in the lower part of a heat source unit where air as a heat source flows at a low speed, there is a limit to the extent by which the heat transfer area of the intercooler can be increased due to the fact that the effect of a reduction in the heat transfer coefficient of air in the intercooler, as caused by placing the intercooler in the lower part of the heat source unit, and the effect of a lower heat transfer coefficient of the refrigerant in the intercooler in comparison with the heat transfer coefficient of the refrigerant in the heat source-side heat exchanger are combined together to reduce the overall heat transfer coefficient of the intercooler, and also due to the fact that the intercooler is integrated with the heat source-side heat exchanger. Therefore, the heat transfer performance of the intercooler is reduced as a result.

In the case that this refrigeration apparatus is configured to be capable of switching between a cooling operation and a heating operation, the heat source-side heat exchanger functions as a refrigerant heater during the heating operation. Therefore, when the heating operation is performed while the air as the heat source has a low temperature, frost deposits form on the heat source-side heat exchanger, and a defrosting operation for defrosting the heat source-side heat exchanger must therefore be performed by causing the heat source-side heat exchanger to function as a refrigerant cooler. In this case, if the intercooler is disposed underneath the heat source-side heat exchanger, water that is melted by the defrosting operation of the heat source-side heat exchanger and drips down from the heat source-side heat exchanger adheres to the intercooler, whereby the water melted by the defrosting operation of the heat source-side heat exchanger adheres to and freezes on the intercooler, a phenomenon (hereinbelow referred to as the "icing-up phenomenon") is likely to occur in which this ice expands, and there is a danger of the reliability of the equipment being compromised.

In view of this, in this refrigeration apparatus, the intercooler is integrated with the heat source-side heat exchanger, and the intercooler is disposed in the upper part of the heat exchanger in which these two components are integrated.

In this refrigeration apparatus, since the intercooler is thereby disposed in the upper part of a heat source unit through which the heat source air flows quickly, the heat transfer coefficient of air in the intercooler is increased. As a result, the decrease in the overall heat transfer coefficient of the intercooler can be minimized, and the loss of heat transfer performance in the intercooler can be minimized as well. Since the water that is melted by the defrosting operation and drips down from the heat source-side heat exchanger is impeded from adhering to the intercooler, the icing-up phenomenon is suppressed, and the reliability of the equipment can be improved.

A refrigeration apparatus according to a second aspect of the present invention is the refrigeration apparatus according to the first aspect of the present invention, wherein the intercooler is disposed in the upper part of the heat source-side heat exchanger.

A refrigeration apparatus according to a third aspect of the present invention is the refrigeration apparatus according to the first aspect of the present invention, wherein the intercooler is disposed in an upper upwind part, which is a section upwind of the flow direction of the air as the heat source in the upper part of the heat exchanger in which the intercooler and the heat source-side heat exchanger are integrated.

Since the temperature of the refrigerant flowing into the intercooler is lower than the temperature of the refrigerant flowing into the heat source-side heat exchanger, it is more difficult to ensure the temperature difference between the refrigerant flowing through the intercooler and the air as the heat source than it is to ensure the temperature difference between the refrigerant flowing through the heat source-side heat exchanger and the air as the heat source, and a loss of heat transfer performance in the intercooler occurs readily.

In view of this, in this refrigeration apparatus, the intercooler is disposed in the upper upwind part.

In this refrigeration apparatus, the temperature difference between the refrigerant flowing through the intercooler and the air as the heat source can thereby be increased. As a result, the heat transfer performance of the intercooler can be improved.

A refrigeration apparatus according to a fourth aspect of the present invention is the refrigeration apparatus according to the third aspect of the present invention, wherein the heat source-side heat exchanger has a high-temperature heat transfer channel through which high-temperature refrigerant flows, and a low-temperature heat transfer channel through which low-temperature refrigerant flows, and the low-temperature heat transfer channel is disposed farther upwind in the flow direction of the air as the heat source than the high-temperature heat transfer channel.

In this refrigeration apparatus, since the low-temperature heat transfer channel is disposed farther upwind than the high-temperature heat transfer channel, high-temperature refrigerant exchanges heat with high-temperature air while low-temperature refrigerant exchanges heat with low-temperature air, the temperature difference between the air and the refrigerant in the heat transfer channels is made uniform, and the heat transfer performance of the heat source-side heat exchanger can be improved.

A refrigeration apparatus according to a fifth aspect of the present invention is the refrigeration apparatus according to the fourth aspect of the present invention, wherein the heat source-side heat exchanger has a plurality of heat transfer channels arranged vertically in multiple columns; the high-temperature heat transfer channels are disposed in a downwind part, which is a section in the heat transfer channels farther downwind in the flow direction of the air as the heat source than the intercooler; the low-temperature heat transfer channels are disposed in a lower upwind part, which is a section in the lower part of the intercooler upwind of the flow direction of the air as the heat source; the number of low-temperature heat transfer channels is less than the number of high-temperature heat transfer channels; and the heat source-side heat exchanger is configured so that the refrigerant fed from the high-temperature heat transfer channels to the low-temperature heat transfer channels flows into the low-temperature heat transfer channels after being mixed together so as to equal the number of low-temperature heat transfer channels.

In this refrigeration apparatus, since the intercooler is disposed in the upper upwind part, the space for disposing the heat source-side heat exchanger in a upwind part where heat exchange with air would be effective is limited to the lower upwind part below the intercooler, but the lower upwind part is the location of the low-temperature heat transfer channels through which low-temperature refrigerant flows with less flow resistance than the high-temperature refrigerant, and the refrigerant fed from the high-temperature heat transfer channels is mixed in and made to flow into the low-temperature heat transfer channels. Therefore, the flow rate of refrigerant through the low-temperature heat transfer channels can be increased, the heat transfer coefficient in the low-temperature heat transfer channels can be improved, and the heat transfer performance of the heat source-side heat exchanger can be further improved.

A refrigeration apparatus according to a sixth aspect of the present invention is the refrigeration apparatus according to any of the first through fifth aspects, wherein the heat source-side heat exchanger and the intercooler are fin-and-tube heat exchangers, and the intercooler is integrated by sharing heat transfer fins with the heat source-side heat exchanger.

A refrigeration apparatus according to a seventh aspect of the present invention is the refrigeration apparatus according to any of the first through sixth aspects, wherein the refrigerant that operates in a supercritical range is carbon dioxide.

DETAILED DESCRIPTION OF EMBODIMENT(S)

Embodiments of the refrigeration apparatus according to the present invention are described hereinbelow with reference to the drawings.

(1) Configuration of Air-Conditioning Apparatus

Figure 1:
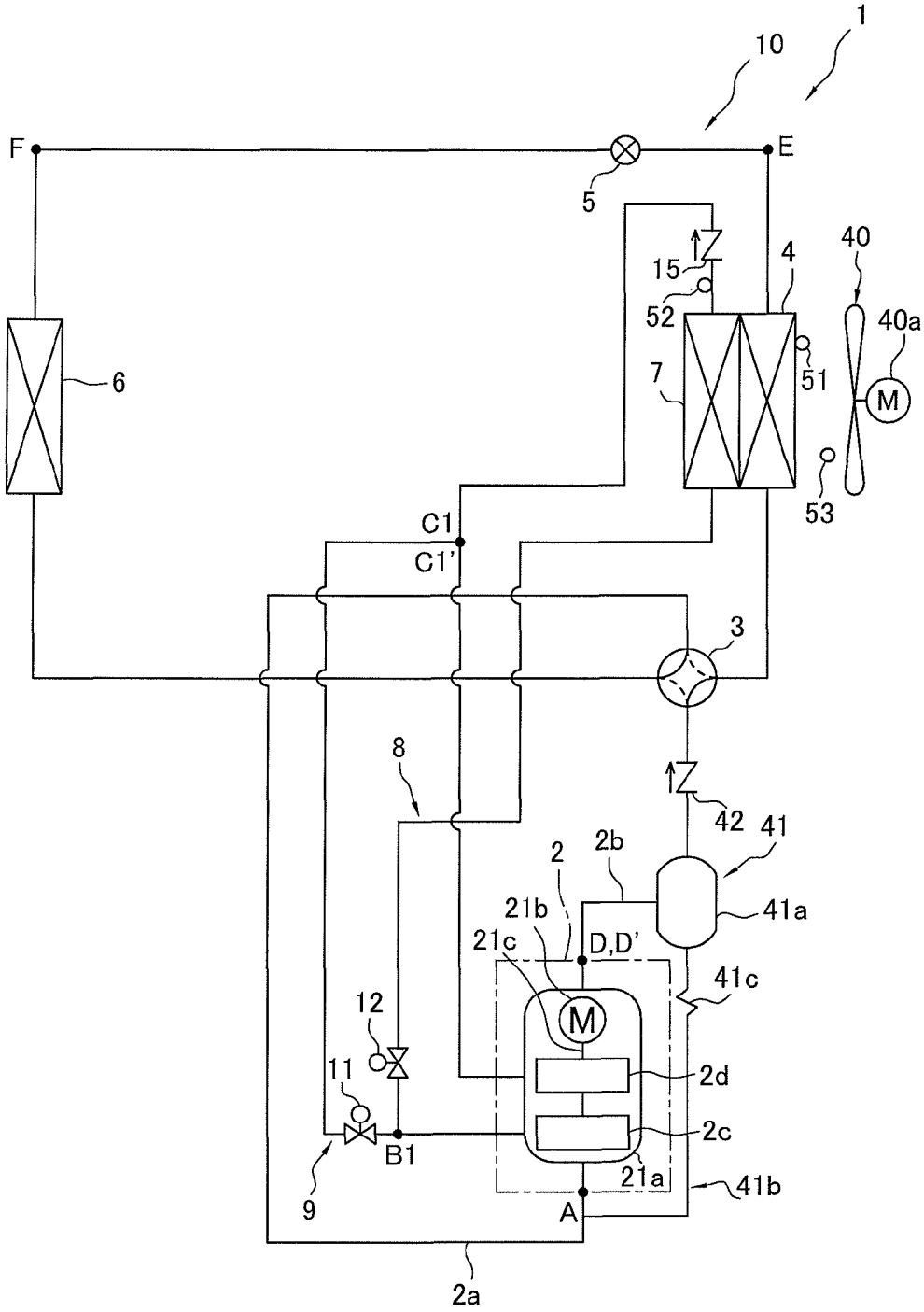
FIG. 1 is a schematic structural diagram of an air-conditioning apparatus as an embodiment of the refrigeration apparatus according to the present invention.

FIG. 1 is a schematic structural diagram of an air-conditioning apparatus 1 as an embodiment of the refrigeration apparatus according to the present invention. The air-conditioning apparatus 1 has a refrigerant circuit 10 configured to be capable of switching between an air-cooling operation and an air-warming operation, and the apparatus performs a two-stage compression refrigeration cycle by using a refrigerant (carbon dioxide in this case) for operating in a supercritical range.

The refrigerant circuit 10 of the air-conditioning apparatus 1 has primarily a compression mechanism 2, a switching mechanism 3, a heat source-side heat exchanger 4, an expansion mechanism 5, a usage-side heat exchanger 6, and an intercooler 7.

In the present embodiment, the compression mechanism 2 is configured from a compressor 21 which uses two compression elements to subject a refrigerant to two-stage compression. The compressor 21 has a hermetic structure in which a compressor drive motor 21*b*, a drive shaft 21*c*, and compression elements 2*c*, 2*d* are housed within a casing 21*a*. The compressor drive motor 21*b* is linked to the drive shaft 21*c*.

The drive shaft 21*c* is linked to the two compression elements 2*c*, 2*d*. Specifically, the compressor 21 has a so-called single-shaft two-stage compression structure in which the two compression elements 2*c*, 2*d* are linked to a single drive shaft 21*c* and the two compression elements 2*c*, 2*d* are both rotatably driven by the compressor drive motor 21*b*. In the present embodiment, the compression elements 2*c*, 2*d* are rotary elements, scroll elements, or another type of positive displacement compression elements. The compressor 21 is configured so as to admit refrigerant through an intake tube 2*a*, to discharge this refrigerant to an intermediate refrigerant tube 8 after the refrigerant has been compressed by the compression element 2*c*, to admit the refrigerant discharged to the intermediate refrigerant tube 8 into the compression element 2*d*, and to discharge the refrigerant to a discharge tube 2*b* after the refrigerant has been further compressed. The intermediate refrigerant tube 8 is a refrigerant tube for taking refrigerant into the compression element 2*d* connected to the second-stage side of the compression element 2*c* after the refrigerant has been discharged from the compression element 2*c* connected to the first-stage side of the compression element 2*c*. The discharge tube 2*b* is a refrigerant tube for feeding refrigerant discharged from the compression mechanism 2 to the switching mechanism 3, and the discharge tube 2*b* is provided with an oil separation mechanism 41 and a non-return mechanism 42. The oil separation mechanism 41 is a mechanism for separating refrigerator oil accompanying the refrigerant from the refrigerant discharged from the compression mechanism 2 and returning the oil to the intake side of the compression mechanism 2, and the oil separation mechanism 41 has primarily an oil separator 41*a* for separating refrigerator oil accompanying the refrigerant from the refrigerant discharged from the compression mechanism 2, and an oil return tube 41*b* connected to the oil separator 41*a* for returning the refrigerator oil separated from the refrigerant to the intake tube 2*a* of the compression mechanism 2. The oil return tube 41*b* is provided with a decompression mechanism 41*c* for depressurizing the refrigerator oil flowing through the oil return tube 41*b*. A capillary tube is used for the decompression mechanism 41*c* in the present embodiment. The non-return mechanism 42 is a mechanism for allowing the flow of refrigerant from the discharge side of the compression mechanism 2 to the switching mechanism 3 and for blocking the flow of refrigerant from the switching mechanism 3 to the discharge side of the compression mechanism 2, and a non-return valve is used in the present embodiment.

Thus, in the present embodiment, the compression mechanism 2 has two compression elements 2*c*, 2*d* and is configured so that among these compression elements 2*c*, 2*d*, refrigerant discharged from the first-stage compression element is compressed in sequence by the second-stage compression element.

The switching mechanism 3 is a mechanism for switching the direction of refrigerant flow in the refrigerant circuit 10. In order to allow the heat source-side heat exchanger 4 to function as a cooler of refrigerant compressed by the compression mechanism 2 and to allow the usage-side heat exchanger 6 to function as a heater of refrigerant cooled in the heat source-side heat exchanger 4 during the air-cooling operation, the switching mechanism 3 is capable of connecting the discharge side of the compression mechanism 2 and one end of the heat source-side heat exchanger 4 and also connecting the intake side of the compressor 21 and the usage-side heat exchanger 6 (refer to the solid lines of the switching mechanism 3 in FIG. 1, this state of the switching mechanism 3 is hereinbelow referred to as the "cooling operation state"). In order to allow the usage-side heat exchanger 6 to function as a cooler of refrigerant compressed by the compression mechanism 2 and to allow the heat source-side heat exchanger 4 to function as a heater of refrigerant cooled in the usage-side heat exchanger 6 during the air-warming operation, the switching mechanism 3 is capable of connecting the discharge side of the compression mechanism 2 and the usage-side heat exchanger 6 and also of connecting the intake side of the compression mechanism 2 and one end of the heat source-side heat exchanger 4 (refer to the dashed lines of the switching mechanism 3 in FIG. 1, this state of the switching mechanism 3 is hereinbelow referred to as the "heating operation state"). In the present embodiment, the switching mechanism 3 is a four-way switching valve connected to the intake side of the compression mechanism 2, the discharge side of the compression mechanism 2, the heat source-side heat exchanger 4, and the usage-side heat exchanger 6. The switching mechanism 3 is not limited to a four-way switching valve, and may also be configured by combining a plurality of electromagnetic valves, for example, so as to provide the same function of switching the direction of refrigerant flow as described above.

Thus, focusing solely on the compression mechanism 2, the heat source-side heat exchanger 4, the expansion mechanism 5, and the usage-side heat exchanger 6 constituting the refrigerant circuit 10; the switching mechanism 3 is configured so as to be capable of switching between the cooling operation state in which refrigerant is circulated in sequence through the compression mechanism 2, the heat source-side heat exchanger 4, the expansion mechanism 5, and the usage-side heat exchanger 6; and the heating operation state in which refrigerant is circulated in sequence through the compression mechanism 2, the usage-side heat exchanger 6, the expansion mechanism 5, and the heat source-side heat exchanger 4.

The heat source-side heat exchanger 4 is a heat exchanger that functions as a cooler or a heater of refrigerant. One end of the heat source-side heat exchanger 4 is connected to the switching mechanism 3, and the other end is connected to the expansion mechanism 5. The heat source-side heat exchanger 4 is a heat exchanger that uses air as a heat source (i.e., a cooling source or a heating source), and a fin-and-tube heat exchanger is used in the present embodiment. The air as the heat source is supplied to the heat source-side heat exchanger 4 by a heat source-side fan 40. The heat source-side fan 40 is driven by a fan drive motor 40*a*.

The expansion mechanism 5 is a mechanism for depressurizing the refrigerant, and an electric expansion valve is used in the present embodiment. One end of the expansion mechanism 5 is connected to the heat source-side heat exchanger 4, and the other end is connected to the usage-side heat exchanger 6. In the present embodiment, the expansion mechanism 5 depressurizes the high-pressure refrigerant cooled in the heat source-side heat exchanger 4 before feeding the refrigerant to the usage-side heat exchanger 6 during the air-cooling operation, and depressurizes the high-pressure refrigerant cooled in the usage-side heat exchanger 6 before feeding the refrigerant to the heat source-side heat exchanger 4 during the air-warming operation.

The usage-side heat exchanger 6 is a heat exchanger that functions as a heater or cooler of refrigerant. One end of the usage-side heat exchanger 6 is connected to the expansion mechanism 5, and the other end is connected to the switching mechanism 3. Though not shown in the drawings, the usage-side heat exchanger 6 is supplied with water or air as a heating source or cooling source for conducting heat exchange with the refrigerant flowing through the usage-side heat exchanger 6.

The intercooler 7 is provided to the intermediate refrigerant tube 8, and is a heat exchanger which functions as a cooler of the refrigerant discharged from the first-stage compression element 2*c* and drawn into the compression element 2*d*. The intercooler 7 is a heat exchanger that uses air as a heat source (i.e., a cooling source), and a fin-and-tube heat exchanger is used in the present embodiment. The intercooler 7 is integrated with the heat source-side heat exchanger 4.

Figure 2:
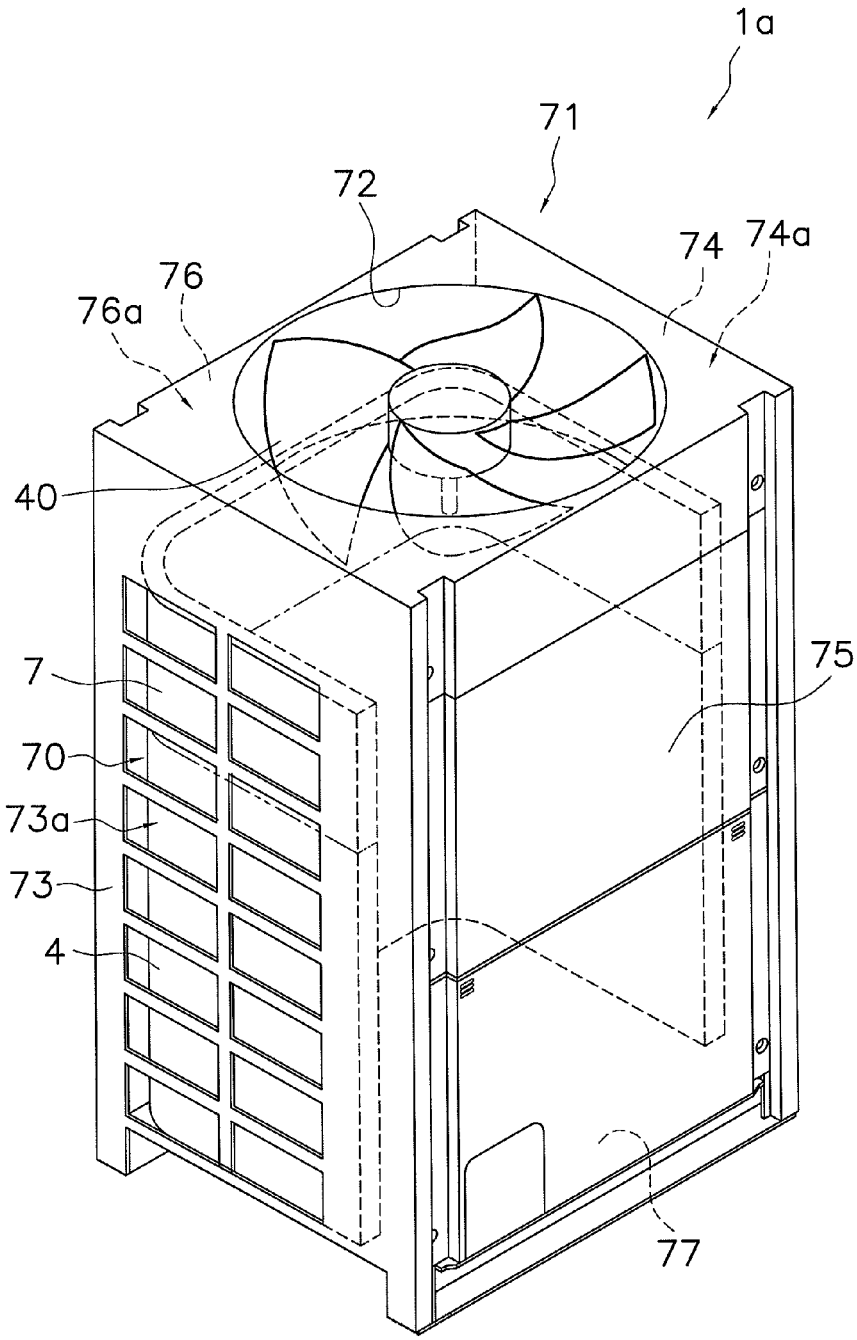
FIG. 2 is an external perspective view of a heat source unit (with the fan grill removed).
Figure 3:
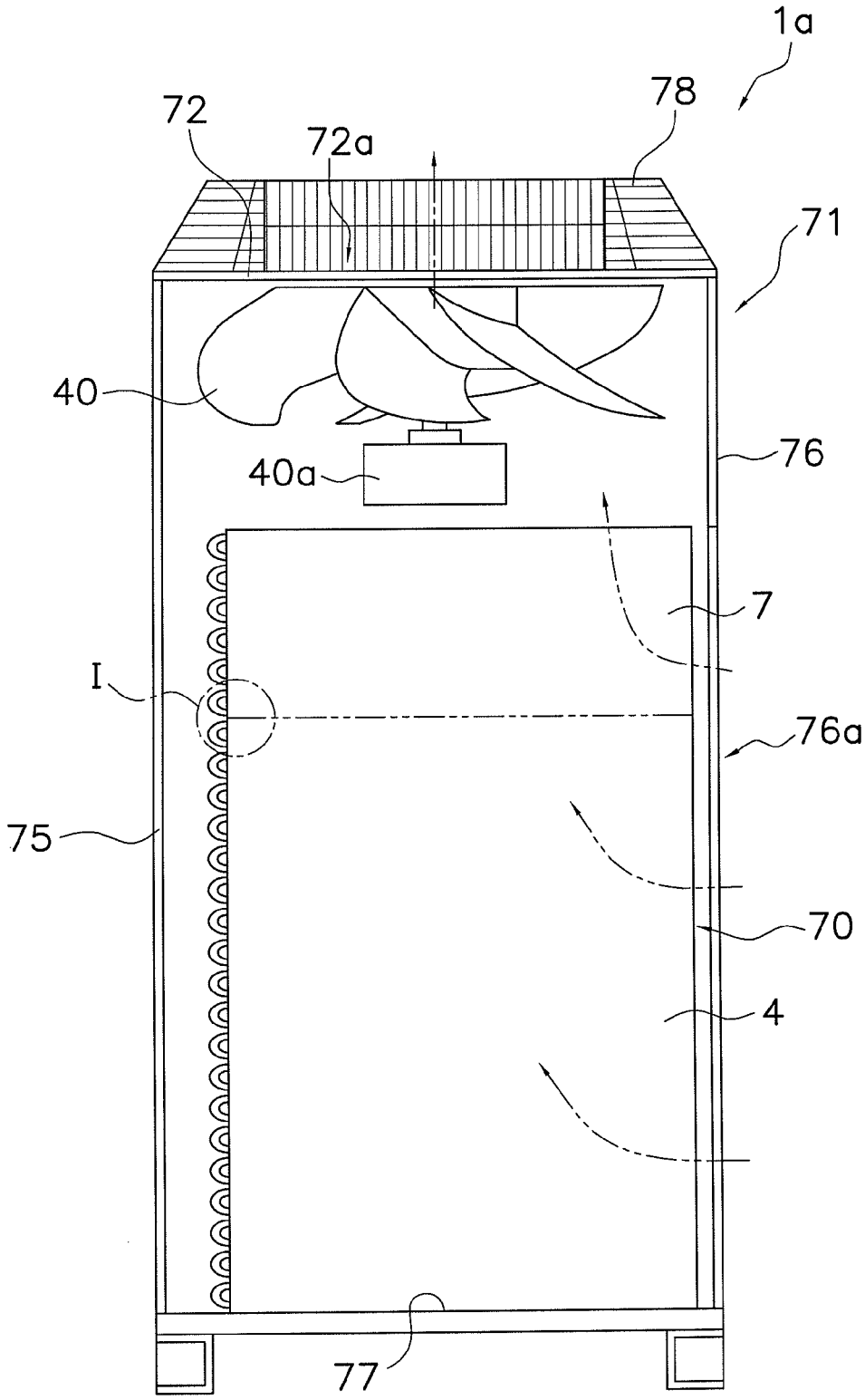
FIG. 3 is a side view of the heat source unit wherein a right plate of the heat source unit has been removed.
Figure 4:
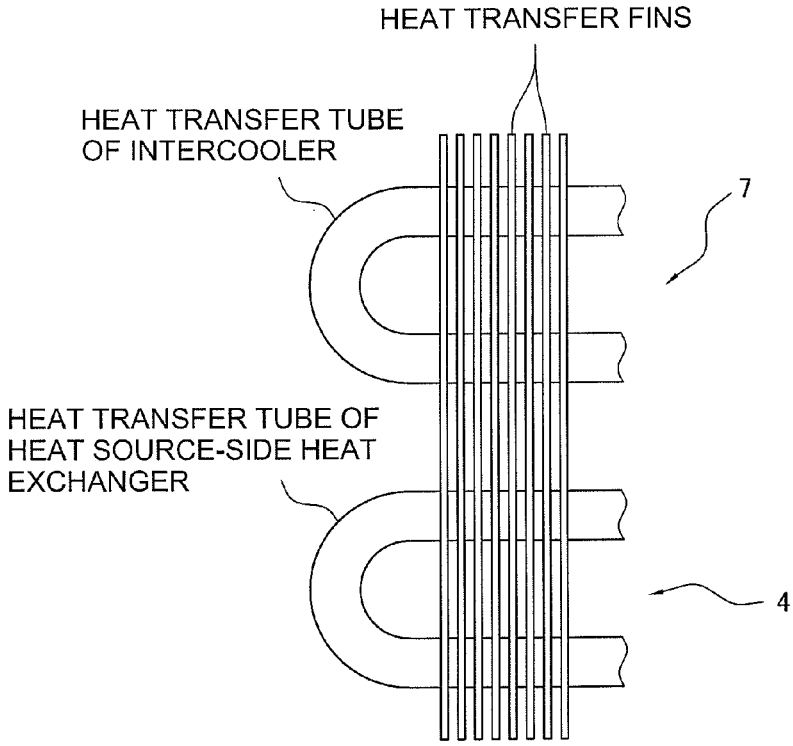
FIG. 4 is an enlarged view of section I in FIG. 3.

Next, the configuration in which the intercooler 7 is integrated with the heat source-side heat exchanger 4 is described in detail using FIGS. 2 through 4, including the arrangement and other features of both components. FIG. 2 is an external perspective view of a heat source unit 1*a* (with the fan grill removed), FIG. 3 is a side view of the heat source unit 1*a* wherein a right plate 74 of the heat source unit 1*a* has been removed, and FIG. 4 is an enlarged view of section I in FIG. 3. The terms "left" and "right" in the following description are used on the premise that the heat source unit 1*a* is being viewed from the side of a front plate 75.

First in the present embodiment, the air-conditioning apparatus 1 is configured by connecting the heat source unit 1*a* provided primarily with the heat source-side fan 40, the heat source-side heat exchanger 4, and the intercooler 7; and a usage unit (not shown) provided primarily with the usage-side heat exchanger 6. The heat source unit 1*a* is a so-called upward-blowing type of heat source unit which draws in air from the side and blows out air upward, and this heat source unit has primarily a casing 71 and refrigerant circuit structural components disposed inside the casing 71, such as the heat source-side heat exchanger 4 and the intercooler 7, as well as the heat source-side fan 40 and other devices.

In the present embodiment, the casing 71 is a substantially rectangular parallelepiped-shaped box, configured primarily from a top plate 72 constituting the top side of the casing 71; a left plate 73, a right plate 74, a front plate 75, and a rear plate 76 constituting the external peripheral sides of the casing 71; and a bottom plate 77. The top plate 72 is primarily a member constituting the top side of the casing 71, and is a substantially rectangular plate-shaped member in a plan view having a vent opening 71*a* formed substantially in the center in the present embodiment. A fan grill 78 is provided to the top plate 72 so as to cover the vent opening 71*a* from above. The left plate 73 is primarily a member constituting the left side of the casing 71, and is a substantially rectangular plate-shaped member in a side view extending downward from the left edge of the top plate 72 in the present embodiment. Intake openings 73*a* are formed throughout nearly the entire face of the left plate 73, except for the top portion. The right plate 74 is primarily a member constituting the right side of the casing 71, and is a substantially rectangular plate-shaped member in a side view extending downward from the right edge of the top plate 72 in the present embodiment. Intake openings 74*a* are formed throughout nearly the entire face of the right plate 74, except for the top part. The front plate 75 is primarily a member constituting the front side of the casing 71, and is configured from substantially rectangular plate-shaped members in a front view disposed in a downward sequence from the front edge of the top plate 72. The rear plate 76 is primarily a member constituting the rear side of the casing 71, and is configured from substantially rectangular plate-shaped members in a front view disposed in a downward sequence from the rear edge of the top plate 72 in the present embodiment. Intake openings 76*a* are formed throughout nearly the entire face of the rear plate 76, except for the top portion. The bottom plate 77 is primarily a member constituting the bottom side of the casing 71, and is a substantially rectangular plate-shaped member in a plan view in the present embodiment.

The intercooler 7 is integrated with the heat source-side heat exchanger 4 in a state of being disposed above the heat source-side heat exchanger 4, and is disposed on top of the bottom plate 77. More specifically, the intercooler 7 is integrated with the heat source-side heat exchanger 4 by sharing heat transfer fins (see FIG. 4). Integrating the heat source-side heat exchanger 4 and the intercooler 7 in the present embodiment forms a heat exchanger panel 70 having a substantial U shape in a plan view, which is disposed so as to face the intake openings 73*a*, 74*a* and 76*a*. The heat source-side fan 40 is directed toward the vent opening 71*a* of the top plate 72, and is disposed on the upper side of the integrated assembly of the heat source-side heat exchanger 4 and the intercooler 7 (i.e., the heat exchanger panel 70). In the present embodiment, the heat source-side fan 40 is an axial-flow fan designed so that, by being rotatably driven by a fan drive motor 40*a*, the heat source-side fan 40 is capable of drawing air as a heat source into the casing 71 through the intake openings 73*a*, 74*a* and 76*a*, and of blowing out the air upward through the vent opening 71*a* after the air has passed through the heat source-side heat exchanger 4 and the intercooler 7 (refer to the arrows indicating the flow of air in FIG. 3). In other words, the heat source-side fan 40 is designed so as to supply air as a heat source to both the heat source-side heat exchanger 4 and the intercooler 7. Neither the outward visible shape of the heat source unit 1*a* nor the shape of the integrated assembly of the heat source-side heat exchanger 4 and the intercooler 7 (i.e., the heat exchanger panel 70) is limited to those described above. Thus, the intercooler 7 constitutes a heat exchanger panel 70 integrated with the heat source-side heat exchanger 4, and the intercooler 7 is disposed in the top part of the heat exchanger panel 70.

An intercooler bypass tube 9 is connected to the intermediate refrigerant tube 8 so as to bypass the intercooler 7. This intercooler bypass tube 9 is a refrigerant tube for limiting the flow rate of refrigerant flowing through the intercooler 7. The intercooler bypass tube 9 is provided with an intercooler bypass on/off valve 11. The intercooler bypass on/off valve 11 is an electromagnetic valve in the present embodiment. Excluding cases in which temporary operations such as the hereinafter-described defrosting operation are performed, the intercooler bypass on/off valve 11 is essentially controlled so as to close when the switching mechanism 3 is set for the cooling operation, and to open when the switching mechanism 3 is set for the heating operation. In other words, the intercooler bypass on/off valve 11 is closed when the air-cooling operation is performed and opened when the air-warming operation is performed.

The intermediate refrigerant tube 8 is provided with a cooler on/off valve 12 in a position leading toward the intercooler 7 from the part connecting with the intercooler bypass tube 9 (i.e., in the portion leading from the part connecting with the intercooler bypass tube 9 nearer the inlet of the intercooler 7 to the connecting part nearer the outlet of the intercooler 7). The cooler on/off valve 12 is a mechanism for limiting the flow rate of refrigerant flowing through the intercooler 7. The cooler on/off valve 12 is an electromagnetic valve in the present embodiment. Excluding cases in which temporary operations such as the hereinafter-described defrosting operation are performed, the cooler on/off valve 12 is essentially controlled so as to open when the switching mechanism 3 is set for the cooling operation, and to close when the switching mechanism 3 is set for the heating operation. In other words, the cooler on/off valve 12 is controlled so as to open when the air-cooling operation is performed and close when the air-warming operation is performed. In the present embodiment, the cooler on/off valve 12 is provided in a position nearer the inlet of the intercooler 7, but may also be provided in a position nearer the outlet of the intercooler 7.

The intermediate refrigerant tube 8 is also provided with a non-return mechanism 15 for allowing refrigerant to flow from the discharge side of the first-stage compression element 2*c* to the intake side of the second-stage compression element 2*d* and for blocking the refrigerant from flowing from the discharge side of the second-stage compression element 2*d* to the first-stage compression element 2*c*. The non-return mechanism 15 is a non-return valve in the present embodiment. In the present embodiment, the non-return mechanism 15 is provided to the intermediate refrigerant tube 8 in the portion leading away from the outlet of the intercooler 7 toward the part connecting with the intercooler bypass tube 9.

Furthermore, the air-conditioning apparatus 1 is provided with various sensors. Specifically, the heat source-side heat exchanger 4 is provided with a heat source-side heat exchange temperature sensor 51 for detecting the temperature of the refrigerant flowing through the heat source-side heat exchanger 4. The outlet of the intercooler 7 is provided with an intercooler outlet temperature sensor 52 for detecting the temperature of refrigerant at the outlet of the intercooler 7. The air-conditioning apparatus 1 is provided with an air temperature sensor 53 for detecting the temperature of the air as a heat source for the heat source-side heat exchanger 4 and intercooler 7. Though not shown in the drawings, the air-conditioning apparatus 1 has a controller for controlling the actions of the compression mechanism 2, the switching mechanism 3, the expansion mechanism 5, the heat source-side fan 40, the intercooler bypass on/off valve 11, the cooler on/off valve 12, and the other components constituting the air-conditioning apparatus 1.

(2) Action of the Air-Conditioning Apparatus

Figure 5:
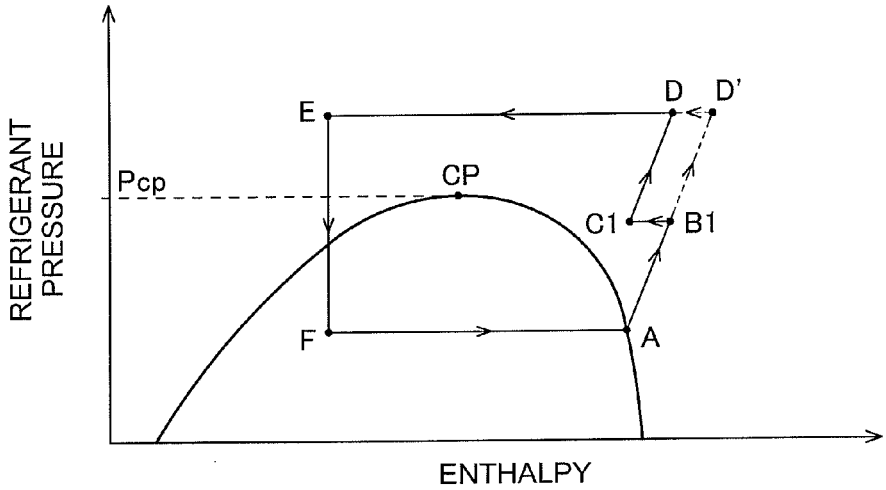
FIG. 5 is a pressure-enthalpy graph representing the refrigeration cycle during the air-cooling operation.
Figure 6:
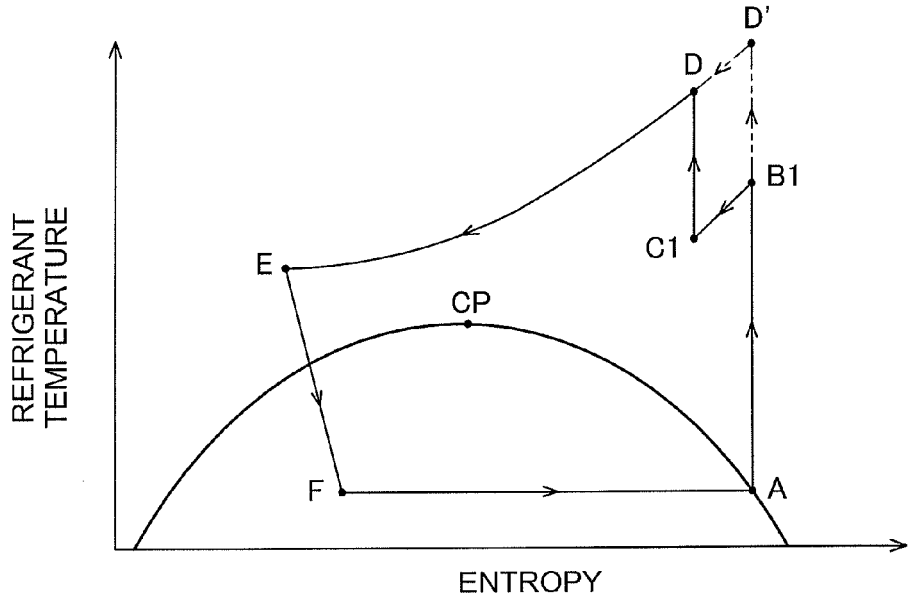
FIG. 6 is a temperature-entropy graph representing the refrigeration cycle during the air-cooling operation.
Figure 7:
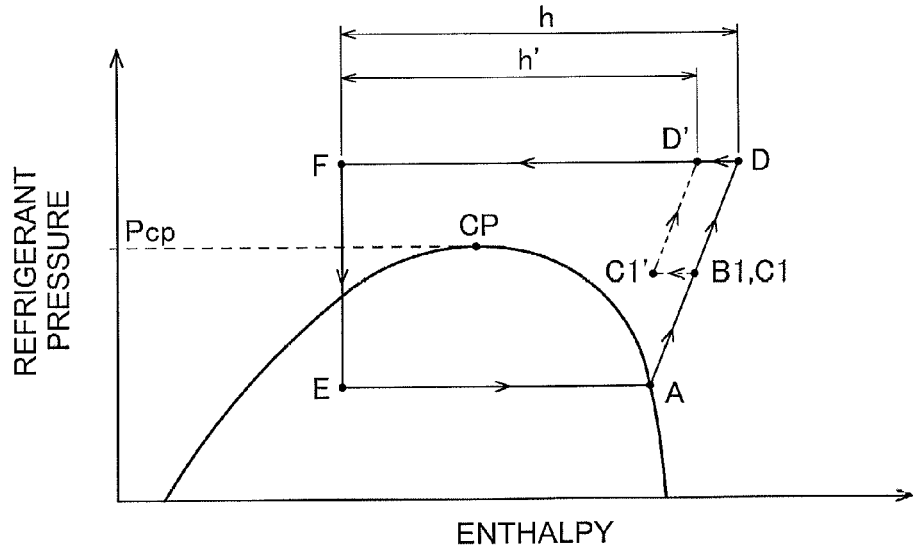
FIG. 7 is a pressure-enthalpy graph representing the refrigeration cycle during the air-warming operation.
Figure 8:
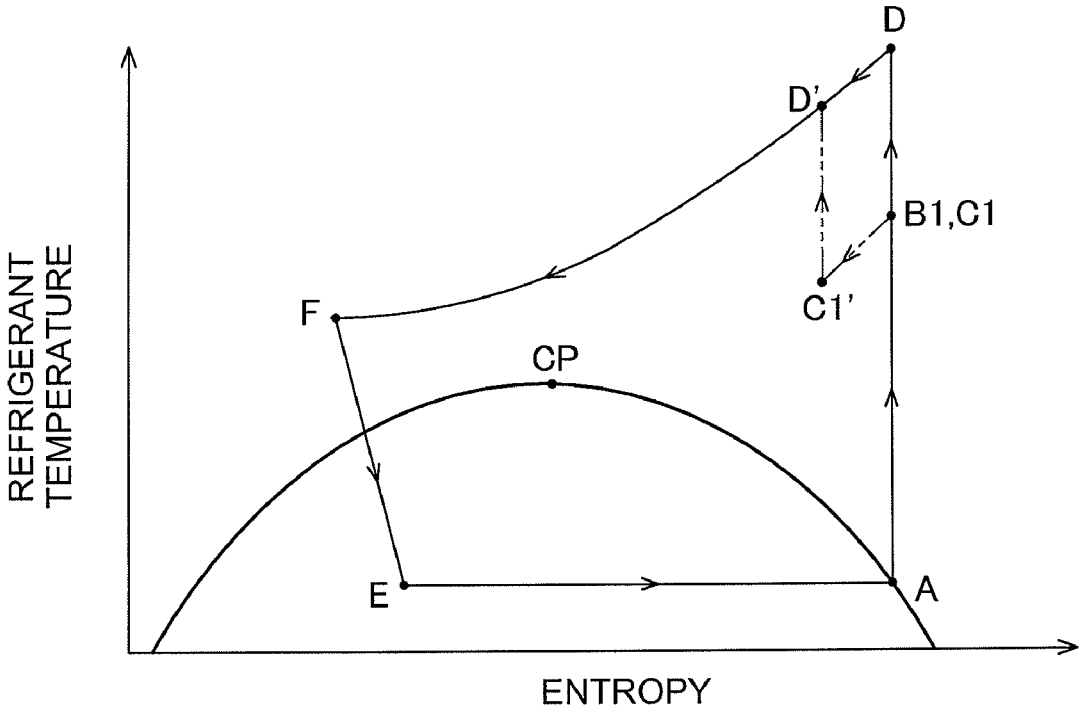
FIG. 8 is a temperature-entropy graph representing the refrigeration cycle during the air-warming operation.
Figure 9:
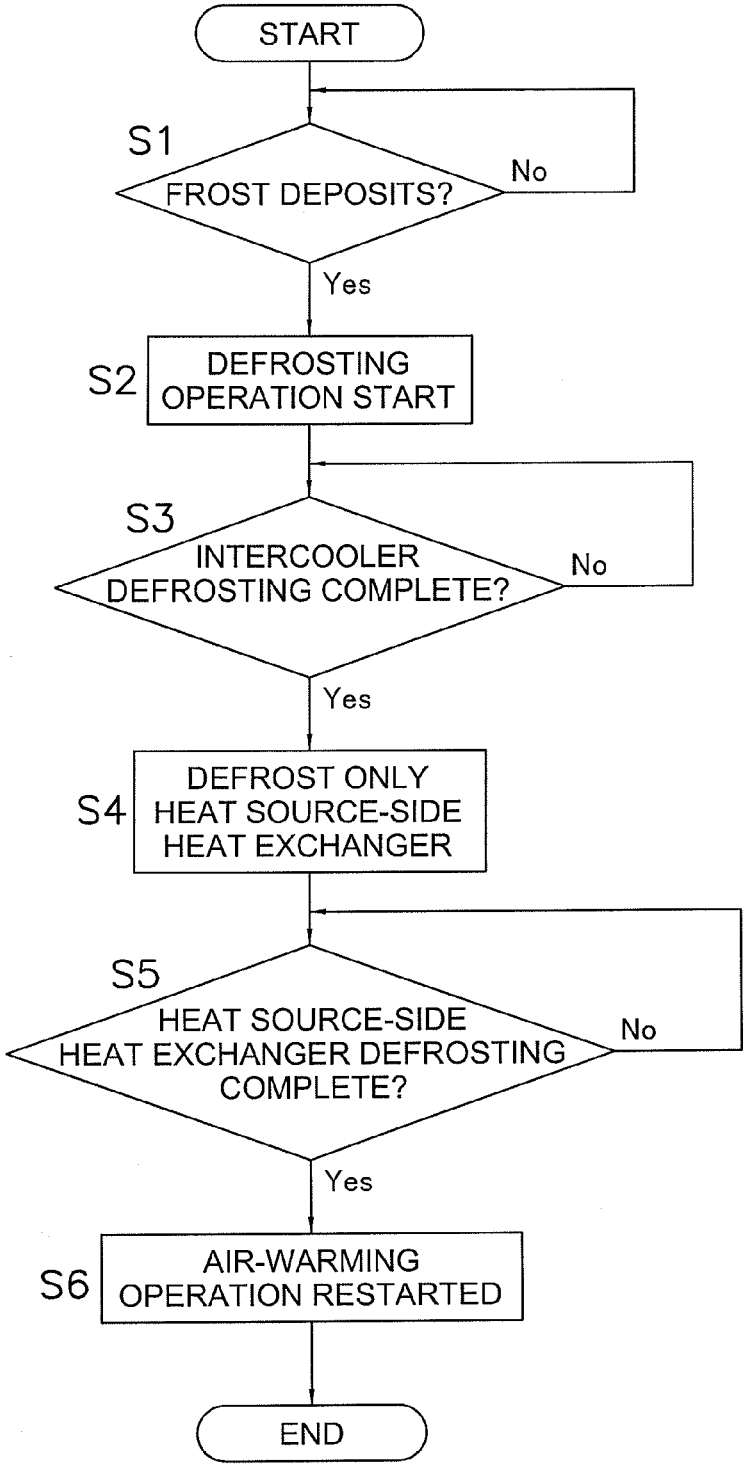
FIG. 9 is a flowchart of the defrosting operation.
Figure 10:
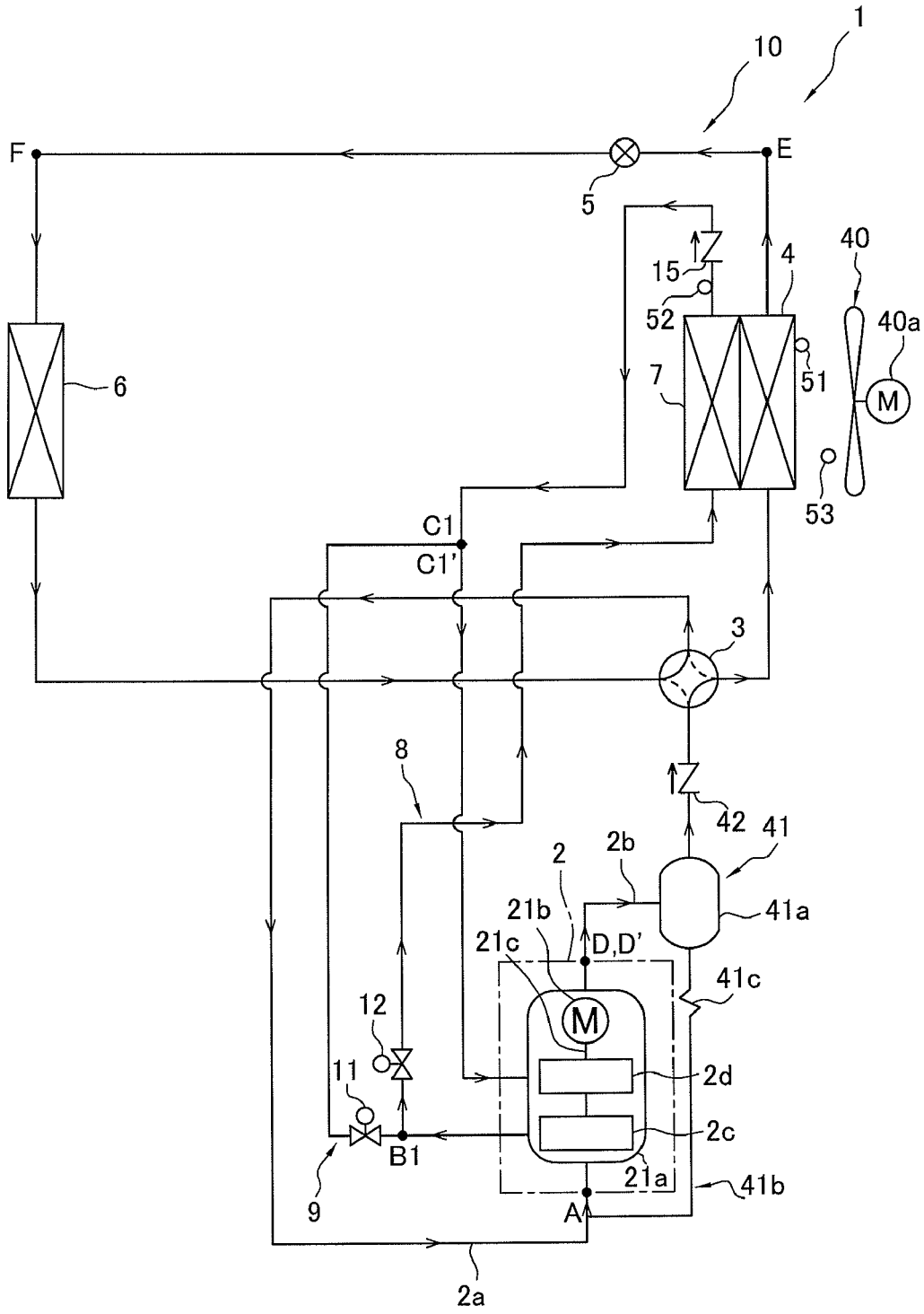
FIG. 10 is a diagram showing the flow of refrigerant within the air-conditioning apparatus at the start of the defrosting operation.
Figure 11:
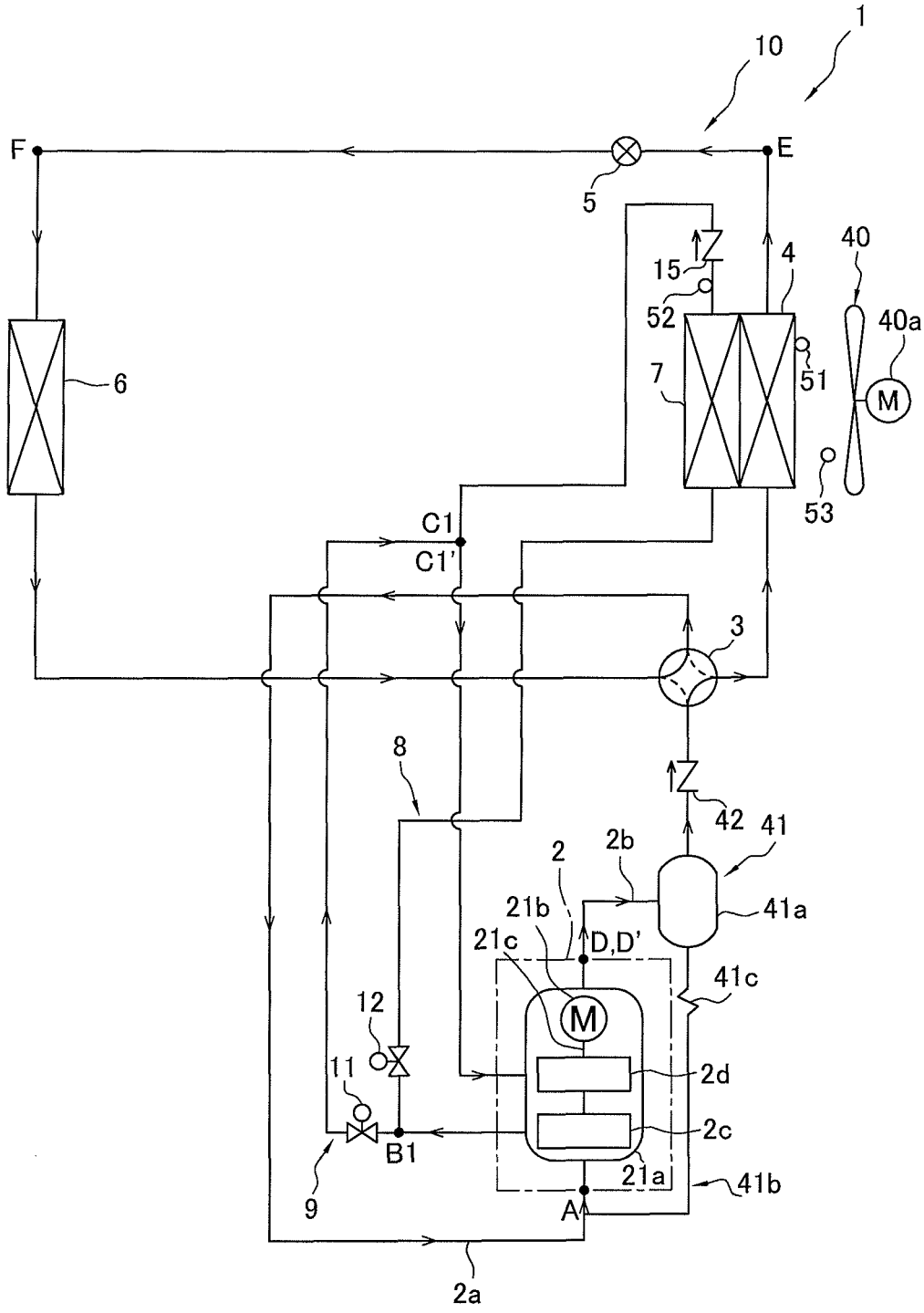
FIG. 11 is a diagram showing the flow of refrigerant within the air-conditioning apparatus after defrosting of the intercooler is complete.

Next, the action of the air-conditioning apparatus 1 of the present embodiment will be described using FIGS. 1 and 5 through 11. FIG. 5 is a pressure-enthalpy graph representing the refrigeration cycle during the air-cooling operation, FIG. 6 is a temperature-entropy graph representing the refrigeration cycle during the air-cooling operation, FIG. 7 is a pressure-enthalpy graph representing the refrigeration cycle during the air-warming operation, FIG. 8 is a temperature-entropy graph representing the refrigeration cycle during the air-warming operation, FIG. 9 is a flowchart of the defrosting operation, FIG. 10 is a diagram showing the flow of refrigerant within the air-conditioning apparatus 1 at the start of the defrosting operation, and FIG. 11 is a diagram showing the flow of refrigerant within the air-conditioning apparatus 1 after defrosting of the intercooler 7 is complete. Operation controls during the following air-cooling operation, air-warming operation, and defrosting operation are performed by the aforementioned controller (not shown). In the following description, the term "high pressure" means a high pressure in the refrigeration cycle (specifically, the pressure at points D, D', and E in FIGS. 5 and 6, and the pressure at points D, D', and F in FIGS. 7 and 8), the term "low pressure" means a low pressure in the refrigeration cycle (specifically, the pressure at points A and F in FIGS. 5 and 6, and the pressure at points A and E in FIGS. 7 and 8), and the term "intermediate pressure" means an intermediate pressure in the refrigeration cycle (specifically, the pressure at points B1, C1, and C1' in FIGS. 5 through 8).

<Air-Cooling Operation>

During the air-cooling operation, the switching mechanism 3 is set for the cooling operation as shown by the solid lines in FIG. 1. The opening degree of the expansion mechanism 5 is adjusted. Since the switching mechanism 3 is set for the cooling operation, the cooler on/off valve 12 is opened and the intercooler bypass on/off valve 11 of the intercooler bypass tube 9 is closed, whereby the intercooler 7 is set to function as a cooler.

When the compression mechanism 2 is driven while the refrigerant circuit 10 is in this state, low-pressure refrigerant (refer to point A in FIGS. 1, 5, and 6) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 1, 5, and 6). The intermediate-pressure refrigerant discharged from the first-stage compression element 2*c* is cooled in the intercooler 7 by undergoing heat exchange with the air as a cooling source (refer to point C1 in FIGS. 1, 5, and 6). The refrigerant cooled in the intercooler 7 is then led to and further compressed in the compression element 2*d* connected to the second-stage side of the compression element 2*c* after passing through the non-return mechanism 15, and the refrigerant is then discharged from the compression mechanism 2 to the discharge tube 2*b* (refer to point D in FIGS. 1, 5, and 6). The high-pressure refrigerant discharged from the compression mechanism 2 is compressed to a pressure exceeding a critical pressure (i.e., the critical pressure Pcp at the critical point CP shown in FIG. 5) by the two-stage compression action of the compression elements 2*c*, 2*d*. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant cooler. The high-pressure refrigerant fed to the heat source-side heat exchanger 4 is cooled in the heat source-side heat exchanger 4 by heat exchange with air as a cooling source (refer to point E in FIGS. 1, 5, and 6). The high-pressure refrigerant cooled in the heat source-side heat exchanger 4 is then depressurized by the expansion mechanism 5 to become a low-pressure gas-liquid two-phase refrigerant, which is fed to the usage-side heat exchanger 6 functioning as a refrigerant heater (refer to point F in FIGS. 1, 5, and 6). The low-pressure gas-liquid two-phase refrigerant fed to the usage-side heat exchanger 6 is heated by heat exchange with water or air as a heating source, and the refrigerant evaporates as a result (refer to point A in FIGS. 1, 5, and 6). The low-pressure refrigerant heated in the usage-side heat exchanger 6 is then led back into the compression mechanism 2 via the switching mechanism 3. In this manner the air-cooling operation is performed.

Thus, in the air-conditioning apparatus 1, the intercooler 7 is provided to the intermediate refrigerant tube 8 for letting refrigerant discharged from the compression element 2*c* into the compression element 2*d*, and during the air-cooling operation in which the switching mechanism 3 is set to a cooling operation state, the cooler on/off valve 12 is opened and the intercooler bypass on/off valve 11 of the intercooler bypass tube 9 is closed, thereby putting the intercooler 7 into a state of functioning as a cooler. Therefore, the refrigerant drawn into the compression element 2*d* on the second-stage side of the compression element 2*c* decreases in temperature (refer to points B1 and C1 in FIG. 6) and the refrigerant discharged from the compression element 2*d* also decreases in temperature (refer to points D and D' in FIG. 6), in comparison with cases in which no intercooler 7 is provided (in this case, the refrigeration cycle is performed in the sequence in FIGS. 5 and 6: point A→point B1→point D'→point E→point F). Therefore, in the heat source-side heat exchanger 4 functioning as a cooler of high-pressure refrigerant in this air-conditioning apparatus 1, operating efficiency can be improved over cases in which no intercooler 7 is provided, because the temperature difference between the refrigerant and air as the cooling source can be reduced, and heat radiation loss can be reduced by an amount equivalent to the area enclosed by connecting points B1, D', D, and C1 in FIG. 6.

<Air-Warming Operation>

During the air-warming operation, the switching mechanism 3 is set to a heating operation state shown by the dashed lines in FIG. 1. The opening degree of the expansion mechanism 5 is adjusted. Since the switching mechanism 3 is set to a heating operation state, the cooler on/off valve 12 is closed and the intercooler bypass on/off valve 11 of the intercooler bypass tube 9 is opened, thereby putting the intercooler 7 into a state of not functioning as a cooler.

When the compression mechanism 2 is driven during this state of the refrigerant circuit 10, low-pressure refrigerant (refer to point A in FIGS. 1, 7, and 8) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 1, 7, and 8). The intermediate-pressure refrigerant discharged from the first-stage compression element 2*c* passes through the intercooler bypass tube 9 (refer to point C1 in FIGS. 1, 7, and 8) without passing through the intercooler 7 (i.e., without being cooled), unlike in the air-cooling operation. The refrigerant is drawn into and further compressed in the compression element 2*d* connected to the second-stage side of the compression element 2*c*, and is discharged from the compression mechanism 2 to the discharge tube 2*b* (refer to point D in FIGS. 1, 7, and 8). The high-pressure refrigerant discharged from the compression mechanism 2 is compressed to a pressure exceeding a critical pressure (i.e., the critical pressure Pcp at the critical point CP shown in FIG. 7) by the two-stage compression action of the compression elements 2*c*, 2*d*, similar to the air-cooling operation. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the usage-side heat exchanger 6 functioning as a refrigerant cooler. The high-pressure refrigerant fed to the usage-side heat exchanger 6 is cooled in the usage-side heat exchanger 6 by heat exchange with water or air as a cooling source (refer to point F in FIGS. 1, 7, and 8). The high-pressure refrigerant cooled in the usage-side heat exchanger 6 is then depressurized by the expansion mechanism 5 to become a low-pressure gas-liquid two-phase refrigerant, which is fed to the heat source-side heat exchanger 4 functioning as a refrigerant heater (refer to point E in FIGS. 1, 7, and 8). The low-pressure gas-liquid two-phase refrigerant fed to the heat source-side heat exchanger 4 is heated by heat exchange with air as a heating source, and the refrigerant evaporates as a result (refer to point A in FIGS. 1, 7, and 8). The low-pressure refrigerant heated in the heat source-side heat exchanger 4 is then led back into the compression mechanism 2 via the switching mechanism 3. In this manner the air-warming operation is performed.

Thus, in the air-conditioning apparatus 1, the intercooler 7 is provided to the intermediate refrigerant tube 8 for letting refrigerant discharged from the compression element 2*c* into the compression element 2*d*, and during the air-warming operation in which the switching mechanism 3 is set to the heating operation state, the cooler on/off valve 12 is closed and the intercooler bypass on/off valve 11 of the intercooler bypass tube 9 is opened, thereby putting the intercooler 7 into a state of not functioning as a cooler. Therefore, the temperature decrease is minimized in the refrigerant discharged from the compression mechanism 2 (refer to points D and D' in FIG. 8), in comparison with cases in which only the intercooler 7 is provided or cases in which the intercooler 7 is made to function as a cooler similar to the air-cooling operation described above (in these cases, the refrigeration cycle is performed in the sequence in FIGS. 7 and 8: point A→point B1→point C1'→point D'→point F→point E). Therefore, in the air-conditioning apparatus 1, heat radiation to the exterior can be minimized, temperature decreases can be minimized in the refrigerant supplied to the usage-side heat exchanger 6 functioning as a refrigerant cooler, loss of heating performance can be minimized in proportion to the difference between the enthalpy difference h of points D and F and the enthalpy difference h' of points D' and F in FIG. 7, and loss of operating efficiency can be prevented, in comparison with cases in which only the intercooler 7 is provided or cases in which the intercooler 7 is made to function as a cooler similar to the air-cooling operation described above.

In the air-conditioning apparatus 1 as described above, not only is the intercooler 7 provided but the cooler on/off valve 12 and intercooler bypass tube 9 are provided as well. When these components are used to put the switching mechanism 3 into a cooling operation state, the intercooler 7 is made to function as a cooler, and when the switching mechanism 3 is brought to a heating operation state, the intercooler 7 does not function as a cooler. Therefore, in the air-conditioning apparatus 1, the temperature of the refrigerant discharged from the compression mechanism 2 can be kept low during the cooling operation as an air-cooling operation, and temperature decreases can be minimized in the refrigerant discharged from the compression mechanism 2 during the heating operation as an air-warming operation. During the air-cooling operation, heat radiation loss can be reduced in the heat source-side heat exchanger 4 functioning as a refrigerant cooler and operating efficiency can be improved, and during the air-warming operation, loss of heating performance can be minimized by minimizing temperature decreases in the refrigerant supplied to the usage-side heat exchanger 6 functioning as a refrigerant cooler, and decreases in operating efficiency can be prevented.

<Defrosting Operation>

In this air-conditioning apparatus 1, when the air-warming operation is performed while the air as the heat source of the heat source-side heat exchanger 4 has a low temperature, frost deposits form on the heat source-side heat exchanger 4 functioning as a refrigerant heater, and there is a danger that the heat transfer performance of the heat source-side heat exchanger 4 will thereby suffer. Defrosting of the heat source-side heat exchanger 4 must therefore be performed.

The defrosting operation of the present embodiment is described in detail hereinbelow using FIGS. 9 through 11.

First, in step S1, a determination is made as to whether or not frost deposits have formed on the heat source-side heat exchanger 4 during the air-warming operation. This is determined based on the temperature of the refrigerant flowing through the heat source-side heat exchanger 4 as detected by the heat source-side heat exchange temperature sensor 51, and/or on the cumulative time of the air-warming operation. For example, in cases in which the temperature of refrigerant in the heat source-side heat exchanger 4 as detected by the heat source-side heat exchange temperature sensor 51 is equal to or less than a predetermined temperature equivalent to conditions at which frost deposits occur, or in cases in which the cumulative time of the air-warming operation has elapsed past a predetermined time, it is determined that frost deposits have occurred in the heat source-side heat exchanger 4. In cases in which these temperature conditions or time conditions are not met, it is determined that frost deposits have not occurred in the heat source-side heat exchanger 4. Since the predetermined temperature and predetermined time depend on the temperature of the air as a heat source, the predetermined temperature and predetermined time are preferably set as a function of the air temperature detected by the air temperature sensor 53. In cases in which a temperature sensor is provided to the inlet or outlet of the heat source-side heat exchanger 4, the refrigerant temperature detected by these temperature sensors may be used in the determination of the temperature conditions instead of the refrigerant temperature detected by the heat source-side heat exchange temperature sensor 51. In cases in which it is determined in step S1 that frost deposits have occurred in the heat source-side heat exchanger 4, the process advances to step S2.

Next, in step S2, the defrosting operation is started. The defrosting operation is a reverse cycle defrosting operation in which the heat source-side heat exchanger 4 is made to function as a refrigerant cooler by switching the switching mechanism 3 from the heating operation state (i.e., the air-warming operation) to the cooling operation state. Moreover, there is a danger in the present embodiment that frost deposits will occur in the intercooler 7 as well because a heat exchanger whose heat source is air is used as the intercooler 7 and the intercooler 7 is integrated with the heat source-side heat exchanger 4; therefore, refrigerant must be passed through not only the heat source-side heat exchanger 4 but also the intercooler 7 and the intercooler 7 must be defrosted. In view of this, at the start of the defrosting operation, similar to the air-cooling operation described above, an operation is performed whereby the heat source-side heat exchanger 4 is made to function as a refrigerant cooler by switching the switching mechanism 3 from the heating operation state (i.e., the air-warming operation) to the cooling operation state (i.e., the air-cooling operation), the cooler on/off valve 12 is opened, and the intercooler bypass on/off valve 11 is closed, and the intercooler 7 is thereby made to function as a cooler (refer to the arrows indicating the flow of refrigerant in FIG. 10).

Next, in step S3, a determination is made as to whether or not defrosting of the intercooler 7 is complete. The reason for determining whether or not defrosting of the intercooler 7 is complete is because the intercooler 7 is made to not function as a cooler by the intercooler bypass tube 9 during the air-warming operation as described above; therefore, the amount of frost deposited in the intercooler 7 is small, and defrosting of the intercooler 7 is completed sooner than the heat source-side heat exchanger 4. This determination is made based on the refrigerant temperature at the outlet of the intercooler 7. For example, in the case that the refrigerant temperature at the outlet of the intercooler 7 as detected by the intercooler outlet temperature sensor 52 is detected to be equal to or greater than a predetermined temperature, defrosting of the intercooler 7 is determined to be complete, and in the case that this temperature condition is not met, it is determined that defrosting of the intercooler 7 is not complete. It is possible to reliably detect that defrosting of the intercooler 7 has completed by this determination based on the refrigerant temperature at the outlet of the intercooler 7. In the case that it has been determined in step S3 that defrosting of the intercooler 7 is complete, the process advances to step S4.

Next, the process transitions in step S4 from the operation of defrosting both the intercooler 7 and the heat source-side heat exchanger 4 to an operation of defrosting only the heat source-side heat exchanger 4. The reason this operation transition is made after defrosting of the intercooler 7 is complete is because when refrigerant continues to flow to the intercooler 7 even after defrosting of the intercooler 7 is complete, heat is radiated from the intercooler 7 to the exterior, the temperature of the refrigerant drawn into the second-stage compression element 2*d* decreases, and as a result, a problem occurs in that the temperature of the refrigerant discharged from the compression mechanism 2 decreases and the defrosting capacity of the heat source-side heat exchanger 4 suffers. The operation transition is therefore made so that this problem does not occur. This operation transition in step S4 allows an operation to be performed for making the intercooler 7 not function as a cooler, by closing the cooler on/off valve 12 and opening the intercooler bypass on/off valve 11 while the heat source-side heat exchanger 4 continues to be defrosted by the reverse cycle defrosting operation (refer to the arrows indicating the flow of refrigerant in FIG. 11). Heat is thereby prevented from being radiated from the intercooler 7 to the exterior, the temperature of the refrigerant drawn into the second-stage compression element 2*d* is therefore prevented from decreasing, and as a result, temperature decreases can be minimized in the refrigerant discharged from the compression mechanism 2, and the decrease in the capacity to defrost the heat source-side heat exchanger 4 can be minimized.

Next, in step S5, a determination is made as to whether or not defrosting of the heat source-side heat exchanger 4 has completed. This determination is made based on the temperature of refrigerant flowing through the heat source-side heat exchanger 4 as detected by the heat source-side heat exchange temperature sensor 51, and/or on the operation time of the defrosting operation. For example, in the case that the temperature of refrigerant in the heat source-side heat exchanger 4 as detected by the heat source-side heat exchange temperature sensor 51 is equal to or greater than a temperature equivalent to conditions at which frost deposits do not occur, or in the case that the defrosting operation has continued for a predetermined time or longer, it is determined that defrosting of the heat source-side heat exchanger 4 has completed. In the case that the temperature conditions or time conditions are not met, it is determined that defrosting of the heat source-side heat exchanger 4 is not complete. In the case that a temperature sensor is provided to the inlet or outlet of the heat source-side heat exchanger 4, the temperature of the refrigerant as detected by either of these temperature sensors may be used in the determination of the temperature conditions instead of the refrigerant temperature detected by the heat source-side heat exchange temperature sensor 51. In cases in which it is determined in step S5 that defrosting of the heat source-side heat exchanger 4 has completed, the process transitions to step S6, the defrosting operation ends, and the process for restarting the air-warming operation is again performed. More specifically, a process is performed for switching the switching mechanism 3 from the cooling operation state to the heating operation state (i.e. the air-warming operation).

As described above, in the air-conditioning apparatus 1, when a defrosting operation is performed for defrosting the heat source-side heat exchanger 4 by making the heat source-side heat exchanger 4 function as a refrigerant cooler, the refrigerant flows to the heat source-side heat exchanger 4 and the intercooler 7, and after it is detected that defrosting of the intercooler 7 is complete, the intercooler bypass tube 9 is used to ensure that refrigerant no longer flows to the intercooler 7. It is thereby possible, when the defrosting operation is performed in the air-conditioning apparatus 1, to also defrost the intercooler 7, to minimize the loss of defrosting capacity resulting from the radiation of heat from the intercooler 7 to the exterior, and to contribute to reducing defrosting time.

Figure 12:
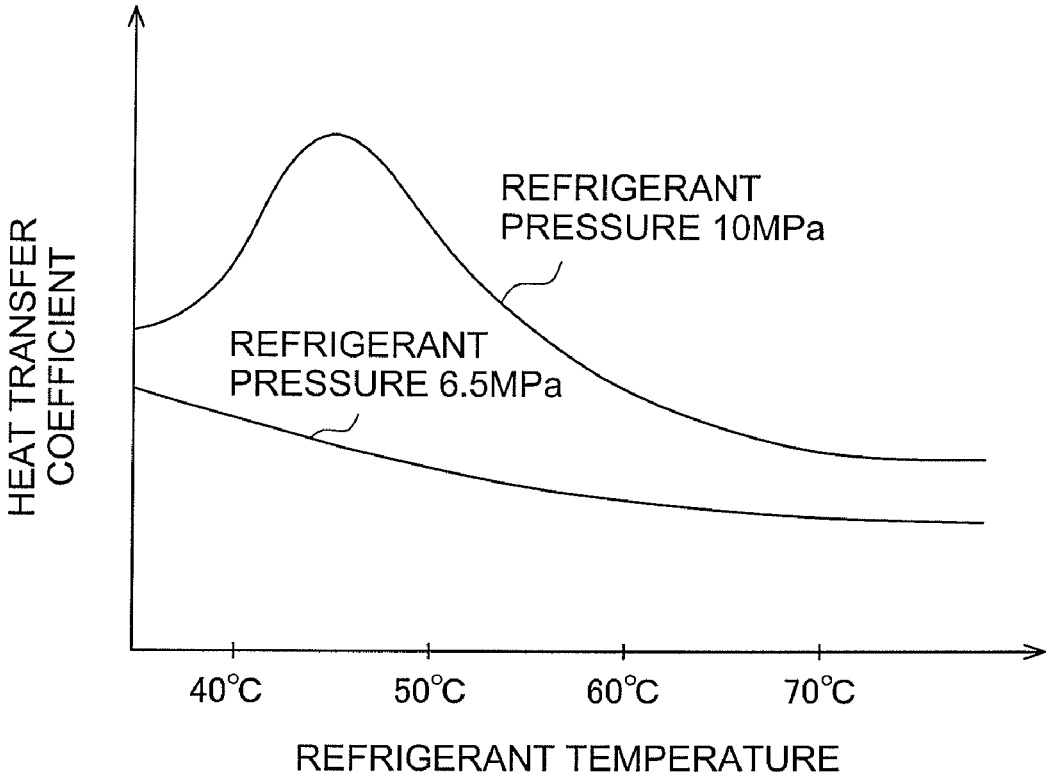
FIG. 12 is a graph showing the physical properties of the heat transfer coefficient when carbon dioxide of an intermediate pressure lower than the critical pressure flows into the heat transfer channels, and the physical properties of the heat transfer coefficient when carbon dioxide of a high pressure exceeding the critical pressure flows into the heat transfer channels.

Since a refrigerant that operates in a critical range (carbon dioxide in this case) is used in the air-conditioning apparatus 1, an air-cooling operation or other refrigeration cycle is sometimes performed in which refrigerant of an intermediate pressure lower than the critical pressure Pcp (about 7.3 MPa with carbon dioxide) flows into the intercooler 7, and refrigerant of a high pressure exceeding the critical pressure Pcp flows into the heat source-side heat exchanger 4 functioning as a refrigerant cooler (see FIG. 5). In this case, the difference between the physical properties of the refrigerant whose pressure is lower than the critical pressure Pcp and the physical properties (particularly the heat transfer coefficient and the specific heat at constant pressure) of the refrigerant whose pressure exceeds the critical pressure Pcp leads to a tendency of the heat transfer coefficient of the refrigerant in the intercooler 7 to be lower than the heat transfer coefficient of the refrigerant in the heat source-side heat exchanger 4, as shown in FIG. 12. FIG. 12 shows the heat transfer coefficient values (corresponding to the heat transfer coefficient of the refrigerant in the intercooler 7) when 6.5 MPa carbon dioxide flows at a predetermined mass flow rate into heat transfer channels having a predetermined channel cross section, as well as the heat transfer coefficient values (corresponding to the heat transfer coefficient of the refrigerant in the heat source-side heat exchanger 4) of 10 MPa carbon dioxide in the same heat transfer channels and in the same mass flow rate conditions as the 6.5 MPa carbon dioxide. It can be seen from this graph that within the temperature range (about 35 to 70° C.) of the refrigerant flowing through the intercooler 7 or the heat source-side heat exchanger 4 functioning as a refrigerant cooler, the heat transfer coefficient values of the 6.5 MPa carbon dioxide are less than the heat transfer coefficient values of the 10 MPa carbon dioxide.

Therefore, in the heat source unit 1*a* of the air-conditioning apparatus 1 of the present embodiment (i.e., a heat source unit configured so as to draw in air from the side and blow out the air upward), if the intercooler 7 is integrated with the heat source-side heat exchanger 4 in a state of being disposed underneath the heat source-side heat exchanger 4, the intercooler 7 integrated with the heat source-side heat exchanger 4 will be disposed in the lower part of heat source unit 1*a* where air as a heat source flows at a low speed; and there is a limit to the extent by which the heat transfer area of the intercooler 7 can be increased due to the fact that the effect of a reduction in the heat transfer coefficient of air in the intercooler 7, as caused by placing the intercooler 7 in the lower part of the heat source unit 1*a*, and the effect of a lower heat transfer coefficient of the refrigerant in the intercooler 7 in comparison with the heat transfer coefficient of the refrigerant in the heat source-side heat exchanger 4 are combined together to reduce the overall heat transfer coefficient of the intercooler 7, and also due to the fact that the intercooler 7 is integrated with the heat source-side heat exchanger 4. Therefore, the heat transfer performance of the intercooler is reduced as a result, but in the present embodiment, since the intercooler 7 is integrated with the heat source-side heat exchanger 4, and the intercooler 7 is disposed in the upper part of the heat exchanger panel 70 in which the two components are integrated (in this case, since the intercooler 7 is integrated with the heat source-side heat exchanger 4 in a state of being disposed above the heat source-side heat exchanger 4), the intercooler 7 is disposed in the top part of the heat source unit 1*a* where air as a heat source flows at a high speed, and the heat transfer coefficient of air in the intercooler 7 increases. As a result, the decrease in the overall heat transfer coefficient of the intercooler 7 is minimized, and the loss of heat transfer performance in the intercooler 7 can be minimized as well.

In the air-conditioning apparatus 1 of the present embodiment, if the intercooler 7 is integrated with the heat source-side heat exchanger 4 in a state of being disposed underneath the heat source-side heat exchanger 4, the icing-up phenomenon readily occurs due to water melted by the above-described defrosting operation adhering to the surface of the intercooler 7, but in the present embodiment, since the intercooler 7 is integrated with the heat source-side heat exchanger 4, and the intercooler 7 is disposed in the upper part of the heat exchanger panel 70 in which the two components are integrated (in this case, since the intercooler 7 is integrated with the heat source-side heat exchanger 4 in a state of being disposed above the heat source-side heat exchanger 4), water that is melted by the defrosting operation and drips down from the heat source-side heat exchanger 4 does not readily adhere to the intercooler 7, the icing-up phenomenon is suppressed, and the reliability of the equipment can be improved. Moreover, since water melted by the above-described defrosting operation does not readily adhere to the surface of the intercooler 7, the time needed for defrosting the intercooler 7 can be greatly reduced in the above-described defrosting operation.

(3) Modification 1

Figure 13:
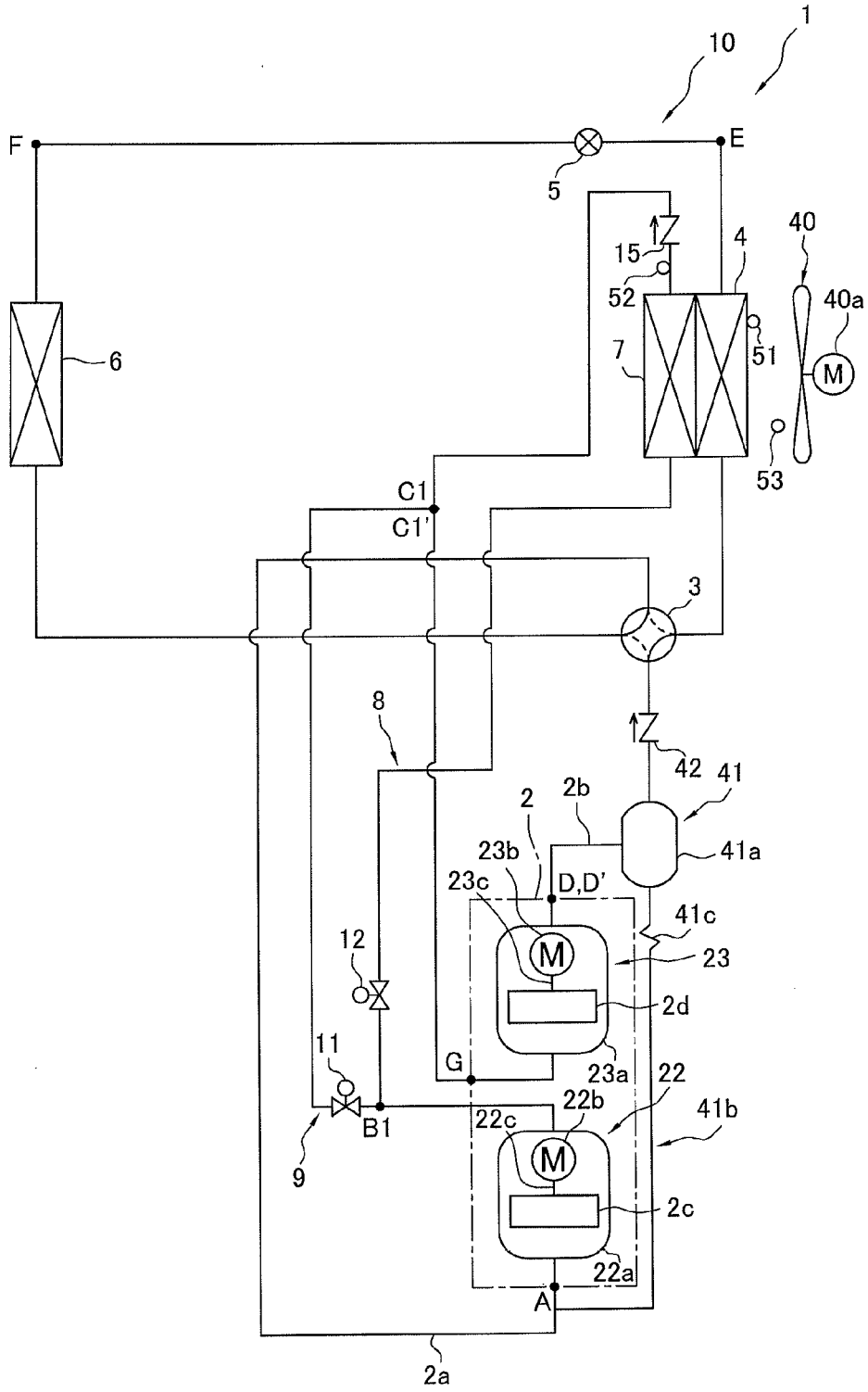
FIG. 13 is a schematic structural diagram of an air-conditioning apparatus according to Modification 1.

In the above-described embodiment, a two-stage compression-type compression mechanism 2 is configured from the single compressor 21 having a single-shaft two-stage compression structure, wherein two compression elements 2*c*, 2*d* are provided and refrigerant discharged from the first-stage compression element is sequentially compressed in the second-stage compression element, but another possible option is to configure a compression mechanism 2 having a two-stage compression structure by connecting two compressors in series, each of which compressors having a single-stage compression structure in which one compression element is rotatably driven by one compressor drive motor, as shown in FIG. 13.

The compression mechanism 2 has a compressor 22 and a compressor 23. The compressor 22 has a hermetic structure in which a casing 22*a* houses a compressor drive motor 22*b*, a drive shaft 22*c*, and a compression element 2*c*. The compressor drive motor 22*b* is coupled with the drive shaft 22*c*, and the drive shaft 22*c* is coupled with the compression element 2*c*. The compressor 23 has a hermetic structure in which a casing 23*a* houses a compressor drive motor 23*b*, a drive shaft 23*c*, and a compression element 2*d*. The compressor drive motor 23*b* is coupled with the drive shaft 23*c*, and the drive shaft 23*c* is coupled with the compression element 2*d*. As in the above-described embodiment, the compression mechanism 2 is configured so as to admit refrigerant through an intake tube 2*a*, discharge the drawn-in refrigerant to an intermediate refrigerant tube 8 after the refrigerant has been compressed by the compression element 2*c*, and discharge the refrigerant discharged to a discharge tube 2*b* after the refrigerant has been drawn into the compression element 2*d* and further compressed.

The same operational effects of the above-described embodiment can be achieved with the configuration of Modification 1.

(4) Modification 2

Figure 14:
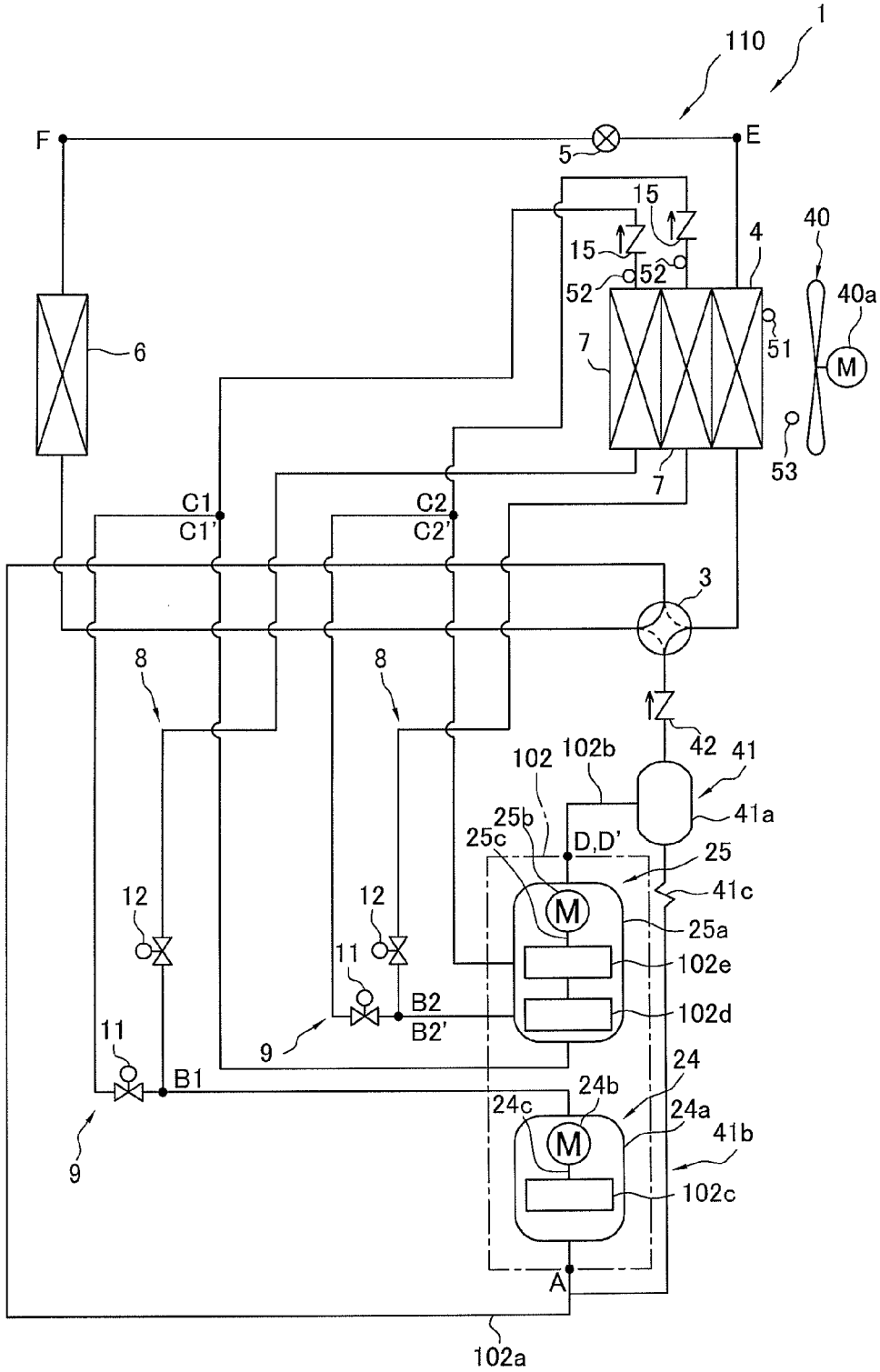
FIG. 14 is a schematic structural diagram of an air-conditioning apparatus according to Modification 2.
Figure 15:
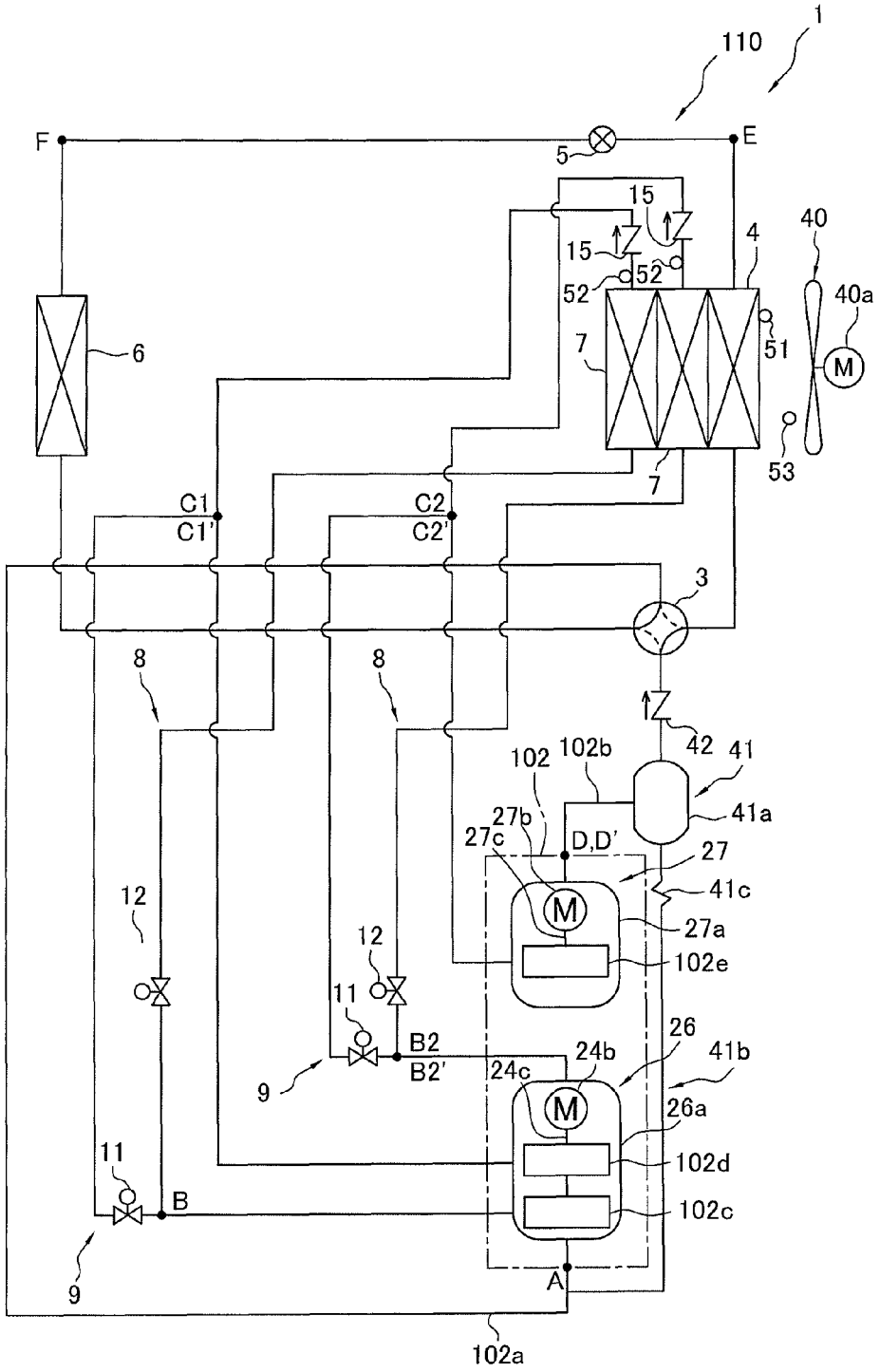
FIG. 15 is a schematic structural diagram of an air-conditioning apparatus according to Modification 2.
Figure 16:
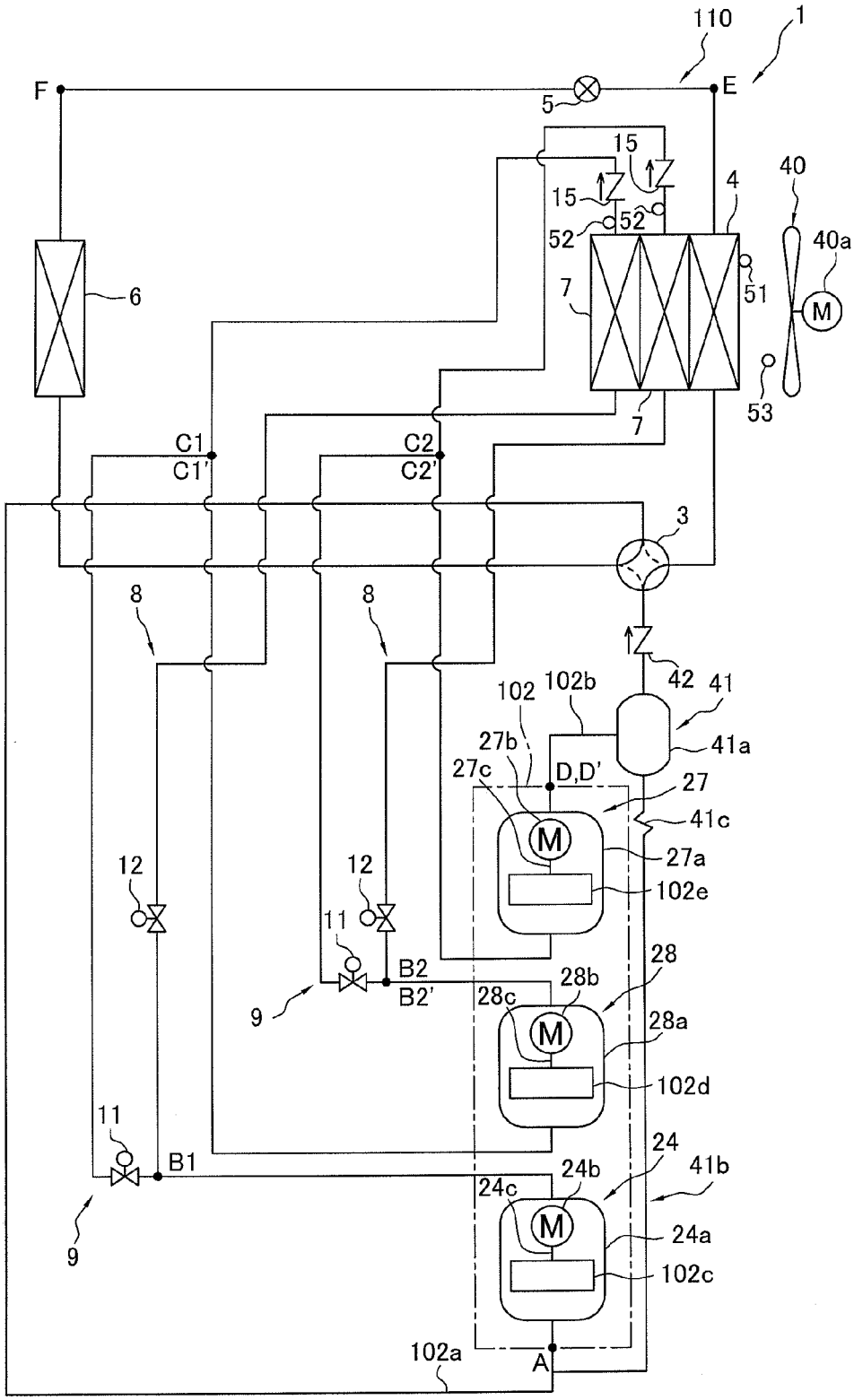
FIG. 16 is a schematic structural diagram of an air-conditioning apparatus according to Modification 2.

In the above-described embodiment and the modification thereof, a two-stage-compression-type compression mechanism 2 was used in which two compression elements 2*c*, 2*d* were provided and a refrigerant discharged from the first-stage compression element was sequentially compressed by the second-stage compression element as shown in FIGS. 1, 10, and others, but another possible option is to use a three-stage-compression-type compression mechanism 102 in which three compression elements 102*c*, 102*d*, 102*e* are provided, and a refrigerant discharged from the first-stage compression element is sequentially compressed by the second-stage compression element, as shown in FIGS. 14 through 16.

First, the configuration of the air-conditioning apparatus 1 which performs a three-stage-compression-type refrigeration cycle shown in FIG. 14 will be described. As in the above-described embodiment and the modification thereof, the air-conditioning apparatus 1 herein has a refrigerant circuit 110 configured to be capable of switching between an air-cooling operation and an air-warming operation, and uses a refrigerant that operates in a supercritical range (carbon dioxide in this case). The refrigerant circuit 110 of the air-conditioning apparatus 1 has primarily a three-stage-compression-type compression mechanism 102, a switching mechanism 3, a heat source-side heat exchanger 4, an expansion mechanism 5, a usage-side heat exchanger 6, and two intercoolers 7. The devices are described next, but since the heat source-side heat exchanger 4, the expansion mechanism 5, the usage-side heat exchanger 6, and the controller (not shown) are identical to the embodiment described above, descriptions thereof are omitted.

In FIG. 14, the compression mechanism 102 is configured by a series connection between a compressor 24 for compressing refrigerant in one stage with a single compression element, and a compressor 25 for compressing refrigerant in two stages with two compression elements. The compressor 24 has a hermetic structure in which a casing 24*a* houses a compressor drive motor 24*b*, a drive shaft 24*c*, and the compression element 102*c*, similar to the compressors 22, 23 having single-stage compression structures in Modification 1 described above. The compressor drive motor 24*b* is coupled with the drive shaft 24*c*, and the drive shaft 24*c* is coupled with the compression element 102*c*. The compressor 25 also has a hermetic structure in which a casing 25*a* houses a compressor drive motor 25*b*, a drive shaft 25*c*, and the compression elements 102*d*, 102*e*, similar to the compressor 21 having a two-stage compression structure in the embodiment described above. The compressor drive motor 25*b* is coupled with the drive shaft 25*c*, and the drive shaft 25*c* is coupled with the two compression elements 102*d*, 102*e*. The compressor 24 is configured so that refrigerant is drawn in through an intake tube 102*a*, the drawn-in refrigerant is compressed by the compression element 102*c*, and the refrigerant is then discharged to an intermediate refrigerant tube 8 for drawing refrigerant into the compression element 102*d* connected to the second-stage side of the compression element 102*c*. The compressor 25 is configured so that refrigerant discharged to this intermediate refrigerant tube 8 is drawn into the compression element 102*d* and further compressed, after which the refrigerant is discharged to an intermediate refrigerant tube 8 for drawing refrigerant into the compression element 102*e* connected to the second-stage side of the compression element 102*d*, the refrigerant discharged to the intermediate refrigerant tube 8 is drawn into the compression element 102*e* and further compressed, and the refrigerant is then discharged to a discharge tube 102*b*.

Instead of the configuration shown in FIG. 14 (specifically, a configuration in which a single-stage compression-type compressor 24 and a two-stage compression-type compressor 25 are connected in series), another possible option is a configuration in which a two-stage compression-type compressor 26 and a single-stage compression-type compressor 27 are connected in series as shown in FIG. 15. In this case, the compressor 26 has compression elements 102*c*, 102*d*, and the compressor 27 has a compression element 102*e*. A configuration is therefore obtained in which three compression elements 102*c*, 102*d*, 102*e* are connected in series, similar to the configuration shown in FIG. 14. Since the compressor 26 has the same configuration as the compressor 21 in the previous embodiment, and the compressor 27 has the same configuration as the compressors 22, 23 in Modification 1 described above, the symbols indicating components other than the compression elements 102*c*, 102*d*, 102*e* are replaced by symbols beginning with the numbers 26 and 27, and descriptions of these components are omitted.

Furthermore, instead of the configuration shown in FIG. 14 (specifically, a configuration in which a single-stage-compression-type compressor 24 and a two-stage-compression-type compressor 25 are connected in series), another possible option is a configuration in which three single-stage-compression-type compressors 24, 28, 27 are connected in series as shown in FIG. 16. In this case, the compressor 24 has a compression element 102*c*, the compressor 28 has a compression element 102*d*, and the compressor 27 has a compression element 102*e*, and a configuration is therefore obtained in which three compression elements 102*c*, 102*d*, 102*e* are connected in series, similar to the configurations shown in FIGS. 14 and 15. Since the compressors 24, 28 have the same structure as the compressors 22, 23 in Modification 1 described above, the symbols indicating components other than the compression elements 102*c*, 102*d* are replaced by symbols beginning with the numbers 24 and 28, and descriptions of these components are omitted.

Thus, in the present modification, the compression mechanism 102 has three compression elements 102*c*, 102*d*, 102*e*, and the compression mechanism is configured so that refrigerant discharged from the first-stage compression elements of these compression elements 102*c*, 102*d*, 102*e* is sequentially compressed in second-stage compression elements.

The intercoolers 7 are provided to the intermediate refrigerant tubes 8. Specifically, one intercooler 7 is provided as a heat exchanger that functions as a cooler of the refrigerant discharged from the first-stage compression element 102*c* and drawn into the compression element 102*d*, and the other intercooler 7 is provided as a heat exchanger that functions as a cooler of the refrigerant discharged from the first-stage compression element 102*d* and drawn into the compression element 102*e*. As in the embodiment described above, these intercoolers 7 are also integrated with the heat source-side heat exchanger 4 in a state of being disposed above the heat source-side heat exchanger 4 (see FIGS. 2 through 4).

Intercooler bypass tubes 9 are connected to the intermediate refrigerant tubes 8 so as to bypass the intercoolers 7 as in the embodiment described above, and the intercooler bypass tubes 9 are provided with intercooler bypass on/off valves 11 which are controlled so as to close when the switching mechanism 3 is set to the cooling operation state and to open when the switching mechanism 3 is set to the heating operation state.

As in the embodiment described above, cooler on/off valves 12, which are controlled so as to open when the switching mechanism 3 is set to the cooling operation state and to close when the switching mechanism 3 is set to the heating operation state, are provided to the intermediate refrigerant tube 8 at positions leading toward the intercoolers 7 from the connections with the intercooler bypass tubes 9 (in other words, the sections leading from the connections with the intercooler bypass tubes 9 on the inlet sides of the intercoolers 7 to the outlet sides of the intercoolers 7, and the sections leading from the connections with the intercooler bypass tubes 9 on the inlet sides of the intercoolers 7 to the connections on the outlet sides of the intercoolers 7).

Furthermore, as in the above-described embodiment, the air-conditioning apparatus 1 is provided with a heat source-side heat exchange temperature sensor 51 for detecting the temperature of refrigerant flowing through the heat source-side heat exchanger 4, intercooler outlet temperature sensors 52 for detecting the temperature of the refrigerant at the outlets of the intercoolers 7, and an air temperature sensor 53 for detecting the temperature of the air as a heat source of the heat source-side heat exchanger 4 and the two intercoolers 7.

Figure 17:
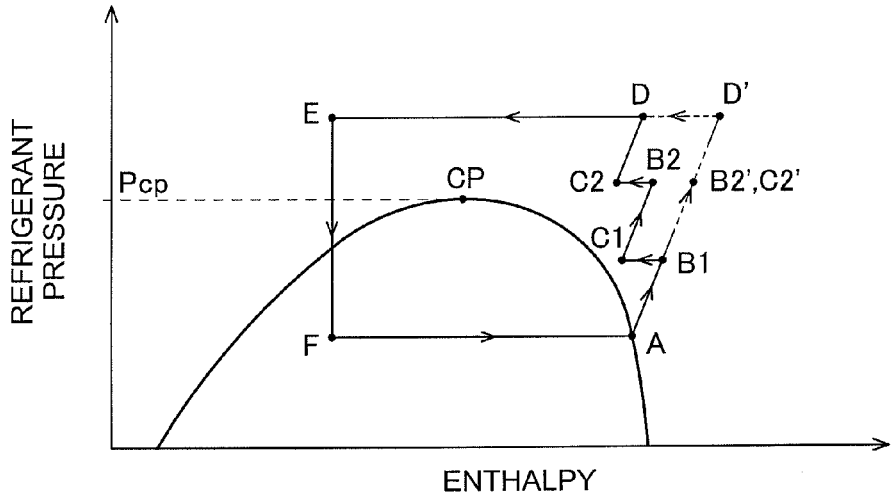
FIG. 17 is a pressure-enthalpy graph representing the refrigeration cycle during the air-cooling operation in the air-conditioning apparatus according to Modification 2.
Figure 18:
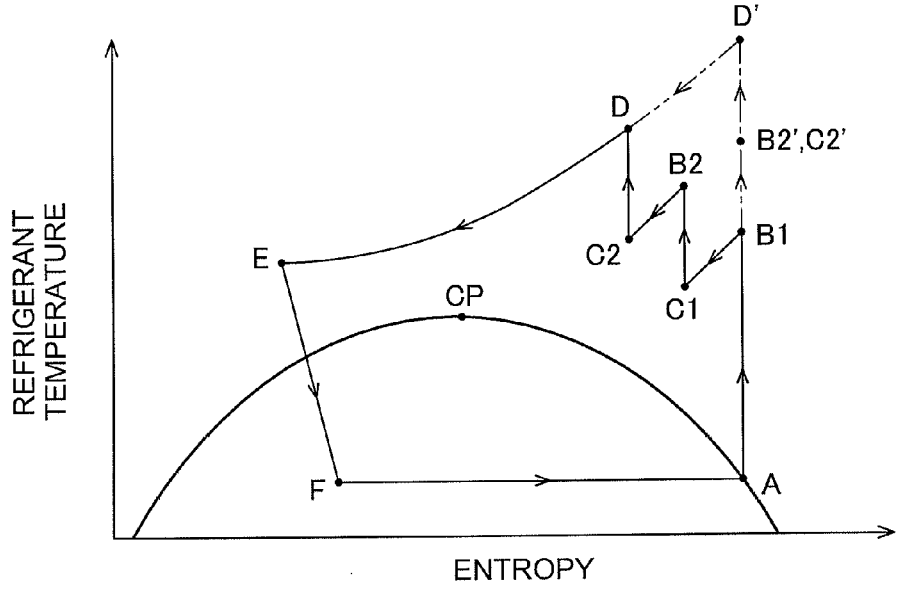
FIG. 18 is a temperature-entropy graph representing the refrigeration cycle during the air-cooling operation in the air-conditioning apparatus according to Modification 2.
Figure 19:
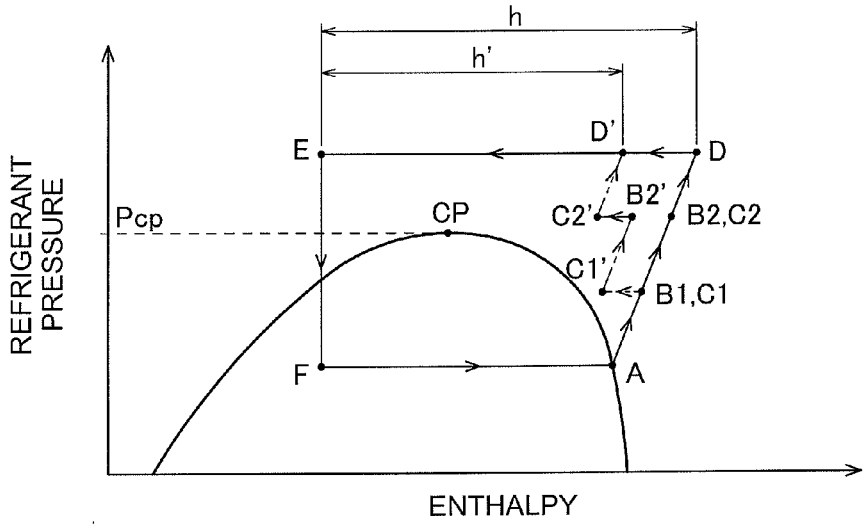
FIG. 19 is a pressure-enthalpy graph representing the refrigeration cycle during the air-warming operation in the air-conditioning apparatus according to Modification 2.
Figure 20:
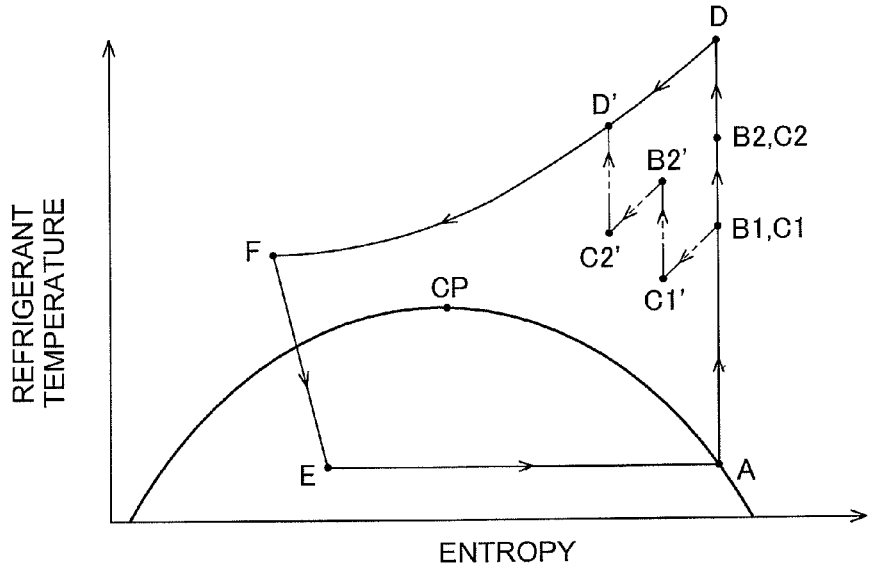
FIG. 20 is a temperature-entropy graph representing the refrigeration cycle during the air-warming operation in the air-conditioning apparatus according to Modification 2.

Next, the action of the air-conditioning apparatus 1 of the present modification will be described using FIGS. 14 to 20. FIG. 17 is a pressure-enthalpy graph representing the refrigeration cycle during the air-cooling operation in Modification 2, FIG. 18 is a temperature-entropy graph representing the refrigeration cycle during the air-cooling operation in Modification 2, FIG. 19 is a pressure-enthalpy graph representing the refrigeration cycle during the air-warming operation in Modification 2, and FIG. 20 is a temperature-entropy graph representing the refrigeration cycle during the air-warming operation in Modification 2. Operation controls during the air-cooling operation, air-warming operation, and defrosting operation described hereinbelow are performed by the aforementioned controller (not shown). In the following description, the term "high pressure" means a high pressure in the refrigeration cycle (specifically, the pressure at points D, D', and E in FIGS. 17 and 18, and the pressure at points D, D', and F in FIGS. 19 and 20), the term "low pressure" means a low pressure in the refrigeration cycle (specifically, the pressure at points A and F in FIGS. 17 and 18, and the pressure at points A and E in FIGS. 19 and 20), and the term "intermediate pressure" means an intermediate pressure in the refrigeration cycle (specifically, the pressure at points B1, B2, B2', C1, C1', C2, and C2' in FIGS. 17 through 20).

<Air-Cooling Operation>

During the air-cooling operation, the switching mechanism 3 is set for the cooling operation as shown by the solid lines in FIGS. 14 through 16. The opening degree of the expansion mechanism 5 is adjusted. Since the switching mechanism 3 is set for the cooling operation, the cooler on/off valves 12 are opened and the intercooler bypass on/off valves 11 of the intercooler bypass tubes 9 are closed, whereby the intercoolers 7 are set to function as a coolers.

When the compression mechanism 102 is driven while the refrigerant circuit 110 is in this state, low-pressure refrigerant (refer to point A in FIGS. 14 through 18) is drawn into the compression mechanism 102 through the intake tube 102*a*, and after being first compressed to an intermediate pressure by the compression element 102*c*, the refrigerant is discharged to the intermediate refrigerant tube 8 (refer to point B1 in FIGS. 14 through 18). The intermediate-pressure refrigerant discharged from the first-stage compression element 102*c* is cooled in the intercoolers 7 by heat exchange with air as a cooling source (refer to point C1 in FIGS. 14 through 18). The refrigerant cooled in the intercoolers 7 is then passed through the non-return mechanism 15, drawn into the compression element 102*d* connected to the second-stage side of the compression element 102*c*, further compressed, and then discharged to the intermediate refrigerant tube 8 (refer to point B2 in FIGS. 14 through 18). The intermediate-pressure refrigerant discharged from the first-stage compression element 102*d* is cooled in the intercoolers 7 by heat exchange with air as a cooling source (refer to point C2 in FIGS. 14 through 18). The refrigerant cooled in the intercoolers 7 is then drawn into the compression element 102*e* connected to the second-stage side of the compression element 102*d* where it is further compressed, and is then discharged from the compression mechanism 102 to the discharge tube 102*b* (refer to point D in FIGS. 14 through 18). The high-pressure refrigerant discharged from the compression mechanism 102 is compressed to a pressure exceeding the critical pressure (i.e., the critical pressure Pcp at the critical point CP shown in FIG. 17) by the three-stage compression action of the compression elements 102*c*, 102*d*, 102*e*. The high-pressure refrigerant discharged from the compression mechanism 102 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein the oil is depressurized by the depressurization mechanism 41*c* provided to the oil return tube 41*b*, and is then returned to the intake tube 102*a* of the compression mechanism 102 and drawn back into the compression mechanism 102. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant cooler. The high-pressure refrigerant fed to the heat source-side heat exchanger 4 is cooled in the heat source-side heat exchanger 4 by heat exchange with air as a cooling source (refer to point E in FIGS. 14 through 18). The high-pressure refrigerant cooled in the heat source-side heat exchanger 4 is then depressurized by the expansion mechanism 5 to become a low-pressure gas-liquid two-phase refrigerant, which is fed to the usage-side heat exchanger 6 functioning as a refrigerant heater (refer to point F in FIGS. 14 through 18). The low-pressure gas-liquid two-phase refrigerant fed to the usage-side heat exchanger 6 is heated by heat exchange with water or air as a heating source, and the refrigerant evaporates as a result (refer to point A in FIGS. 14 through 18). The low-pressure refrigerant heated in the usage-side heat exchanger 6 is then drawn back into the compression mechanism 102 via the switching mechanism 3. In this manner the air-cooling operation is performed.

In the configuration of the present modification, an intercooler 7 is provided to the intermediate refrigerant tube 8 for drawing the refrigerant discharged from the compression element 102*c* into the compression element 102*d*, another intercooler 7 is provided to the intermediate refrigerant tube 8 for drawing the refrigerant discharged from the compression element 102*d* into the compression element 102*e*, and the two intercoolers 7 are set to states of functioning as coolers by opening the two cooler on/off valves 12 and closing the intercooler bypass on/off valves 11 of the two intercooler bypass tubes 9 during the air-cooling operation in which the switching mechanism 3 is set to the cooling operation state. Therefore, the temperature of the refrigerant drawn into the compression element 102*d* on the second-stage side of the compression element 102*c* and the temperature of the refrigerant drawn into the compression element 102*e* on the second-stage side of the compression element 102*d* are both reduced (refer to points B1, C1, B2, and C2 in FIG. 18), and the temperature of the refrigerant discharged from the compression element 102*e* is also reduced (refer to points D and D' in FIG. 18) in comparison with cases in which no intercoolers 7 are provided (in this case, the refrigeration cycle is performed in the following sequence in FIGS. 17 and 18: point A→point B1→point B2'→(C2')→point D'→point E→point F). Therefore, in the configuration of the present modification, it is possible to reduce the temperature difference between the refrigerant and the air as a cooling source in the heat source-side heat exchanger 4 functioning as a cooler of high-pressure refrigerant in comparison with cases in which no intercoolers 7 are provided, the heat radiation loss can be reduced in proportion to the area enclosed by points B1, B2' (C2'), D', D, C2, B2, and C1 in FIG. 18, and operating efficiency can therefore be improved. Moreover, since this area is greater than the area in a two-stage compression refrigeration cycle such as those of the above-described embodiment and Modification 1, the operating efficiency can be further improved over the above-described embodiment and Modification 1.

<Air-Warming Operation>

During the air-warming operation, the switching mechanism 3 is set to a heating operation state shown by the dashed lines in FIGS. 14 through 16. The opening degree of the expansion mechanism 5 is adjusted. Since the switching mechanism 3 is set to a heating operation state, the two cooler on/off valves 12 are closed and the intercooler bypass on/off valves 11 of the two intercooler bypass tubes 9 are opened, thereby putting the intercoolers 7 into a state of not functioning as a coolers.

When the compression mechanism 102 is driven while the refrigerant circuit 110 is in this state, low-pressure refrigerant (refer to point A in FIGS. 14 to 16, 19, and 20) is drawn into the compression mechanism 102 through the intake tube 102*a*, after the refrigerant is first compressed to an intermediate pressure by the compression element 102*c*, and the refrigerant is discharged to the intermediate refrigerant tube 8 (refer to point B1 in FIGS. 14 to 16, 19, and 20). The intermediate-pressure refrigerant discharged from the first-stage compression element 102*c* passes through the intercooler bypass tube 9 (refer to point C1 in FIGS. 14 to 16, 19, and 20) without passing through the intercooler 7 (i.e., without being cooled), unlike the air-cooling operation, and the refrigerant is drawn into the compression element 102*d* connected to the second-stage side of the compression element 102*c* where it is further compressed, and the refrigerant is then discharged to the intermediate refrigerant tube 8 (refer to point B2 in FIGS. 14 to 16, 19, and 20). The intermediate-pressure refrigerant discharged from the first-stage compression element 102*d* flows through the other intercooler bypass tube 9 (refer to point C2 in FIGS. 14 to 16, 19, and 20) without passing through the intercooler 7 (i.e., without being cooled), the refrigerant is drawn into the compression element 102*e* connected to the second-stage side of the compression element 102*d* where it is further compressed, and the refrigerant is then discharged from the compression mechanism 102 to the discharge tube 102*b* (refer to point D in FIGS. 14 to 16, 19, and 20). As in the air-cooling operation, the high-pressure refrigerant discharged from the compression mechanism 102 is compressed to a pressure exceeding the critical pressure (i.e., the critical pressure Pcp at the critical point CP shown in FIG. 19) by the three-stage compression action of the compression elements 102*c*, 102*d*, 102*e*. The high-pressure refrigerant discharged from the compression mechanism 102 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein the oil is depressurized by the depressurization mechanism 41*c* provided to the oil return tube 41*b*, and is then returned to the intake tube 102*a* of the compression mechanism 102 and drawn back into the compression mechanism 102. Next, having been separated from the refrigeration oil in the oil separation mechanism 41, the high-pressure refrigerant is passed through the non-return mechanism 42 and the switching mechanism 3, and is fed via the non-return mechanism 42 and the switching mechanism 3 into the usage-side heat exchanger 6 functioning as a refrigerant cooler, where the refrigerant is cooled by heat exchange with water or air as a cooling source (refer to point F in FIGS. 14 to 16, 19, and 20). The high-pressure refrigerant cooled in the usage-side heat exchanger 6 is then depressurized by the expansion mechanism 5 to become a low-pressure gas-liquid two-phase refrigerant, which is fed to the heat source-side heat exchanger 4 functioning as a refrigerant heater (refer to point E in FIGS. 14 to 16, 19, and 20). The low-pressure gas-liquid two-phase refrigerant fed to the heat source-side heat exchanger 4 is heated by heat exchange with air as a heating source, and the refrigerant evaporates as a result (refer to point A in FIGS. 14 to 16, 19, and 20). The low-pressure refrigerant heated in the heat source-side heat exchanger 4 is then drawn back into the compression mechanism 102 via the switching mechanism 3. In this manner the air-warming operation is performed.

In the configuration of the present modification, an intercooler 7 is provided to the intermediate refrigerant tube 8 for drawing the refrigerant discharged from the compression element 102*c* into the compression element 102*d*, another intercooler 7 is provided to the intermediate refrigerant tube 8 for drawing the refrigerant discharged from the compression element 102*d* into the compression element 102*e*, and the two intercoolers 7 are set to states of not functioning as coolers by closing the two cooler on/off valves 12 and opening the intercooler bypass on/off valves 11 of the two intercooler bypass tubes 9 during the air-warming operation in which the switching mechanism 3 is set to the heating operation state. Therefore, decreases in the temperature of the refrigerant discharged from the compression mechanism 102 are minimized (refer to points D and D' in FIG. 20) in comparison with cases in which no intercoolers 7 are provided or cases in which the intercoolers 7 are made to function as coolers as in the air-cooling operation described above (in this case, the refrigeration cycle is performed in the following sequence in FIGS. 19 and 20: point A→point B1→point C1→point B2'→point C2'→point D'→point F→point E). Therefore, in the configuration of the present modification, heat radiation to the exterior can be minimized, it is possible to minimize the decrease in the temperature of refrigerant supplied to the usage-side heat exchanger 6 functioning as a refrigerant cooler, the decrease of heating capacity can be minimized in proportion to the difference between the enthalpy difference h of points D and F in FIG. 19 and the enthalpy difference h' of points D' and F, and reduction in operating efficiency can therefore be prevented as in the above-described embodiment and Modification 1, in comparison with cases in which only an intercooler 7 is provided or cases in which the intercooler 7 is made to function as a cooler as in the air-cooling operation described above.

As described above, in the configuration of the present modification, not only are two intercoolers 7 provided, but two cooler on/off valves 12 and two intercooler bypass tubes 9 are also provided, and these two cooler on/off valves 12 and two intercooler bypass tubes 9 are used to cause the intercoolers 7 to function as coolers when the switching mechanism 3 is set to the cooling operation state, and to cause the intercoolers 7 to not function as coolers when the switching mechanism 3 is set to the heating operation state. Therefore, in the air-conditioning apparatus 1, the temperature of the refrigerant discharged from the compression mechanism 102 can be kept low during the air-cooling operation as a cooling operation, and the decrease in the temperature of the refrigerant discharged from the compression mechanism 102 can be minimized during the air-warming operation as a heating operation. During the air-cooling operation, heat radiation loss in the heat source-side heat exchanger 4 functioning as a refrigerant cooler can be reduced and the operating efficiency can be improved, and during the air-warming operation, the decrease in heating capacity can be minimized by minimizing the decrease in temperature of the refrigerant supplied to the usage-side heat exchanger 6 functioning as a refrigerant cooler, and reduction in operating efficiency can be prevented.

<Defrosting Operation>

In the air-conditioning apparatus 1 of the present modification, when the air-warming operation is performed while the air as the heat source of the heat source-side heat exchanger 4 has a low temperature, frost deposits form on the heat source-side heat exchanger 4 functioning as a refrigerant heater, and there is a danger that the heat transfer performance of the heat source-side heat exchanger 4 will thereby suffer. Defrosting of the heat source-side heat exchanger 4 must therefore be performed.

Therefore, the same defrosting operation of the embodiment described above (FIGS. 9 through 11 and their relevant descriptions) is performed in the present modification as well. The defrosting operation of the present modification is described hereinbelow using FIGS. 14 to 16 and FIG. 9.

First, in step S1, a determination is made as to whether or not frost deposits have formed on the heat source-side heat exchanger 4 during the air-warming operation. This is determined based on the temperature of the refrigerant flowing through the heat source-side heat exchanger 4 as detected by the heat source-side heat exchange temperature sensor 51, and on the cumulative time of the air-warming operation. In cases in which it is determined in step S1 that frost deposits have formed in the heat source-side heat exchanger 4, the process advances to step S2.

Next, the defrosting operation is started in step S2. The defrosting operation is a reverse cycle defrosting operation in which the heat source-side heat exchanger 4 is made to function as a refrigerant cooler by switching the switching mechanism 3 from the heating operation state (i.e., the air-warming operation) to the cooling operation state. Moreover, there is a danger in the present embodiment that frost deposits will occur in the intercoolers 7 as well because a heat exchanger whose heat source is air is used as the intercoolers 7, and the intercoolers 7 are integrated with the heat source-side heat exchanger 4; therefore, refrigerant must be passed through not only the heat source-side heat exchanger 4 but also the intercoolers 7, and the intercoolers 7 must be defrosted. In view of this, at the start of the defrosting operation, similar to the air-cooling operation described above, whereby the heat source-side heat exchanger 4 is made to function as a refrigerant cooler by switching the switching mechanism 3 from the heating operation state (i.e., the air-warming operation) to the cooling operation state (i.e., the air-cooling operation), the cooler on/off valves 12 are opened, and the intercooler bypass on/off valves 11 are closed. The intercoolers 7 are thereby made to function as a cooler.

Next, in step S3, a determination is made as to whether or not defrosting of the intercoolers 7 is complete. This determination is made based on the refrigerant temperature at the outlet of the intercoolers 7. It is possible to reliably detect that defrosting of the intercoolers 7 has completed by this determination based on the refrigerant temperature at the outlet of the intercoolers 7. In the case that it has been determined in step S3 that defrosting of the intercoolers 7 is complete, the process advances to step S4.

Next, the process transitions in step S4 from the operation of defrosting both the intercoolers 7 and the heat source-side heat exchanger 4 to an operation of defrosting only the heat source-side heat exchanger 4. This operation transition in step S4 allows an operation to be performed for making the intercooler 7 not function as a cooler, by closing the cooler on/off valves 12 and opening the intercooler bypass on/off valves 11 while the heat source-side heat exchanger 4 continues to be defrosted by the reverse cycle defrosting operation. Heat is thereby prevented from being radiated from the intercoolers 7 to the exterior, the temperature of the refrigerant drawn into the second-stage compression elements 102*d*, 102*e* is therefore prevented from decreasing, and as a result, temperature decreases can be minimized in the refrigerant discharged from the compression mechanism 102, and the decrease in the capacity to defrost the heat source-side heat exchanger 4 can be minimized. As a result, temperature decreases can be minimized in the refrigerant discharged from the compression mechanism 102, and the decrease in the capacity to defrost the heat source-side heat exchanger 4 can be minimized as well.

Next, in step S5, a determination is made as to whether or not defrosting of the heat source-side heat exchanger 4 has completed. This determination is made based on the temperature of refrigerant flowing through the heat source-side heat exchanger 4 as detected by the heat source-side heat exchange temperature sensor 51, and/or on the operation time of the defrosting operation. In cases in which it is determined in step S5 that defrosting of the heat source-side heat exchanger 4 has completed, the process transitions to step S6, the defrosting operation ends, and the process for restarting the air-warming operation is again performed. More specifically, a process is performed for switching the switching mechanism 3 from the cooling operation state to the heating operation state (i.e. the air-warming operation).

As described above, in the air-conditioning apparatus 1, when a defrosting operation is performed for defrosting the heat source-side heat exchanger 4 by making the heat source-side heat exchanger 4 function as a refrigerant cooler, the refrigerant flows to the heat source-side heat exchanger 4 and the intercoolers 7, and after it is detected that defrosting of the intercoolers 7 is complete, the intercooler bypass tube 9 is used to ensure that refrigerant no longer flows to the intercoolers 7. It is thereby possible, when the defrosting operation is performed, to also defrost the intercoolers 7, to minimize the loss of defrosting capacity resulting from the radiation of heat from the intercoolers 7 to the exterior, and to contribute to reducing defrosting time.

In the present modification, since the refrigerant that operates in a supercritical range (carbon dioxide in this case) is used, sometimes an air-cooling operation or other refrigeration cycle is performed in which refrigerant of an intermediate pressure lower than the critical pressure Pcp (about 7.3 MPa with carbon dioxide) flows into the intercoolers 7, and refrigerant of a high pressure exceeding the critical pressure Pcp flows into the heat source-side heat exchanger 4 functioning as a refrigerant cooler (see FIG. 17). In this case, the difference between the physical properties of the refrigerant whose pressure is lower than the critical pressure Pcp and the physical properties (particularly the heat transfer coefficient and the specific heat at constant pressure) of the refrigerant whose pressure exceeds the critical pressure Pcp leads to a tendency of the heat transfer coefficient of the refrigerant in the intercoolers 7 to be lower than the heat transfer coefficient of the refrigerant in the heat source-side heat exchanger 4. In the present modification, since the three-stage-compression-type compression mechanism 102 is used, the intermediate pressure (refer to points B1 and C1 in FIG. 17) of the refrigerant discharged by the first-stage compression element 102*c* and drawn into the second-stage compression element 102*d* is lower than the critical pressure Pcp, and as with the intermediate pressure (refer to points B1 and C1 in FIG. 5 and also to FIG. 12) of the refrigerant flowing through the intercooler 7 in the embodiment described above, the heat transfer coefficient value of the intermediate-pressure refrigerant flowing through the intercoolers 7 is less than the heat transfer coefficient value of the high-pressure refrigerant flowing through the heat source-side heat exchanger 4 within the temperature range (about 35 to 70° C.) of the refrigerant flowing through the intercoolers 7 or the heat source-side heat exchanger 4 functioning as a refrigerant cooler.

Therefore, in the present modification, since the intercoolers 7 are integrated with the heat source-side heat exchanger 4, and the intercoolers 7 are disposed in the upper part of the heat exchanger panel 70 in which the two components are integrated (in this case, since the intercoolers 7 are integrated with the heat source-side heat exchanger 4 in a state of being disposed above the heat source-side heat exchanger 4), the intercoolers 7 are disposed in the top part of the heat source unit 1*a* where air as a heat source flows at a high speed, and the heat transfer coefficient of air in the intercoolers 7 increase. As a result, the decrease in the overall heat transfer coefficient of the intercoolers 7 is minimized, and the loss of heat transfer performance in the intercoolers 7 can be minimized as well. In the present modification, water that is melted by the defrosting operation and drips down from the heat source-side heat exchanger 4 does not readily adhere to the intercoolers 7, the icing-up phenomenon is suppressed, and the reliability of the equipment can be improved. Moreover, the time needed for defrosting the intercoolers 7 can be greatly reduced in the above-described defrosting operation.

(5) Modification 3

In the above-described embodiment and the modifications thereof, the configuration has a single compression mechanism 102 and the multistage-compression-type compression mechanism 2 in which refrigerant is sequentially compressed by a plurality of compression elements as shown in FIGS. 1 and 13 through 16, but another possible option, in cases in which, for example, a large-capacity usage-side heat exchanger 6 is connected or a plurality of usage-side heat exchangers 6 is connected, is to use a parallel multistage-compression-type compression mechanism in which a multistage-compression-type compression mechanism 2 and a plurality of compression mechanisms 102 are connected in parallel.

Figure 21:
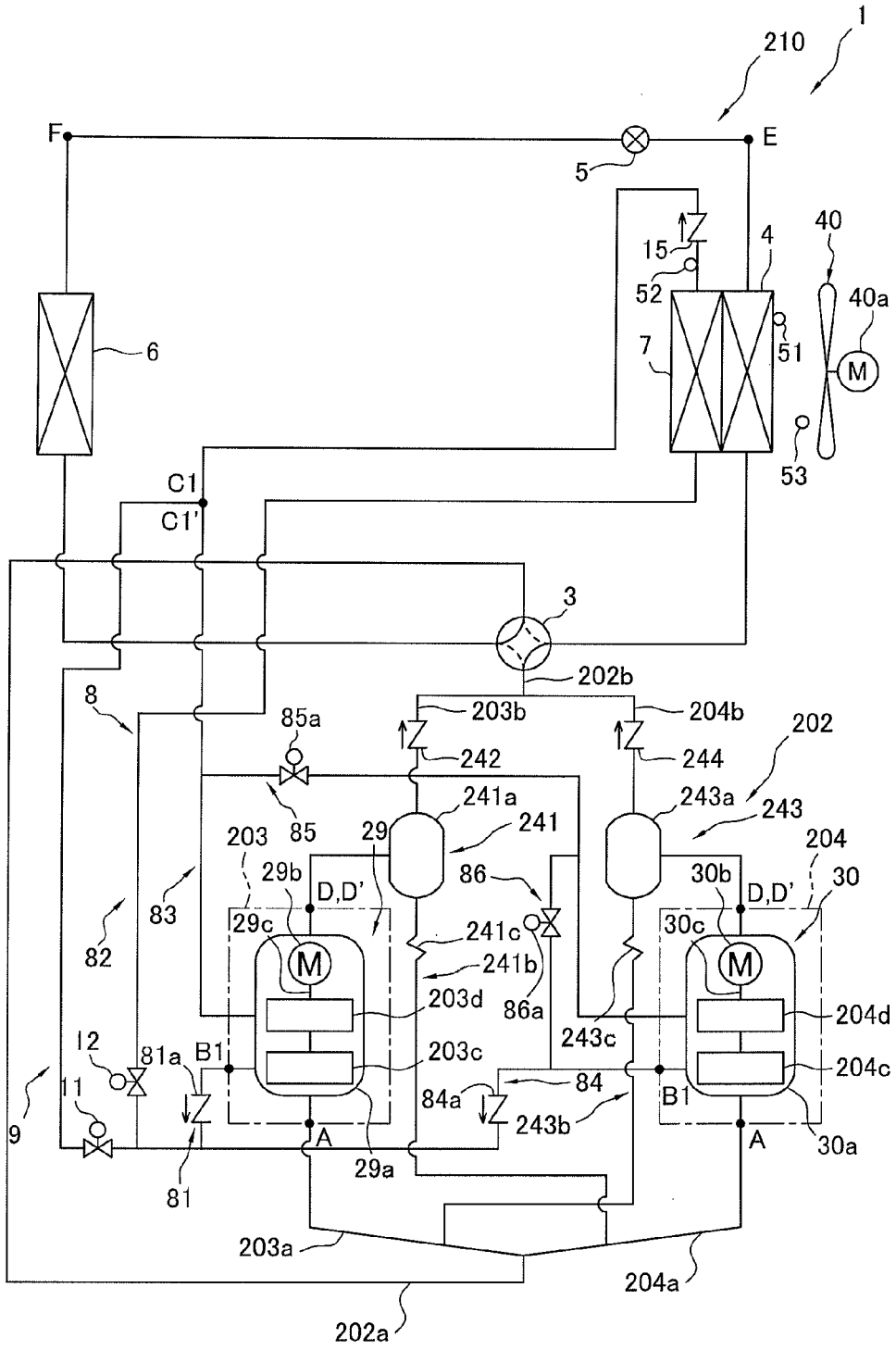
FIG. 21 is a schematic structural drawing of an air-conditioning apparatus according to Modification 3.

For example, in the embodiment described above as shown in FIG. 21, the refrigerant circuit 210 can use a compression mechanism 202 configured having a parallel connection between a two-stage-compression-type first compression mechanism 203 having compression elements 203*c*, 203*d*, and a two-stage-compression-type second compression mechanism 204 having compression elements 204*c*, 204*d*.

In the present modification, the first compression mechanism 203 is configured using a compressor 29 for subjecting the refrigerant to two-stage compression through two compression elements 203*c*, 203*d*, and is connected to a first intake branch tube 203*a* which branches off from an intake header tube 202*a* of the compression mechanism 202, and also to a first discharge branch tube 203*b* whose flow merges with a discharge header tube 202*b* of the compression mechanism 202. In the present modification, the second compression mechanism 204 is configured using a compressor 30 for subjecting the refrigerant to two-stage compression through two compression elements 204*c*, 204*d*, and is connected to a second intake branch tube 204*a* which branches off from the intake header tube 202*a* of the compression mechanism 202, and also to a second discharge branch tube 204*b* whose flow merges with the discharge header tube 202*b* of the compression mechanism 202. Since the compressors 29, 30 have the same configuration as the compressor 21 in the embodiment described above, symbols indicating components other than the compression elements 203*c*, 203*d*, 204*c*, 204*d* are replaced with symbols beginning with 29 or 30, and these components are not described. The compressor 29 is configured so that refrigerant is drawn in through the first intake branch tube 203*a*, the drawn-in refrigerant is compressed by the compression element 203*c* and then discharged to a first inlet-side intermediate branch tube 81 constituting the intermediate refrigerant tube 8, the refrigerant discharged to the first inlet-side intermediate branch tube 81 is drawn in into the compression element 203*d* via an intermediate header tube 82 and a first discharge-side intermediate branch tube 83 constituting the intermediate refrigerant tube 8, and the refrigerant is further compressed and then discharged to the first discharge branch tube 203*b*. The compressor 30 is configured so that refrigerant is drawn in through the second intake branch tube 204*a*, the drawn-in refrigerant is compressed by the compression element 204*c* and then discharged to a second inlet-side intermediate branch tube 84 constituting the intermediate refrigerant tube 8, the refrigerant discharged to the second inlet-side intermediate branch tube 84 is drawn in into the compression element 204*d* via the intermediate header tube 82 and a second outlet-side intermediate branch tube 85 constituting the intermediate refrigerant tube 8, and the refrigerant is further compressed and then discharged to the second discharge branch tube 204*b*. In the present modification, the intermediate refrigerant tube 8 is a refrigerant tube for admitting refrigerant discharged from the compression elements 203*c*, 204*c* connected to the first-stage sides of the compression elements 203*d*, 204*d* into the compression elements 203*d*, 204*d* connected to the second-stage sides of the compression elements 203*c*, 204*c*, and the intermediate refrigerant tube 8 primarily comprises the first inlet-side intermediate branch tube 81 connected to the discharge side of the first-stage compression element 203*c* of the first compression mechanism 203, the second inlet-side intermediate branch tube 84 connected to the discharge side of the first-stage compression element 204*c* of the second compression mechanism 204, the intermediate header tube 82 whose flow merges with both inlet-side intermediate branch tubes 81, 84, the first discharge-side intermediate branch tube 83 branching off from the intermediate header tube 82 and connected to the intake side of the second-stage compression element 203*d* of the first compression mechanism 203, and the second outlet-side intermediate branch tube 85 branching off from the intermediate header tube 82 and connected to the intake side of the second-stage compression element 204*d* of the second compression mechanism 204. The discharge header tube 202*b* is a refrigerant tube for feeding the refrigerant discharged from the compression mechanism 202 to the switching mechanism 3, and the first discharge branch tube 203*b* connected to the discharge header tube 202*b* is provided with a first oil separation mechanism 241 and a first non-return mechanism 242, while the second discharge branch tube 204*b* connected to the discharge header tube 202*b* is provided with a second oil separation mechanism 243 and a second non-return mechanism 244. The first oil separation mechanism 241 is a mechanism for separating from the refrigerant the refrigeration oil accompanying the refrigerant discharged from the first compression mechanism 203 and returning the oil to the intake side of the compression mechanism 202. The first oil separation mechanism 241 primarily comprises a first oil separator 241*a* for separating from the refrigerant the refrigeration oil accompanying the refrigerant discharged from the first compression mechanism 203, and a first oil return tube 241*b* connected to the first oil separator 241*a* for returning the refrigeration oil separated from the refrigerant to the intake side of the compression mechanism 202. The second oil separation mechanism 243 is a mechanism for separating from the refrigerant the refrigeration oil accompanying the refrigerant discharged from the second compression mechanism 204 and returning the oil to the intake side of the compression mechanism 202. The second oil separation mechanism 243 primarily comprises a second oil separator 243*a* for separating from the refrigerant the refrigeration oil accompanying the refrigerant discharged from the second compression mechanism 204, and a second oil return tube 243*b* connected to the second oil separator 243*a* for returning the refrigeration oil separated from the refrigerant to the intake side of the compression mechanism 202. In the present modification, the first oil return tube 241*b* is connected to the second intake branch tube 204*a*, and the second oil return tube 243*b* is connected to the first intake branch tube 203*a*. Therefore, even if there is a disparity between the amount of refrigeration oil accompanying the refrigerant discharged from the first compression mechanism 203 and the amount of refrigeration oil accompanying the refrigerant discharged from the second compression mechanism 204, which occurs as a result of a disparity between the amount of refrigeration oil retained in the first compression mechanism 203 and the amount of refrigeration oil retained in the second compression mechanism 204, more refrigeration oil returns to whichever of the compression mechanisms 203, 204 has the smaller amount of refrigeration oil, thus resolving the disparity between the amount of refrigeration oil retained in the first compression mechanism 203 and the amount of refrigeration oil retained in the second compression mechanism 204. In the present modification, the first intake branch tube 203*a* is configured so that the portion leading from the flow juncture with the second oil return tube 243*b* to the flow juncture with the intake header tube 202*a* slopes downward toward the flow juncture with the intake header tube 202*a*, while the second intake branch tube 204*a* is configured so that the portion leading from the flow juncture with the first oil return tube 241*b* to the flow juncture with the intake header tube 202*a* slopes downward toward the flow juncture with the intake header tube 202*a*. Therefore, even if either one of the two-stage compression-type compression mechanisms 203, 204 is stopped, refrigeration oil being returned from the oil return tube corresponding to the operating compression mechanism to the intake branch tube corresponding to the stopped compression mechanism is returned to the intake header tube 202*a*, and there will be little likelihood of a shortage of oil supplied to the operating compression mechanism. The oil return tubes 241*b*, 243*b* are provided with depressurizing mechanisms 241*c*, 243*c* for depressurizing the refrigeration oil flowing through the oil return tubes 241*b*, 243*b*. The non-return mechanisms 242, 244 are mechanisms for allowing refrigerant to flow from the discharge sides of the compression mechanisms 203, 204 to the switching mechanism 3 and for blocking the flow of refrigerant from the switching mechanism 3 to the discharge sides of the compression mechanisms 203, 204.

Thus, in the present modification, the compression mechanism 202 is configured by connecting two compression mechanisms in parallel; namely, the first compression mechanism 203 having two compression elements 203*c*, 203*d* and configured so that refrigerant discharged from the first-stage compression element of these compression elements 203*c*, 203*d* is sequentially compressed by the second-stage compression element, and the second compression mechanism 204 having two compression elements 204*c*, 204*d* and configured so that refrigerant discharged from the first-stage compression element of these compression elements 204*c*, 204*d* is sequentially compressed by the second-stage compression element.

In the present modification, the intercooler 7 is provided to the intermediate header tube 82 constituting the intermediate refrigerant tube 8, and is a heat exchanger for cooling the mixture of the refrigerant discharged from the first-stage compression element 203*c* of the first compression mechanism 203 and the refrigerant discharged from the first-stage compression element 204*c* of the second compression mechanism 204. In other words, the intercooler 7 functions as a common cooler for both of the two compression mechanisms 203, 204. Therefore, it is possible to simplify the circuit configuration around the compression mechanism 202 when the intercooler 7 is provided to the parallel multistage-compression-type compression mechanism 202 in which a plurality of multistage-compression-type compression mechanisms 203, 204 is connected in parallel. As with the embodiment described above, the intercooler 7 of the present modification is also integrated with the heat source-side heat exchanger 4 in a state of being disposed above the heat source-side heat exchanger 4 (see FIGS. 2 through 4).

The first inlet-side intermediate branch tube 81 constituting the intermediate refrigerant tube 8 is provided with a non-return mechanism 81*a* for allowing the flow of refrigerant from the discharge side of the first-stage compression element 203*c* of the first compression mechanism 203 toward the intermediate header tube 82 and for blocking the flow of refrigerant from the intermediate header tube 82 toward the discharge side of the first-stage compression element 203*c*, while the second inlet-side intermediate branch tube 84 constituting the intermediate refrigerant tube 8 is provided with a non-return mechanism 84*a* for allowing the flow of refrigerant from the discharge side of the first-stage compression element 204*c* of the second compression mechanism 204 toward the intermediate header tube 82 and for blocking the flow of refrigerant from the intermediate header tube 82 toward the discharge side of the first-stage compression element 204*c*. In the present modification, non-return valves are used as the non-return mechanisms 81*a*, 84*a*. Therefore, even if either one of the compression mechanisms 203, 204 has stopped, there are no instances in which refrigerant discharged from the first-stage compression element of the operating compression mechanism passes through the intermediate refrigerant tube 8 and travels to the discharge side of the first-stage compression element of the stopped compression mechanism. Therefore, there are no instances in which refrigerant discharged from the first-stage compression element of the operating compression mechanism passes through the interior of the first-stage compression element of the stopped compression mechanism and exits out through the intake side of the compression mechanism 202, which would cause the refrigeration oil of the stopped compression mechanism to flow out, and it is thus unlikely that there will be insufficient refrigeration oil for starting up the stopped compression mechanism. In the case that the compression mechanisms 203, 204 are operated in order of priority (for example, in the case of a compression mechanism in which priority is given to operating the first compression mechanism 203), the stopped compression mechanism described above will always be the second compression mechanism 204, and therefore in this case only the non-return mechanism 84*a* corresponding to the second compression mechanism 204 need be provided.

In cases of a compression mechanism which prioritizes operating the first compression mechanism 203 as described above, since a shared intermediate refrigerant tube 8 is provided for both compression mechanisms 203, 204, the refrigerant discharged from the first-stage compression element 203*c* corresponding to the operating first compression mechanism 203 passes through the second outlet-side intermediate branch tube 85 of the intermediate refrigerant tube 8 and travels to the intake side of the second-stage compression element 204*d* of the stopped second compression mechanism 204, whereby there is a danger that refrigerant discharged from the first-stage compression element 203*c* of the operating first compression mechanism 203 will pass through the interior of the second-stage compression element 204*d* of the stopped second compression mechanism 204 and exit out through the discharge side of the compression mechanism 202, causing the refrigeration oil of the stopped second compression mechanism 204 to flow out, resulting in insufficient refrigeration oil for starting up the stopped second compression mechanism 204. In view of this, an on/off valve 85*a* is provided to the second outlet-side intermediate branch tube 85 in the present modification, and when the second compression mechanism 204 has stopped, the flow of refrigerant through the second outlet-side intermediate branch tube 85 is blocked by the on/off valve 85*a*. The refrigerant discharged from the first-stage compression element 203*c* of the operating first compression mechanism 203 thereby no longer passes through the second outlet-side intermediate branch tube 85 of the intermediate refrigerant tube 8 and travels to the intake side of the second-stage compression element 204*d* of the stopped second compression mechanism 204; therefore, there are no longer any instances in which the refrigerant discharged from the first-stage compression element 203*c* of the operating first compression mechanism 203 passes through the interior of the second-stage compression element 204*d* of the stopped second compression mechanism 204 and exits out through the discharge side of the compression mechanism 202 which causes the refrigeration oil of the stopped second compression mechanism 204 to flow out, and it is thereby even more unlikely that there will be insufficient refrigeration oil for starting up the stopped second compression mechanism 204. An electromagnetic valve is used as the on/off valve 85*a* in the present modification.

In the case of a compression mechanism which prioritizes operating the first compression mechanism 203, the second compression mechanism 204 is started up in continuation from the starting up of the first compression mechanism 203, but at this time, since a shared intermediate refrigerant tube 8 is provided for both compression mechanisms 203, 204, the starting up takes place from a state in which the pressure in the discharge side of the first-stage compression element 203*c* of the second compression mechanism 204 and the pressure in the intake side of the second-stage compression element 203*d* are greater than the pressure in the intake side of the first-stage compression element 203*c* and the pressure in the discharge side of the second-stage compression element 203*d*, and it is difficult to start up the second compression mechanism 204 in a stable manner. In view of this, in the present modification, there is provided a startup bypass tube 86 for connecting the discharge side of the first-stage compression element 204*c* of the second compression mechanism 204 and the intake side of the second-stage compression element 204*d*, and an on/off valve 86*a* is provided to this startup bypass tube 86. In cases in which the second compression mechanism 204 has stopped, the flow of refrigerant through the startup bypass tube 86 is blocked by the on/off valve 86*a* and the flow of refrigerant through the second outlet-side intermediate branch tube 85 is blocked by the on/off valve 85*a*. When the second compression mechanism 204 is started up, a state in which refrigerant is allowed to flow through the startup bypass tube 86 can be restored via the on/off valve 86*a*, whereby the refrigerant discharged from the first-stage compression element 204*c* of the second compression mechanism 204 is drawn into the second-stage compression element 204*d* via the startup bypass tube 86 without being mixed with the refrigerant discharged from the first-stage compression element 203*c* of the first compression mechanism 203, a state of allowing refrigerant to flow through the second outlet-side intermediate branch tube 85 can be restored via the on/off valve 85*a* at point in time when the operating state of the compression mechanism 202 has been stabilized (e.g., a point in time when the intake pressure, discharge pressure, and intermediate pressure of the compression mechanism 202 have been stabilized), the flow of refrigerant through the startup bypass tube 86 can be blocked by the on/off valve 86*a*, and operation can transition to the normal air-cooling operation. In the present modification, one end of the startup bypass tube 86 is connected between the on/off valve 85*a* of the second outlet-side intermediate branch tube 85 and the intake side of the second-stage compression element 204*d* of the second compression mechanism 204, while the other end is connected between the discharge side of the first-stage compression element 204*c* of the second compression mechanism 204 and the non-return mechanism 84*a* of the second inlet-side intermediate branch tube 84, and when the second compression mechanism 204 is started up, the startup bypass tube 86 can be kept in a state of being substantially unaffected by the intermediate pressure portion of the first compression mechanism 203. An electromagnetic valve is used as the on/off valve 86*a* in the present modification.

The actions of the air-conditioning apparatus 1 of the present modification during the air-cooling operation, the air-warming operation, and the defrosting operation are essentially the same as the actions in the above-described embodiment (FIGS. 1 and 5 through 11 as well as the relevant descriptions), except for the changes brought about by a somewhat more complex circuit structure around the compression mechanism 202 due to the compression mechanism 202 being provided instead of the compression mechanism 2, for which reason the actions are not described herein.

The same operational effects of the above-described embodiment can be achieved with the configuration of Modification 3.

Though not described in detail herein, a compression mechanism having more stages than a two-stage compression system, such as a three-stage compression system (e.g., the compression mechanism 102 in Modification 2) or the like, may be used instead of the two-stage compression-type compression mechanisms 203, 204, or a parallel multi-stage compression-type compression mechanism may be used in which three or more multi-stage compression-type compression mechanisms are connected in parallel, and the same effects as those of the present modification can be achieved in this case as well.

(6) Modification 4

In the air-conditioning apparatus 1 configured to be capable of being switched between the air-cooling operation and the air-warming operation by the switching mechanism 3 according to the embodiment described above and the modifications thereof, the intercooler bypass tube 9 is provided, as is the air-cooling intercooler 7 integrated with the heat source-side heat exchanger 4 and disposed in the top part of the heat exchanger panel 70 in which the two components are integrated (in this case, the air-cooling intercooler 7 integrated with the heat source-side heat exchanger 4 in a state of being disposed above the heat source-side heat exchanger 4). Using the intercooler 7 and the intercooler bypass tube 9, the intercooler 7 is made to function as a cooler when the switching mechanism 3 is set to the cooling operation state, and the intercooler 7 is made to not function as a cooler when the switching mechanism 3 is set to the heating operation state, whereby heat radiation loss in the heat source-side heat exchanger 4 functioning as a cooler can be reduced and operating efficiency can be improved during the air-cooling operation, and heat radiation to the exterior can be minimized to minimize the decrease in heating capacity during the air-warming operation. However, in addition to this configuration, a second-stage injection tube may also be provided for branching off the refrigerant cooled in the heat source-side heat exchanger 4 or the usage-side heat exchanger 6 and returning the refrigerant to the second-stage compression element 2*d*.

Figure 22:
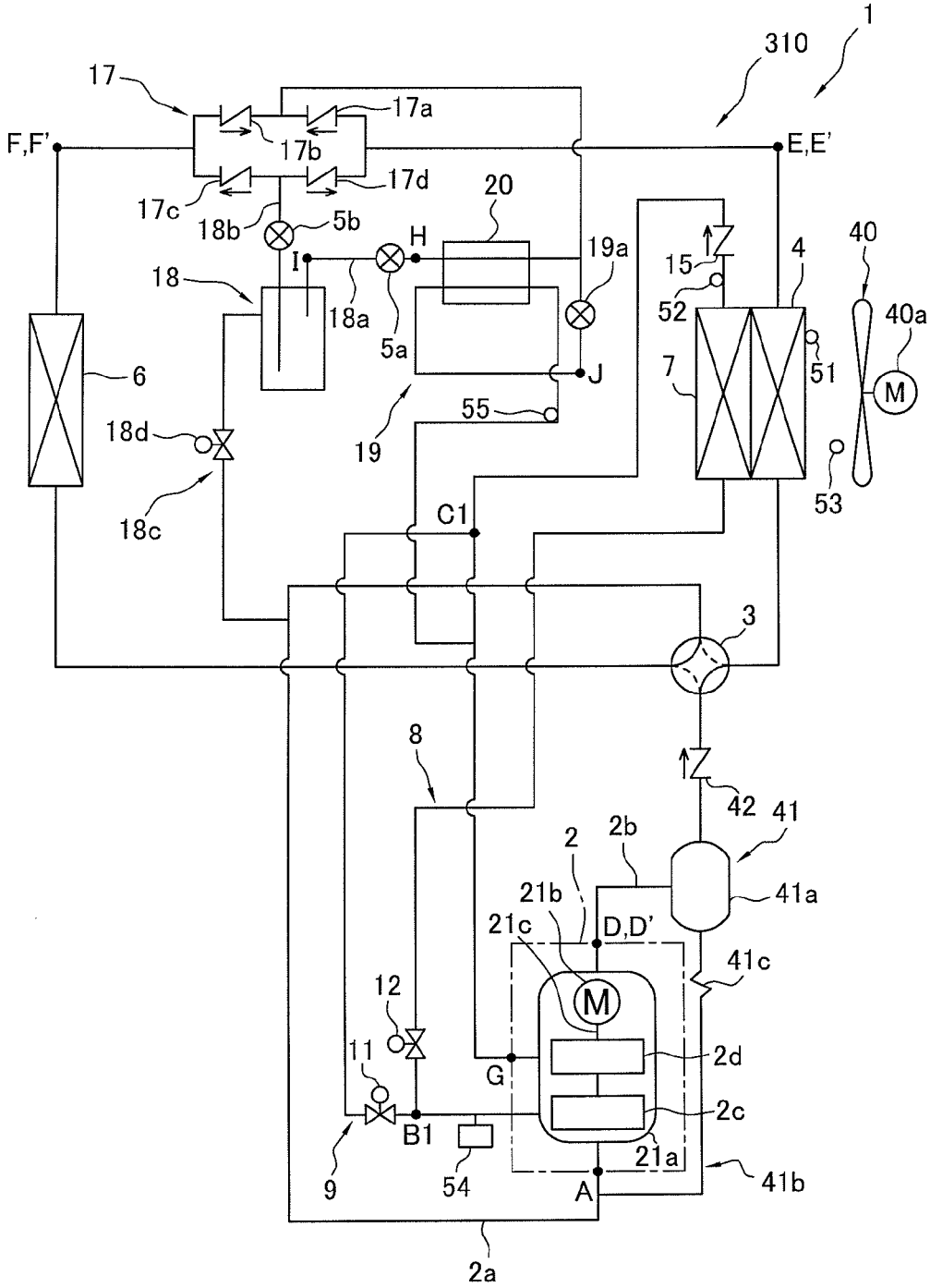
FIG. 22 is a schematic structural drawing of an air-conditioning apparatus according to Modification 4.

For example, in the above-described embodiment in which a two-stage compression-type compression mechanism 2 is used, a refrigerant circuit 310 can be used in which a receiver inlet expansion mechanism 5*a* and a receiver outlet expansion mechanism 5*b* are provided instead of the expansion mechanism 5, and a bridge circuit 17, a receiver 18, a second-stage injection tube 19, and an economizer heat exchanger 20 are provided as shown in FIG. 22.

The bridge circuit 17 is provided between the heat source-side heat exchanger 4 and the usage-side heat exchanger 6, and is connected to a receiver inlet tube 18*a* connected to an inlet of the receiver 18, and to a receiver outlet tube 18*b* connected to an outlet of the receiver 18. The bridge circuit 17 has four non-return valves 17*a*, 17*b*, 17*c* and 17*d* in the present modification. The inlet non-return valve 17*a* is a non-return valve for allowing refrigerant to flow only from the heat source-side heat exchanger 4 to the receiver inlet tube 18*a*. The inlet non-return valve 17*b* is a non-return valve for allowing refrigerant to flow only from the usage-side heat exchanger 6 to the receiver inlet tube 18*a*. In other words, the inlet non-return valves 17*a*, 17*b* have the function of allowing refrigerant to flow to the receiver inlet tube 18*a* from either the heat source-side heat exchanger 4 or the usage-side heat exchanger 6. The outlet non-return valve 17*c* is a non-return valve for allowing refrigerant to flow only from the receiver outlet tube 18*b* to the usage-side heat exchanger 6. The outlet non-return valve 17*d* is a non-return valve for allowing refrigerant to flow only from the receiver outlet tube 18*b* to the heat source-side heat exchanger 4. In other words, the outlet non-return valves 17*c*, 17*d* have the function of allowing the refrigerant to flow from the receiver outlet tube 18*b* to the other of the heat source-side heat exchanger 4 and the usage-side heat exchanger 6.

The receiver inlet expansion mechanism 5*a* is a refrigerant-depressurizing mechanism provided to the receiver inlet tube 18*a*, and an electric expansion valve is used in the present modification. In the present modification, the receiver inlet expansion mechanism 5*a* depressurizes the high-pressure refrigerant cooled in the heat source-side heat exchanger 4 before feeding the refrigerant to the usage-side heat exchanger 6 during the air-cooling operation, and depressurizes the high-pressure refrigerant cooled in the usage-side heat exchanger 6 before feeding the refrigerant to the heat source-side heat exchanger 4 during the air-warming operation.

The receiver 18 is a container provided in order to temporarily retain refrigerant after it is depressurized by the receiver inlet expansion mechanism 5*a*, wherein the inlet of the receiver is connected to the receiver inlet tube 18*a* and the outlet is connected to the receiver outlet tube 18*b*. Also connected to the receiver 18 is an intake return tube 18*c* capable of withdrawing refrigerant from inside the receiver 18 and returning the refrigerant to the intake tube 2*a* of the compression mechanism 2 (i.e., to the intake side of the compression element 2*c* on the first-stage side of the compression mechanism 2). The intake return tube 18*c* is provided with an intake return on/off valve 18*d*. The intake return on/off valve 18*d* is an electromagnetic valve in the present modification.

The receiver outlet expansion mechanism 5*b* is a refrigerant-depressurizing mechanism provided to the receiver outlet tube 18*b*, and an electric expansion valve is used in the present modification. In the present modification, the receiver outlet expansion mechanism 5*b* further depressurizes refrigerant depressurized by the receiver inlet expansion mechanism 5*a* to an even lower pressure before feeding the refrigerant to the usage-side heat exchanger 6 during the air-cooling operation, and further depressurizes refrigerant depressurized by the receiver inlet expansion mechanism 5*a* to an even lower pressure before feeding the refrigerant to the heat source-side heat exchanger 4.

Thus, when the switching mechanism 3 is brought to the cooling operation state by the bridge circuit 17, the receiver 18, the receiver inlet tube 18*a*, and the receiver outlet tube 18*b*, the high-pressure refrigerant cooled in the heat source-side heat exchanger 4 can be fed to the usage-side heat exchanger 6 through the inlet non-return valve 17*a* of the bridge circuit 17, the receiver inlet expansion mechanism 5*a* of the receiver inlet tube 18*a*, the receiver 18, the receiver outlet expansion mechanism 5*b* of the receiver outlet tube 18*b*, and the outlet non-return valve 17*c* of the bridge circuit 17. When the switching mechanism 3 is brought to the heating operation state, the high-pressure refrigerant cooled in the usage-side heat exchanger 6 can be fed to the heat source-side heat exchanger 4 through the inlet non-return valve 17*b* of the bridge circuit 17, the receiver inlet expansion mechanism 5*a* of the receiver inlet tube 18*a*, the receiver 18, the receiver outlet expansion mechanism 5*b* of the receiver outlet tube 18*b*, and the outlet non-return valve 17*d* of the bridge circuit 17.

The second-stage injection tube 19 has the function of branching off the refrigerant cooled in the heat source-side heat exchanger 4 or the usage-side heat exchanger 6 and returning the refrigerant to the compression element 2*d* on the second-stage side of the compression mechanism 2. In the present modification, the second-stage injection tube 19 is provided so as to branch off refrigerant flowing through the receiver inlet tube 18*a* and return the refrigerant to the second-stage compression element 2*d*. More specifically, the second-stage injection tube 19 is provided so as to branch off refrigerant from a position upstream of the receiver inlet expansion mechanism 5*a* of the receiver inlet tube 18*a* (specifically, between the heat source-side heat exchanger 4 and the receiver inlet expansion mechanism 5*a* when the switching mechanism 3 is in the cooling operation state, and between the usage-side heat exchanger 6 and the receiver inlet expansion mechanism 5*a* when the switching mechanism 3 is in the heating operation state) and return the refrigerant to a position downstream of the intercooler 7 of the intermediate refrigerant tube 8. The second-stage injection tube 19 is provided with a second-stage injection valve 19*a* whose opening degree can be controlled. The second-stage injection valve 19*a* is an electric expansion valve in the present modification.

The economizer heat exchanger 20 is a heat exchanger for conducting heat exchange between the refrigerant cooled in the heat source-side heat exchanger 4 or the usage-side heat exchanger 6 and the refrigerant flowing through the second-stage injection tube 19 (more specifically, the refrigerant that has been depressurized nearly to an intermediate pressure in the second-stage injection valve 19*a*). In the present modification, the economizer heat exchanger 20 is provided so as to conduct heat exchange between the refrigerant flowing through a position upstream (specifically, between the heat source-side heat exchanger 4 and the receiver inlet expansion mechanism 5*a* when the switching mechanism 3 is in the cooling operation state, and between the usage-side heat exchanger 6 and the receiver inlet expansion mechanism 5*a* when the switching mechanism 3 is in the heating operation state) of the receiver inlet expansion mechanism 5*a* of the receiver inlet tube 18*a* and the refrigerant flowing through the second-stage injection tube 19, and the economizer heat exchanger 20 has flow channels through which both refrigerants flow so as to oppose each other. In the present modification, the economizer heat exchanger 20 is provided upstream of the second-stage injection tube 19 of the receiver inlet tube 18*a*. Therefore, the refrigerant cooled in the heat source-side heat exchanger 4 or usage-side heat exchanger 6 is branched off in the receiver inlet tube 18*a* to the second-stage injection tube 19 before undergoing heat exchange in the economizer heat exchanger 20, and heat exchange is then conducted in the economizer heat exchanger 20 with the refrigerant flowing through the second-stage injection tube 19.

Furthermore, the air-conditioning apparatus 1 of the present modification is provided with various sensors. Specifically, an intermediate pressure sensor 54 for detecting the pressure of refrigerant flowing through the intermediate refrigerant tube 8 is provided to the intermediate refrigerant tube 8 or the compression mechanism 2. The outlet on the second-stage injection tube 19 side of the economizer heat exchanger 20 is provided with an economizer outlet temperature sensor 55 for detecting the temperature of refrigerant at the outlet on the second-stage injection tube 19 side of the economizer heat exchanger 20.

Figure 23:
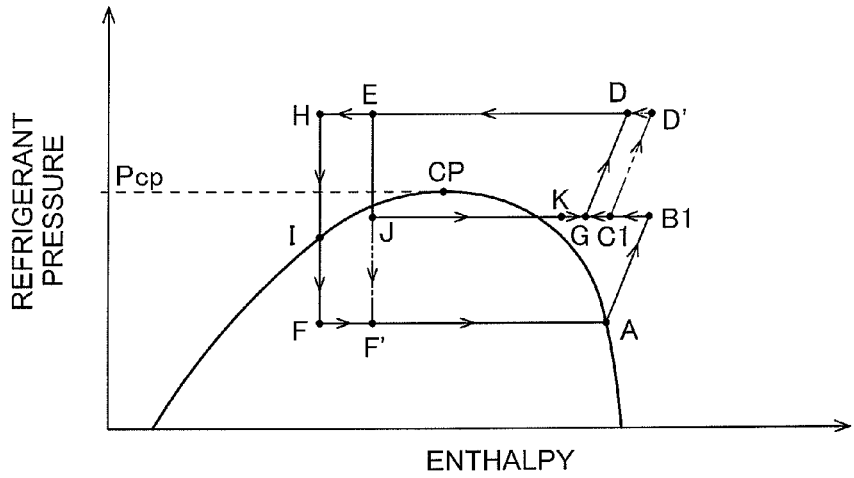
FIG. 23 is a pressure-enthalpy graph representing the refrigeration cycle during the air-cooling operation in the air-conditioning apparatus according to Modification 4.
Figure 24:
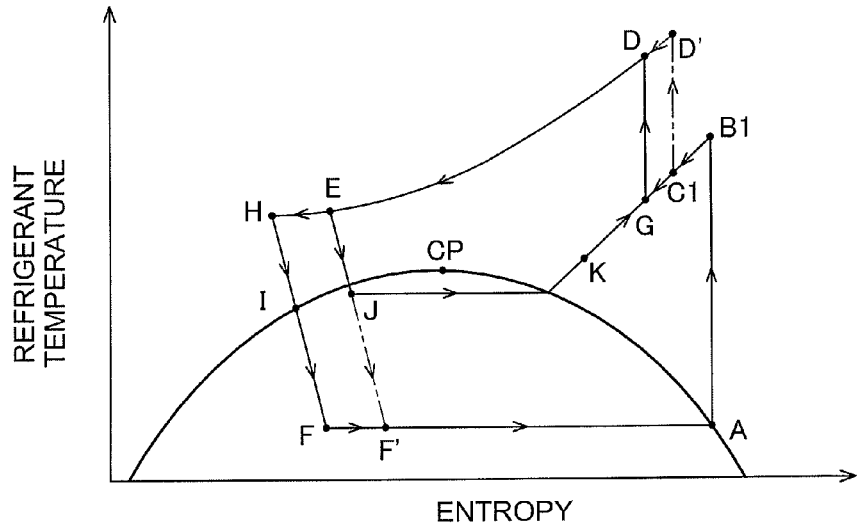
FIG. 24 is a temperature-entropy graph representing the refrigeration cycle during the air-cooling operation in the air-conditioning apparatus according to Modification 4.
Figure 25:
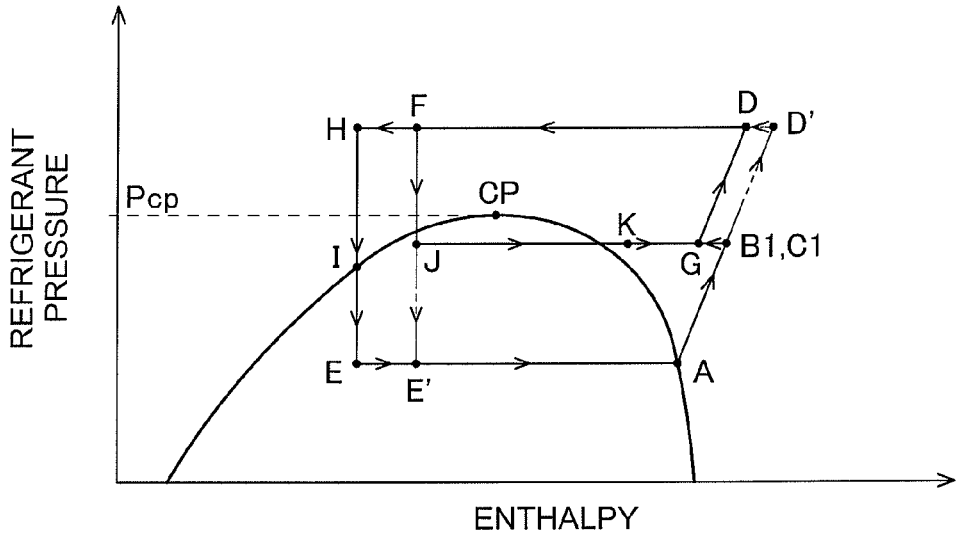
FIG. 25 is a pressure-enthalpy graph representing the refrigeration cycle during the air-warming operation in the air-conditioning apparatus according to Modification 4.
Figure 26:
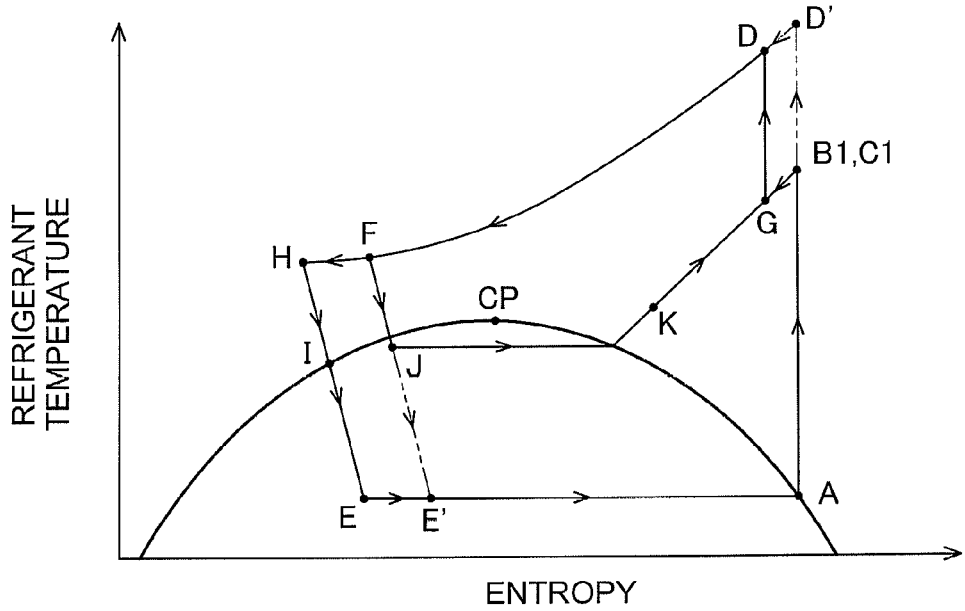
FIG. 26 is a temperature-entropy graph representing the refrigeration cycle during the air-warming operation in the air-conditioning apparatus according to Modification 4.
Figure 27:
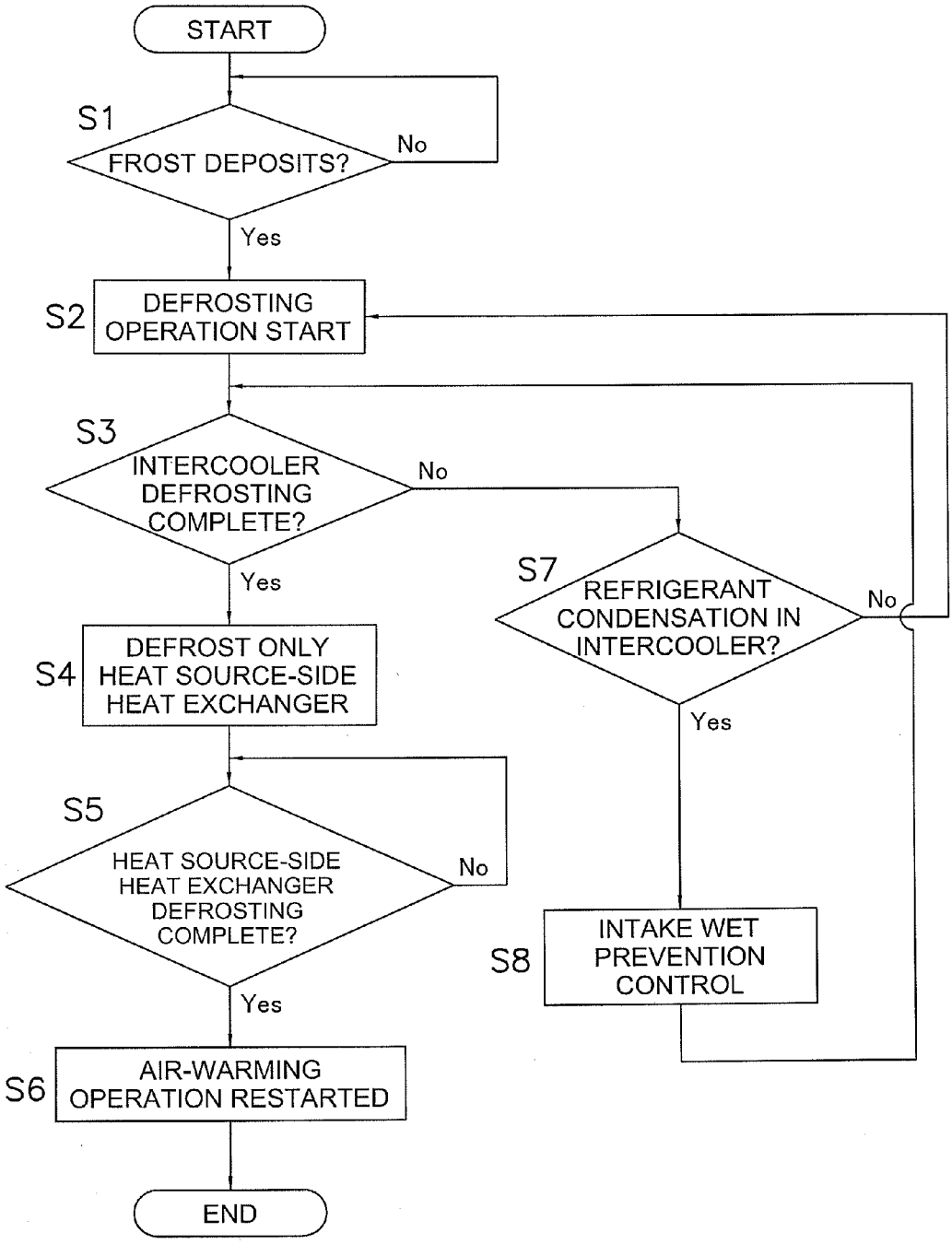
FIG. 27 is a flowchart of the defrosting operation according to Modification 4.

Next, the action of the air-conditioning apparatus 1 of the present modification will be described using FIGS. 22 through 26. FIG. 23 is a pressure-enthalpy graph representing the refrigeration cycle during the air-cooling operation in Modification 4, FIG. 24 is a temperature-entropy graph representing the refrigeration cycle during the air-cooling operation in Modification 4, FIG. 25 is a pressure-enthalpy graph representing the refrigeration cycle during the air-warming operation in Modification 4, and FIG. 26 is a temperature-entropy graph representing the refrigeration cycle during the air-warming operation in Modification 4. Operation control in the air-cooling operation, the air-warming operation, and the defrosting operation described hereinbelow is performed by the aforementioned controller (not shown). In the following description, the term "high pressure" means a high pressure in the refrigeration cycle (specifically, the pressure at points D, D', E, and H in FIGS. 23 and 24, and the pressure at points D, D', F, and H in FIGS. 25 and 26), the term "low pressure" means a low pressure in the refrigeration cycle (specifically, the pressure at points A, F, and F' in FIGS. 23 and 24, and the pressure at points A, E, and E' in FIGS. 25 and 26), and the term "intermediate pressure" means an intermediate pressure in the refrigeration cycle (specifically, the pressure at points B1, C1, G, J, and K in FIGS. 23 through 26).

<Air-Cooling Operation>

During the air-cooling operation, the switching mechanism 3 is brought to the cooling operation state shown by the solid lines in FIG. 22. The opening degrees of the receiver inlet expansion mechanism 5*a* and the receiver outlet expansion mechanism 5*b* are adjusted. Since the switching mechanism 3 is in the cooling operation state, the cooler on/off valve 12 is opened and the intercooler bypass on/off valve 11 of the intercooler bypass tube 9 is closed, thereby bringing the intercooler 7 into a state of functioning as a cooler. Furthermore, the opening degree of the second-stage injection valve 19*a* is also adjusted. More specifically, in the present modification, so-called superheat degree control is performed wherein the opening degree of the second-stage injection valve 19*a* is adjusted so that a target value is achieved for the degree of superheat of the refrigerant at the outlet on the second-stage injection tube 19 side of the economizer heat exchanger 20. In the present modification, the degree of superheat of the refrigerant at the outlet on the second-stage injection tube 19 side of the economizer heat exchanger 20 is obtained by converting the intermediate pressure detected by the intermediate pressure sensor 54 to a saturation temperature and subtracting this refrigerant saturation temperature value from the refrigerant temperature detected by the economizer outlet temperature sensor 55. Though not used in the present embodiment, another possible option is to provide a temperature sensor to the inlet on the second-stage injection tube 19 side of the economizer heat exchanger 20, and to obtain the degree of superheat of the refrigerant at the outlet on the second-stage injection tube 19 side of the economizer heat exchanger 20 by subtracting the refrigerant temperature detected by this temperature sensor from the refrigerant temperature detected by the economizer outlet temperature sensor 55.

When the compression mechanism 2 is driven while the refrigerant circuit 310 is in this state, low-pressure refrigerant (refer to point A in FIGS. 22 to 24) is drawn into the compression mechanism 2 through the intake tube 2*a*, and after the refrigerant is first compressed by the compression element 2*c* to an intermediate pressure, the refrigerant is discharged to the intermediate refrigerant tube 8 (refer to point B1 in FIGS. 22 to 24). The intermediate-pressure refrigerant discharged from the first-stage compression element 2*c* is cooled by heat exchange with air as a cooling source (refer to point C1 in FIGS. 22 to 24). The refrigerant cooled in the intercooler 7 is further cooled (refer to point G in FIGS. 22 to 24) by being mixed with the refrigerant being returned from the second-stage injection tube 19 to the compression element 2*d* (refer to point K in FIGS. 22 to 24). Next, having been mixed with the refrigerant returned from the second-stage injection tube 19, the intermediate-pressure refrigerant is drawn into and further compressed in the compression element 2*d* connected to the second-stage side of the compression element 2*c*, and the refrigerant is then discharged from the compression mechanism 2 to the discharge tube 2*b* (refer to point D in FIGS. 22 to 24). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 23). The high-pressure refrigerant discharged from the compression mechanism 2 is fed via the switching mechanism 3 to the heat source-side heat exchanger 4 functioning as a refrigerant cooler, and the refrigerant is cooled by heat exchange with air as a cooling source (refer to point E in FIGS. 22 to 24). The high-pressure refrigerant cooled in the heat source-side heat exchanger 4 flows through the inlet non-return valve 17*a* of the bridge circuit 17 into the receiver inlet tube 18*a*, and some of the refrigerant is branched off into the second-stage injection tube 19. The refrigerant flowing through the second-stage injection tube 19 is depressurized to a nearly intermediate pressure in the second-stage injection valve 19*a* and is then fed to the economizer heat exchanger 20 (refer to point J in FIGS. 22 to 24). The refrigerant flowing through the receiver inlet tube 18*a* after being branched off into the second-stage injection tube 19 then flows into the economizer heat exchanger 20, where it is cooled by heat exchange with the refrigerant flowing through the second-stage injection tube 19 (refer to point H in FIGS. 22 to 24). The refrigerant flowing through the second-stage injection tube 19 is heated by heat exchange with the refrigerant flowing through the receiver inlet tube 18*a* (refer to point K in FIGS. 22 to 24), and this refrigerant is mixed with the refrigerant cooled in the intercooler 7 as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 22 to 24). The refrigerant retained in the receiver 18 is fed to the receiver outlet tube 18*b*, is depressurized by the receiver outlet expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant heater (refer to point F in FIGS. 22 to 24). The low-pressure gas-liquid two-phase refrigerant fed to the usage-side heat exchanger 6 is heated by heat exchange with water or air as a heating source, and the refrigerant is evaporated as a result (refer to point A in FIGS. 22 to 24). The low-pressure refrigerant heated in the usage-side heat exchanger 6 is drawn once again into the compression mechanism 2 via the switching mechanism 3. In this manner the air-cooling operation is performed.

In the configuration of the present modification, as in the embodiment described above, since the intercooler 7 is in a state of functioning as a cooler during the air-cooling operation in which the switching mechanism 3 is brought to the cooling operation state, heat radiation loss in the heat source-side heat exchanger 4 can be reduced in comparison with cases in which no intercooler 7 is provided.

Moreover, in the configuration of the present modification, since the second-stage injection tube 19 is provided so as to branch off the refrigerant fed from the heat source-side heat exchanger 4 to the expansion mechanisms 5*a*, 5*b* and return the refrigerant to the second-stage compression element 2*d*, the temperature of refrigerant drawn into the second-stage compression element 2*d* can be kept even lower (refer to points C1 and G in FIG. 24) without performing heat radiation to the exterior, such as is done with the intercooler 7. The temperature of the refrigerant discharged from the compression mechanism 2 is thereby brought even lower (refer to points D and D' in FIG. 24), and operating efficiency can be further improved because heat radiation loss can be further reduced in proportion to the area enclosed by connecting the points C1, D', D, and G in FIG. 24 in comparison with cases in which no second-stage injection tube 19 is provided.

In the configuration of the present modification, since an economizer heat exchanger 20 is also provided for conducting heat exchange between the refrigerant fed from the heat source-side heat exchanger 4 to the expansion mechanisms 5*a*, 5*b* and the refrigerant flowing through the second-stage injection tube 19, the refrigerant fed from the heat source-side heat exchanger 4 to the expansion mechanisms 5*a*, 5*b* can be cooled by the refrigerant flowing through the second-stage injection tube 19 (refer to points E and H in FIGS. 23 and 24), and the cooling capacity per flow rate of the refrigerant in the usage-side heat exchanger 6 can be increased in comparison with cases in which the second-stage injection tube 19 and economizer heat exchanger 20 are not provided (in this case, the refrigeration cycle in FIGS. 23 and 24 is performed in the following sequence: point A→point B1→point C1→point D'→point E→point F').

<Air-Warming Operation>

During the air-warming operation, the switching mechanism 3 is brought to the heating operation state shown by the dashed lines in FIG. 22. The opening degrees of the receiver inlet expansion mechanism 5*a* and receiver outlet expansion mechanism 5*b* are adjusted. Since the switching mechanism 3 is in the heating operation state, the cooler on/off valve 12 is closed and the intercooler bypass on/off valve 11 of the intercooler bypass tube 9 is opened, thereby bringing the intercooler 7 in a state of not functioning as a cooler. Furthermore, the opening degree of the second-stage injection valve 19*a* is also adjusted by the same superheat degree control as in the air-cooling operation.

When the compression mechanism 2 is driven while the refrigerant circuit 310 is in this state, low-pressure refrigerant (refer to point A in FIGS. 22, 25, and 26) is drawn into the compression mechanism 2 through the intake tube 2*a*, and after the refrigerant is first compressed by the compression element 2*c* to an intermediate pressure, the refrigerant is discharged to the intermediate refrigerant tube 8 (refer to point B1 in FIGS. 22, 25, and 26). Unlike the air-cooling operation, the intermediate-pressure refrigerant discharged from the first-stage compression element 2*c* passes through the intercooler bypass tube 9 (refer to point C1 in FIGS. 22, 25, and 26) without passing through the intercooler 7 (i.e., without being cooled), and the refrigerant is cooled (refer to point G in FIGS. 22, 25, and 26)) by being mixed with refrigerant being returned from the second-stage injection tube 19 to the second-stage compression element 2*d* (refer to point K in FIGS. 22, 25, and 26). Next, having been mixed with the refrigerant returning from the second-stage injection tube 19, the intermediate-pressure refrigerant is drawn into and further compressed in the compression element 2*d* connected to the second-stage side of the compression element 2*c*, and the refrigerant is discharged from the compression mechanism 2 to the discharge tube 2*b* (refer to point D in FIGS. 22, 25, and 26). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 25), similar to the air-cooling operation. The high-pressure refrigerant discharged from the compression mechanism 2 is fed via the switching mechanism 3 to the usage-side heat exchanger 6 functioning as a refrigerant cooler, and the refrigerant is cooled by heat exchange with water or air as a cooling source (refer to point F in FIGS. 22, 25, and 26). The high-pressure refrigerant cooled in the usage-side heat exchanger 6 flows through the inlet non-return valve 17*b* of the bridge circuit 17 into the receiver inlet tube 18*a*, and some of the refrigerant is branched off into the second-stage injection tube 19. The refrigerant flowing through the second-stage injection tube 19 is depressurized to a nearly intermediate pressure in the second-stage injection valve 19*a*, and is then fed to the economizer heat exchanger 20 (refer to point J in FIGS. 22, 25, and 26). The refrigerant flowing through the receiver inlet tube 18*a* after being branched off into the second-stage injection tube 19 then flows into the economizer heat exchanger 20 and is cooled by heat exchange with the refrigerant flowing through the second-stage injection tube 19 (refer to point H in FIGS. 22, 25, and 26). The refrigerant flowing through the second-stage injection tube 19 is heated by heat exchange with the refrigerant flowing through the receiver inlet tube 18*a* (refer to point K in FIGS. 22, 25, and 26), and is mixed with the intermediate-pressure refrigerant discharged from the first-stage compression element 2*c* as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 22, 25, and 26). The refrigerant retained in the receiver 18 is fed to the receiver outlet tube 18*b* and is depressurized by the receiver outlet expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant heater (refer to point E in FIGS. 22, 25, and 26). The low-pressure gas-liquid two-phase refrigerant fed to the heat source-side heat exchanger 4 is heated by heat exchange with air as a heating source, and is evaporated as a result (refer to point A in FIGS. 22, 25, and 26). The low-pressure refrigerant heated in the heat source-side heat exchanger 4 is drawn once again into the compression mechanism 2 via the switching mechanism 3. In this manner the air-warming operation is performed.

In the configuration of the present modification, as in the embodiment described above, since the intercooler 7 is in a state of not functioning as a cooler during the air-warming operation in which the switching mechanism 3 is in the heating operation state, it is possible to minimize heat radiation to the exterior and minimize the decrease in temperature of the refrigerant supplied to the usage-side heat exchanger 6 functioning as a refrigerant cooler, loss of heating capacity can be minimized, and loss of operating efficiency can be prevented, in comparison with cases in which only the intercooler 7 or cases in which the intercooler 7 is made to function as a cooler as in the air-cooling operation described above.

Moreover, in the configuration of the present modification, since the second-stage injection tube 19 is provided so as to branch off the refrigerant fed from the usage-side heat exchanger 6 to the expansion mechanisms 5*a*, 5*b* and return the refrigerant to the second-stage compression element 2*d*, the temperature of the refrigerant discharged from the compression mechanism 2 is lower (refer to points D and D' in FIG. 26), and the heating capacity per flow rate of the refrigerant in the usage-side heat exchanger 6 is thereby reduced (refer to points D, D', and F in FIG. 25), but since the flow rate of refrigerant discharged from the second-stage compression element 2*d* increases, the heating capacity in the usage-side heat exchanger 6 is preserved, and operating efficiency can be improved.

In the configuration of the present modification, since an economizer heat exchanger 20 is also provided for conducting heat exchange between the refrigerant fed from the usage-side heat exchanger 6 to the expansion mechanisms 5*a*, 5*b* and the refrigerant flowing through the second-stage injection tube 19, the refrigerant flowing through the second-stage injection tube 19 can be heated by the refrigerant fed from the usage-side heat exchanger 6 to the expansion mechanisms 5*a*, 5*b* (refer to points J and K in FIGS. 25 and 26), and the flow rate of the refrigerant discharged from the second-stage compression element 2*d* can be increased in comparison with cases in which the second-stage injection tube 19 and economizer heat exchanger 20 are not provided (in this case, the refrigeration cycle in FIGS. 25 and 26 is performed in the following sequence: point A→point B1→point C1→point D'→point F→point E').

Advantages of both the air-cooling operation and the air-warming operation in the configuration of the present modification are that the economizer heat exchanger 20 is a heat exchanger which has flow channels through which refrigerant fed from the heat source-side heat exchanger 4 or usage-side heat exchanger 6 to the expansion mechanisms 5*a*, 5*b* and refrigerant flowing through the second-stage injection tube 19 both flow so as to oppose each other; therefore, it is possible to reduce the temperature difference between the refrigerant fed to the expansion mechanisms 5*a*, 5*b* from the heat source-side heat exchanger 4 or the usage-side heat exchanger 6 in the economizer heat exchanger 20 and the refrigerant flowing through the second-stage injection tube 19, and high heat exchange efficiency can be achieved. In the configuration of the present modification, since the second-stage injection tube 19 is provided so as to branch off the refrigerant fed to the expansion mechanisms 5*a*, 5*b* from the heat source-side heat exchanger 4 or the usage-side heat exchanger 6 before the refrigerant fed to the expansion mechanisms 5*a*, 5*b* from the heat source-side heat exchanger 4 or the usage-side heat exchanger 6 undergoes heat exchange in the economizer heat exchanger 20, it is possible to reduce the flow rate of the refrigerant fed from the heat source-side heat exchanger 4 or usage-side heat exchanger 6 to the expansion mechanisms 5*a*, 5*b* and subjected to heat exchange with the refrigerant flowing through the second-stage injection tube 19 in the economizer heat exchanger 20, the quantity of heat exchanged in the economizer heat exchanger 20 can be reduced, and the size of the economizer heat exchanger 20 can be reduced.

<Defrosting Operation>

In the air-conditioning apparatus 1, when the air-warming operation is performed while there is a low temperature in the air used as the heat source of the heat source-side heat exchanger 4, there is a danger that frost deposits will form in the heat source-side heat exchanger 4 functioning as a refrigerant heater similar to the embodiment described above, thereby reducing the heat transfer performance of the heat source-side heat exchanger 4. Defrosting of the heat source-side heat exchanger 4 must therefore be performed.

The defrosting operation of the present modification is described in detail hereinbelow using FIGS. 27 through 30.

First, in step S1, a determination is made as to whether or not frost deposits have formed in the heat source-side heat exchanger 4 during the air-warming operation. This is determined based on the temperature of the refrigerant flowing through the heat source-side heat exchanger 4 as detected by the heat source-side heat exchange temperature sensor 51, and/or on the cumulative time of the air-warming operation. For example, in cases in which the temperature of the refrigerant in the heat source-side heat exchanger 4 as detected by the heat source-side heat exchange temperature sensor 51 is equal to or less than a predetermined temperature equivalent to conditions at which frost deposits occur, or in cases in which the cumulative time of the air-warming operation has elapsed past a predetermined time, it is determined that frost deposits have formed in the heat source-side heat exchanger 4. In cases in which these temperature conditions or time conditions are not met, it is determined that frost deposits have not occurred in the heat source-side heat exchanger 4. Since the predetermined temperature and predetermined time depend on the temperature of the air as a heat source, the predetermined temperature and predetermined time are preferably set as a function of the air temperature detected by the air temperature sensor 53. In cases in which a temperature sensor is provided to the inlet or outlet of the heat source-side heat exchanger 4, the refrigerant temperature detected by these temperature sensors may be used in the determination of the temperature conditions instead of the refrigerant temperature detected by the heat source-side heat exchange temperature sensor 51. In cases in which it is determined in step S1 that frost deposits have formed in the heat source-side heat exchanger 4, the process advances to step S2.

Next, the defrosting operation is started in step S2. The defrosting operation is a reverse cycle defrosting operation in which the heat source-side heat exchanger 4 is made to function as a refrigerant cooler by switching the switching mechanism 3 from the heating operation state (i.e., the air-warming operation) to the cooling operation state. Moreover, as in the embodiment described above and the modifications thereof, since refrigerant must be passed not only through the heat source-side heat exchanger 4 but also through the intercooler 7, and the intercooler 7 must be defrosted, an operation is performed whereby the intercooler 7 is made to function as a cooler by opening the cooler on/off valve 12 and closing the intercooler bypass on/off valve 11 (refer to the arrows indicating the flow of refrigerant in FIG. 28).

When the reverse cycle defrosting operation is used, there is a problem with a decrease in the temperature on the usage side because the usage-side heat exchanger 6 is made to function as a refrigerant heater, regardless of whether the usage-side heat exchanger 6 is intended to function as a refrigerant cooler. Since the reverse cycle defrosting operation is an air-cooling operation performed under conditions of a low temperature in the air as the heat source, the low pressure of the refrigeration cycle decreases, and the flow rate of refrigerant drawn in from the first-stage compression element 2*c* is reduced. When this happens, another problem emerges that more time is required for defrosting the heat source-side heat exchanger 4 because the flow rate of refrigerant circulated through the refrigerant circuit 310 is reduced and the flow rate of refrigerant flowing through the heat source-side heat exchanger 4 can no longer be guaranteed.

Figure 28:
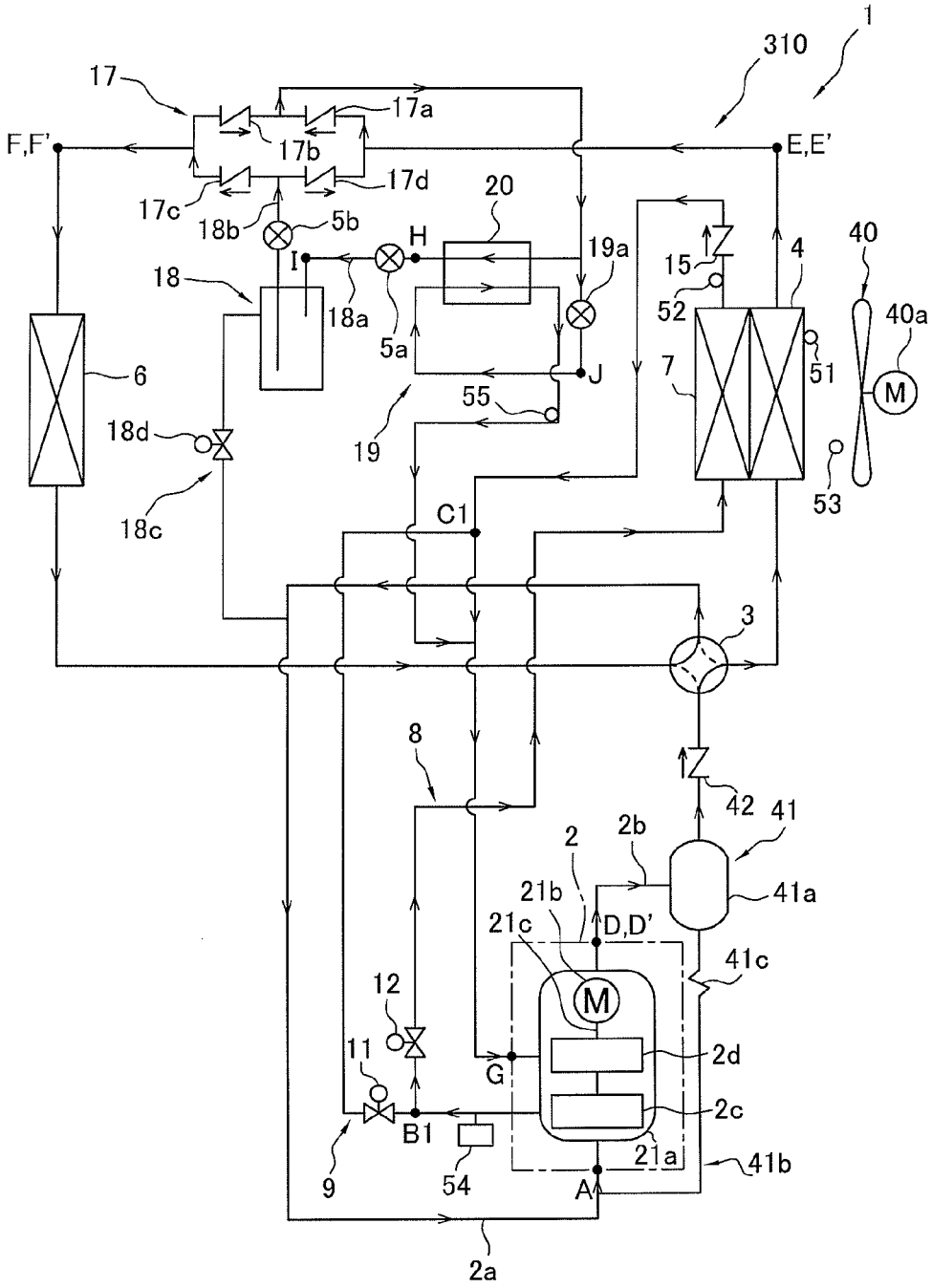
FIG. 28 is a diagram showing the flow of refrigerant within the air-conditioning apparatus at the start of the defrosting operation according to Modification 4.
Figure 29:
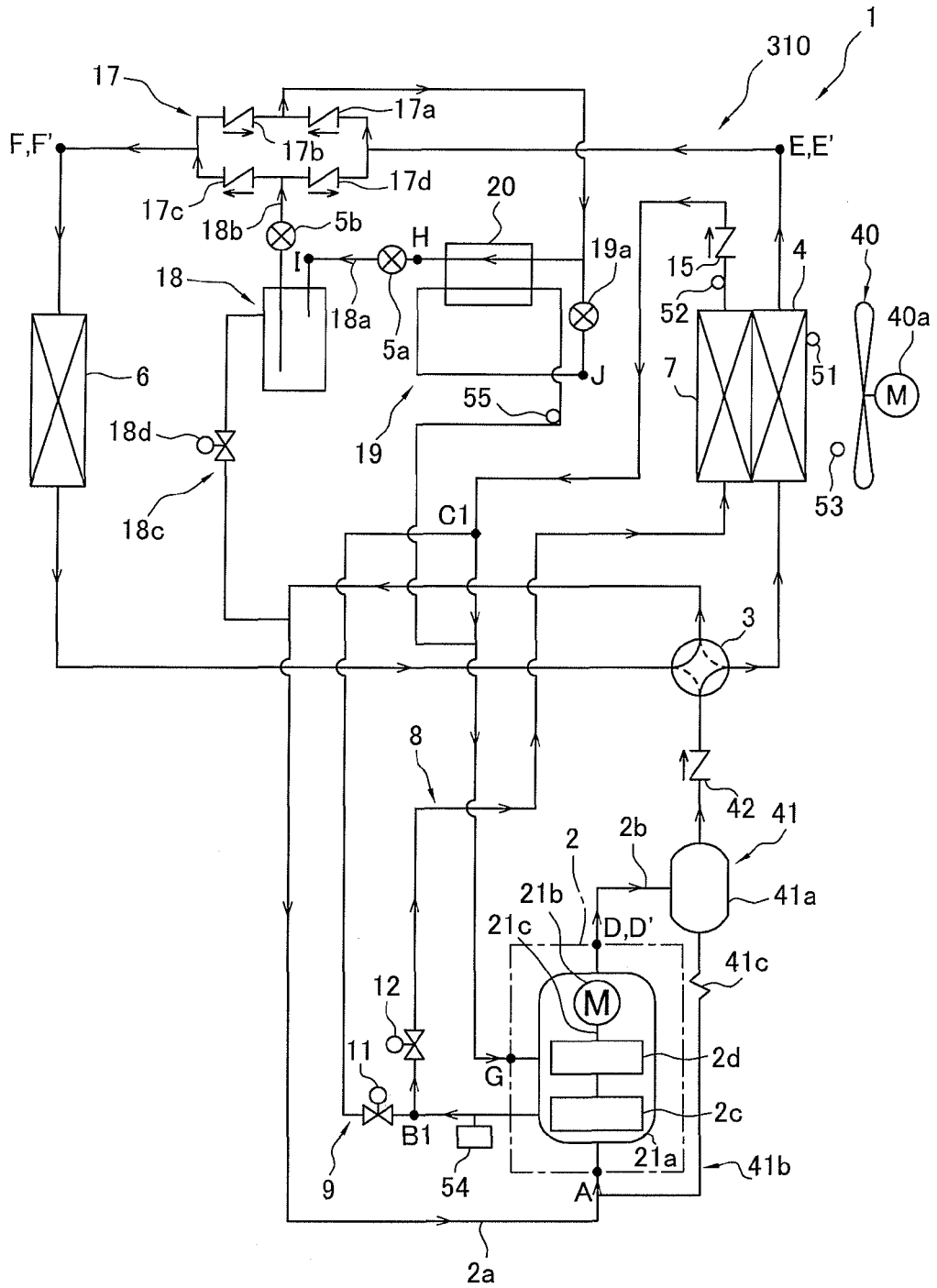
FIG. 29 is a diagram showing the flow of refrigerant within the air-conditioning apparatus when the refrigerant has condensed in the intercooler in the defrosting operation according to Modification 4.
Figure 30:
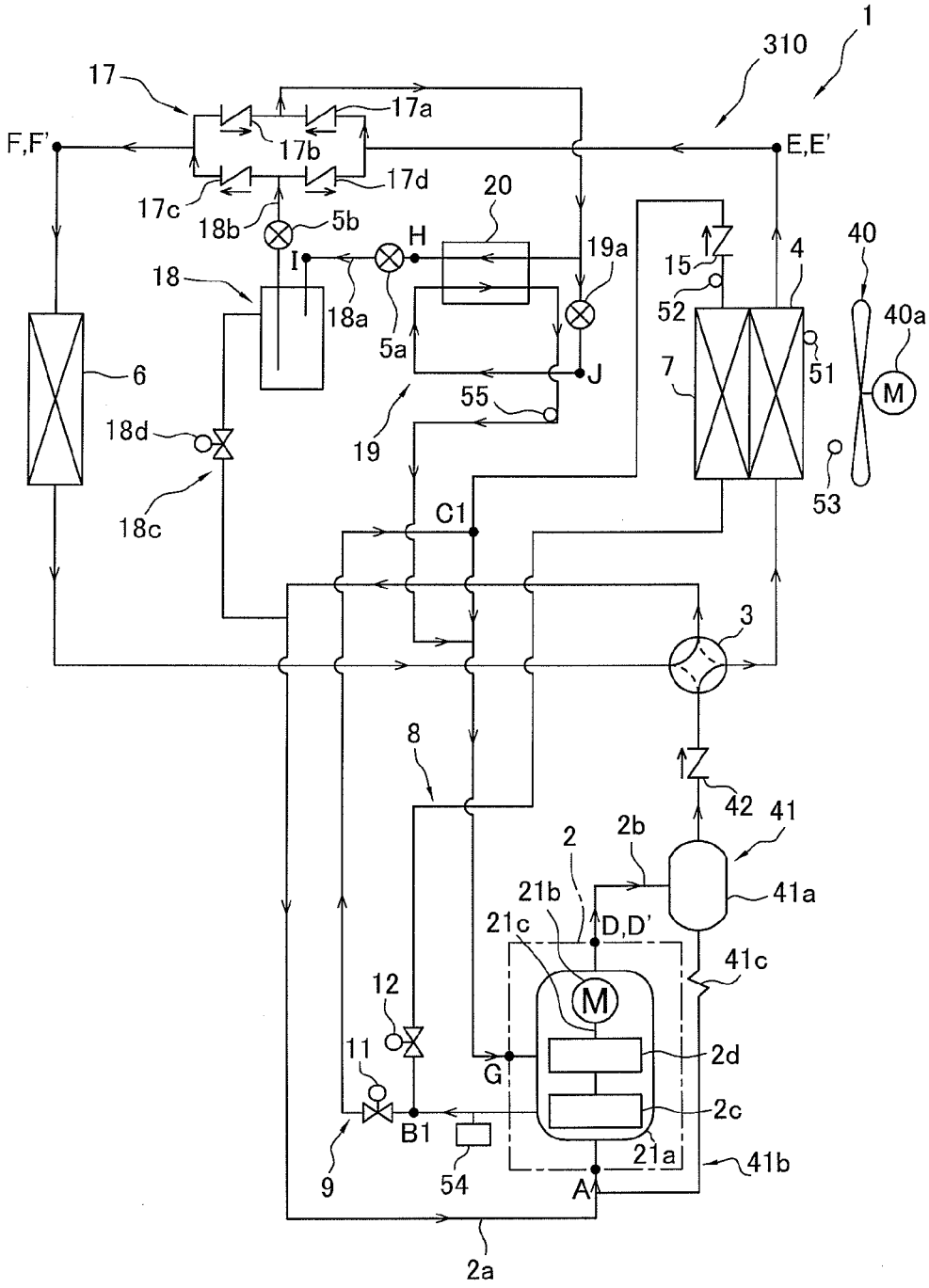
FIG. 30 is a diagram showing the flow of refrigerant within the air-conditioning apparatus after defrosting of the intercooler is complete in the defrosting operation according to Modification 4.

In view of this, in the present modification, an operation is performed whereby the intercooler 7 is made to function as a cooler by opening the cooler on/off valve 12 and closing the intercooler bypass on/off valve 11, and the second-stage injection tube 19 is used to perform a reverse cycle defrosting operation while the refrigerant fed from the heat source-side heat exchanger 4 to the usage-side heat exchanger 6 is being returned to the second-stage compression element 2*d* (refer to the arrows indicating the flow of refrigerant in FIG. 28). Moreover, in the present modification, a control is performed so that the opening degree of the second-stage injection valve 19*a* is opened greater than the opening degree of the second-stage injection valve 19*a* during the air-warming operation immediately before the reverse cycle defrosting operation. In a case in which the opening degree of the second-stage injection valve 19*a* when fully closed is 0%, the opening degree when fully open is 100%, and the second-stage injection valve 19*a* is controlled during the air-warming operation within the opening-degree range of 50% or less, for example; the second-stage injection valve 19*a* in step S2 is controlled so that the opening degree increases up to about 70%, and this opening degree is kept constant until it is determined in step S5 that defrosting of the heat source-side heat exchanger 4 is complete.

Defrosting of the intercooler 7 is thereby performed, and a reverse cycle defrosting operation is achieved in which the flow rate of refrigerant flowing through the second-stage injection tube 19 is increased, the flow rate of refrigerant flowing through the usage-side heat exchanger 6 is reduced, the flow rate of refrigerant processed in the second-stage compression element 2*d* is increased, and a flow rate of refrigerant flowing through the heat source-side heat exchanger 4 can be guaranteed. Moreover, in the present modification, since the control is performed so that the opening degree of the second-stage injection valve 19*a* is opened greater than the opening degree during the air-warming operation immediately before the reverse cycle defrosting operation, it is possible to further increase the flow rate of refrigerant flowing through the heat source-side heat exchanger 4 while further reducing the flow rate of refrigerant flowing through the usage-side heat exchanger 6.

Although only temporarily until defrosting of the intercooler 7 is complete, the refrigerant flowing through the intercooler 7 condenses and the refrigerant drawn into the compression element 2*d* becomes wet, presenting a risk that wet compression will occur in the second-stage compression element 2*d* and the compression mechanism 2 will be overloaded.

In view of this, in the present modification, in cases in which it is detected in step S7 that the flowing through the intercooler 7 has condensed, intake wet prevention control is performed in step S8 for reducing the flow rate of refrigerant returned to the second-stage compression element 2*d* via the second-stage injection tube 19.

The decision of whether or not the refrigerant has condensed in the intercooler 7 in step S7 is based on the degree of superheat of refrigerant at the outlet of the intercooler 7. For example, in cases in which the degree of superheat of refrigerant at the outlet of intercooler 7 is detected as being zero or less (i.e., a state of saturation), it is determined that refrigerant has condensed in the intercooler 7, and in cases in which such superheat degree conditions are not met, it is determined that refrigerant has not condensed in the intercooler 7. The degree of superheat of the refrigerant at the outlet of intercooler 7 is determined by subtracting a saturation temperature obtained by converting the pressure of the refrigerant flowing through the intermediate refrigerant tube 8, as detected by the intermediate pressure sensor 54, from the temperature of the refrigerant at the outlet of intercooler 7 as detected by the intercooler outlet temperature sensor 52. In step S8, a control is performed so that the opening degree of the second-stage injection valve 19*a* decreases, thereby reducing the flow rate of refrigerant returned to the second-stage compression element 2*d* via the second-stage injection tube 19, but in the present modification, the opening degree control is performed so that the opening degree (e.g., nearly fully closed) is less than the opening degree (about 70% in this case) prior to the detection of refrigerant condensation in the intercooler 7 (refer to the arrows indicating the flow of refrigerant in FIG. 29).

Thereby, even in cases in which the refrigerant flowing through the intercooler 7 has condensed before defrosting of the intercooler 7 is complete, the flow rate of refrigerant returned to the second-stage compression element 2*d* via the second-stage injection tube 19 is temporarily reduced, whereby the degree of wet in the refrigerant drawn into the second-stage compression element 2*d* can be suppressed while defrosting of the intercooler 7 continues, and it is possible to suppress the occurrence of wet compression in the second-stage compression element 2*d* as well as overloading of the compression mechanism 2.

Next, in step S3, a determination is made as to whether or not defrosting of the intercooler 7 is complete. The reason for determining whether or not defrosting of the intercooler 7 is complete is because the intercooler 7 is made to not function as a cooler by the intercooler bypass tube 9 during the air-warming operation as described above; therefore, the amount of frost deposited in the intercooler 7 is small, and defrosting of the intercooler 7 is completed sooner than the heat source-side heat exchanger 4. This determination is made based on the refrigerant temperature at the outlet of the intercooler 7. For example, in the case that the refrigerant temperature at the outlet of the intercooler 7 as detected by the intercooler outlet temperature sensor 52 is detected to be equal to or greater than a predetermined temperature, defrosting of the intercooler 7 is determined to be complete, and in the case that this temperature condition is not met, it is determined that defrosting of the intercooler 7 is not complete. It is possible to reliably detect that defrosting of the intercooler 7 has completed by this determination based on the refrigerant temperature at the outlet of the intercooler 7. In the case that it has been determined in step S3 that defrosting of the intercooler 7 is complete, the process advances to step S4.

Next, the process transitions in step S4 from the operation of defrosting both the intercooler 7 and the heat source-side heat exchanger 4 to an operation of defrosting only the heat source-side heat exchanger 4. The reason this operation transition is made after defrosting of the intercooler 7 is complete is because when refrigerant continues to flow to the intercooler 7 even after defrosting of the intercooler 7 is complete, heat is radiated from the intercooler 7 to the exterior, the temperature of the refrigerant drawn into the second-stage compression element 2*d* decreases, and as a result, a problem occurs in that the temperature of the refrigerant discharged from the compression mechanism 2 decreases and the defrosting capacity of the heat source-side heat exchanger 4 suffers. The operation transition is therefore made so that this problem does not occur. This operation transition in step S4 allows an operation to be performed for making the intercooler 7 not function as a cooler, by closing the cooler on/off valve 12 and opening the intercooler bypass on/off valve 11 while the heat source-side heat exchanger 4 continues to be defrosted by the reverse cycle defrosting operation (refer to the arrows indicating the flow of refrigerant in FIG. 30). Heat is thereby prevented from being radiated from the intercooler 7 to the exterior, the temperature of the refrigerant drawn into the second-stage compression element 2*d* is therefore prevented from decreasing, and as a result, temperature decreases can be minimized in the refrigerant discharged from the compression mechanism 2, and the decrease in the capacity to defrost the heat source-side heat exchanger 4 can be minimized.

However, after it has been detected that defrosting of the intercooler 7 is complete, if the intercooler bypass tube 9 is used (in other words, the cooler on/off valve 12 is closed and the intercooler bypass on/off valve 11 is opened) to ensure that refrigerant does not flow to the intercooler 7, the temperature of the refrigerant drawn into the second-stage compression element 2*d* suddenly increases, and there is therefore a tendency for the refrigerant drawn into the second-stage compression element 2*d* to become less dense and for the flow rate of refrigerant drawn into the second-stage compression element 2*d* to decrease. Therefore, a danger arises that the effects of minimizing the loss of defrosting capacity of the heat source-side heat exchanger 4 will not be adequately obtained in the balance between the action of increasing the defrosting capacity by preventing heat radiation from the intercooler 7 to the exterior, and the action of reducing the defrosting capacity by reducing the flow rate of refrigerant flowing through the heat source-side heat exchanger 4.

In view of this, the intercooler bypass tube 9 is used in step S4 to ensure that refrigerant does not flow to the intercooler 7, and control is performed so that the opening degree of the second-stage injection valve 19*a* increases, whereby heat radiation from the intercooler 7 to the exterior is prevented, the refrigerant fed from the heat source-side heat exchanger 4 to the usage-side heat exchanger 6 is returned to the second-stage compression element 2*d*, and the flow rate of refrigerant flowing through the heat source-side heat exchanger 4 is increased. In step S2, the opening degree of the second-stage injection valve 19*a* is greater (about 70% in this case) than the opening degree of the second-stage injection valve 19*a* during the air-warming operation immediately prior to the reverse cycle defrosting operation, but in step S4, control is performed for opening the valve to an even larger opening degree (e.g., nearly fully open).

Next, in step S5, a determination is made as to whether or not defrosting of the heat source-side heat exchanger 4 has completed. This determination is made based on the temperature of refrigerant flowing through the heat source-side heat exchanger 4 as detected by the heat source-side heat exchange temperature sensor 51, and/or on the operation time of the defrosting operation. For example, in the case that the temperature of refrigerant in the heat source-side heat exchanger 4 as detected by the heat source-side heat exchange temperature sensor 51 is equal to or greater than a temperature equivalent to conditions at which frost deposits do not occur, or in the case that the defrosting operation has continued for a predetermined time or longer, it is determined that defrosting of the heat source-side heat exchanger 4 has completed. In the case that the temperature conditions or time conditions are not met, it is determined that defrosting of the heat source-side heat exchanger 4 is not complete. In the case that a temperature sensor is provided to the inlet or outlet of the heat source-side heat exchanger 4, the temperature of the refrigerant as detected by either of these temperature sensors may be used in the determination of the temperature conditions instead of the refrigerant temperature detected by the heat source-side heat exchange temperature sensor 51. In cases in which it is determined in step S5 that defrosting of the heat source-side heat exchanger 4 has completed, the process transitions to step S6, the defrosting operation ends, and the process for restarting the air-warming operation is again performed. More specifically, a process is performed for switching the switching mechanism 3 from the cooling operation state to the heating operation state (i.e. the air-warming operation).

As described above, the same effects as those of the embodiment described above and the modifications thereof are achieved in the air-conditioning apparatus 1 as well.

Moreover, in the present modification, when the reverse cycle defrosting operation is performed for defrosting the heat source-side heat exchanger 4 by switching the switching mechanism 3 to a cooling operation state, the second-stage injection tube 19 is used so as to return refrigerant fed from the heat source-side heat exchanger 4 to the usage-side heat exchanger 6 back to the second-stage compression element 2*d*. After defrosting of the intercooler 7 is detected as being complete, the intercooler bypass tube 9 is used so as to prevent refrigerant from flowing to the intercooler 7, and control is performed so that the opening degree of the second-stage injection valve 19*a* increases, whereby heat radiation from the intercooler 7 to the exterior is prevented, the refrigerant fed from the heat source-side heat exchanger 4 to the usage-side heat exchanger 6 is returned to the second-stage compression element 2*d*, the flow rate of refrigerant flowing through the heat source-side heat exchanger 4 is increased, and the decrease in the defrosting capacity of the heat source-side heat exchanger 4 is minimized. Moreover, the flow rate of refrigerant flowing through the usage-side heat exchanger 6 can be reduced.

It is thereby possible in the present modification to minimize the decrease in defrosting capacity when the reverse cycle defrosting operation is performed. The temperature decrease on the usage side when the reverse cycle defrosting operation is performed can also be minimized.

In the present modification, since the second-stage injection tube 19 is provided so as to branch off the refrigerant from between the heat source-side heat exchanger 4 and the expansion mechanism (in this case, the receiver inlet expansion mechanism 5*a* for depressurizing the high-pressure refrigerant cooled in the heat source-side heat exchanger 4 before the refrigerant is fed to the usage-side heat exchanger 6) when the switching mechanism 3 is set to the cooling operation state, it is possible to use the pressure difference between the pressure prior to depressurizing by the expansion mechanism and the pressure on the intake side of the second-stage compression element 2*d*, the flow rate of refrigerant returned to the second-stage compression element 2*d* is more readily increased, the flow rate of refrigerant flowing through the usage-side heat exchanger 6 can be further reduced, and the flow rate of refrigerant flowing through the heat source-side heat exchanger 4 can be further increased.

In the present modification, since an economizer heat exchanger 20 is also provided for conducting heat exchange between the refrigerant flowing through the second-stage injection tube 19 and the refrigerant fed from the heat source-side heat exchanger 4 to the expansion mechanism (in this case, the receiver inlet expansion mechanism 5*a* for depressurizing the high-pressure refrigerant cooled in the heat source-side heat exchanger 4 before the refrigerant is fed to the usage-side heat exchanger 6) when the switching mechanism 3 is set to the cooling operation state, there is less danger that the refrigerant flowing through the second-stage injection tube 19 will be heated by heat exchange with the refrigerant flowing from the heat source-side heat exchanger 4 to the expansion mechanism, and that the refrigerant drawn into the second-stage compression element 2*d* will become wet. The flow rate of refrigerant returned to the second-stage compression element 2*d* is more readily increased, the flow rate of refrigerant flowing through the usage-side heat exchanger 6 can be further reduced, and the flow rate of refrigerant flowing through the heat source-side heat exchanger 4 can be further increased.

Figure 31:
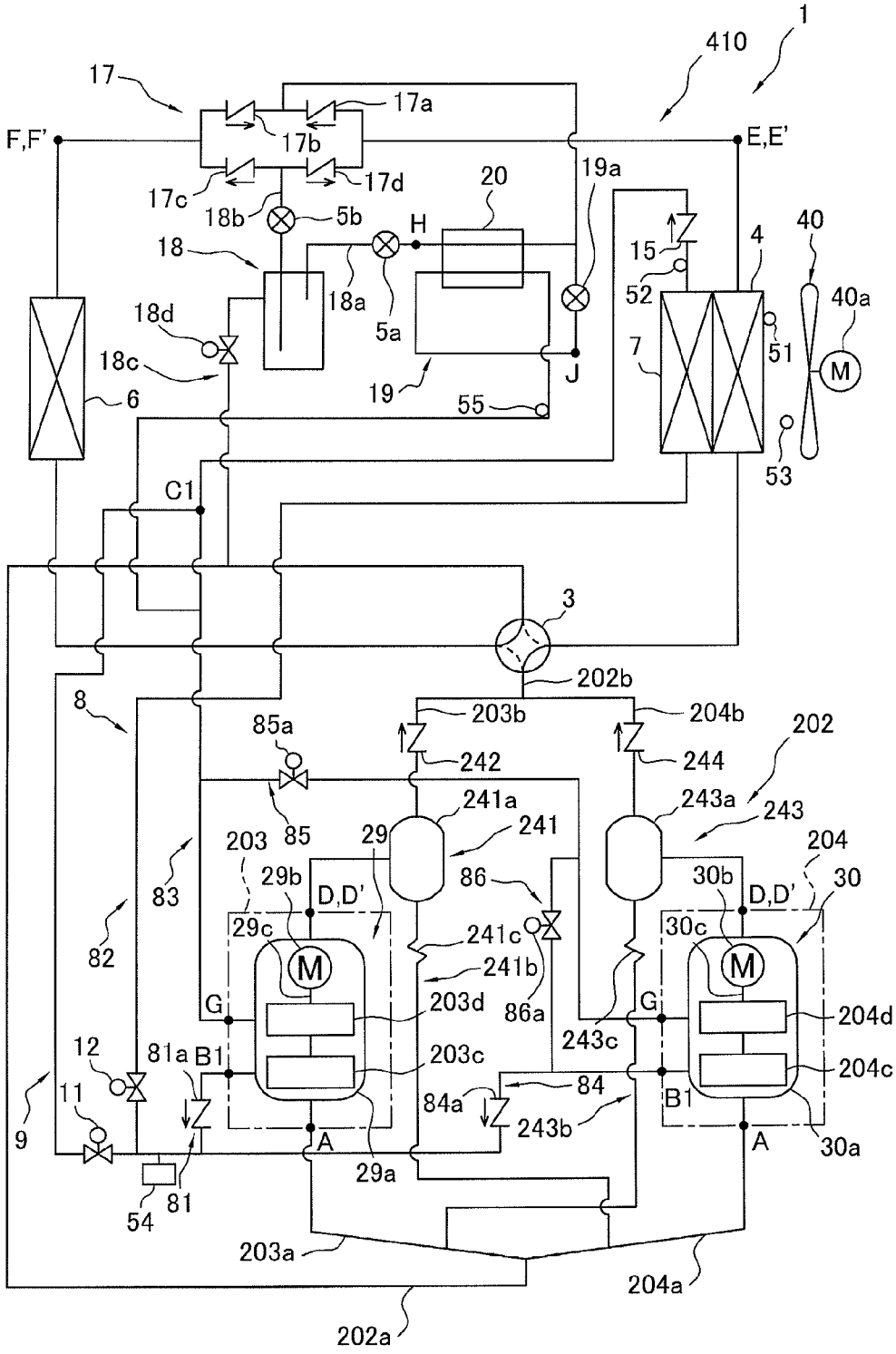
FIG. 31 is a schematic structural diagram of an air-conditioning apparatus according to Modification 4.

Though not described in detail herein, a compression mechanism having more stages than a two-stage compression system, such as a three-stage compression system (e.g., the compression mechanism 102 in Modification 2) or the like, may be used instead of the two-stage compression-type compression mechanism 2, or a parallel multi-stage compression-type compression mechanism may be used in which a plurality of compression mechanisms are connected in parallel, such as is the case with the refrigerant circuit 410 (see FIG. 31) which uses the compression mechanism 202 having the two-stage compression-type compression mechanisms 203, 204 in Modification 3; and the same effects as those of the present modification can be achieved in this case as well. In the air-conditioning apparatus 1 of the present modification, the use of a bridge circuit 17 is included from the standpoint of keeping the direction of refrigerant flow constant in the receiver inlet expansion mechanism 5*a*, the receiver outlet expansion mechanism 5*b*, the receiver 18, the second-stage injection tube 19, or the economizer heat exchanger 20, regardless of whether the air-cooling operation or air-warming operation is in effect. However, the bridge circuit 17 may be omitted in cases in which there is no need to keep the direction of refrigerant flow constant in the receiver inlet expansion mechanism 5*a*, the receiver outlet expansion mechanism 5*b*, the receiver 18, the second-stage injection tube 19, or the economizer heat exchanger 20 regardless of whether the air-cooling operation or the air-warming operation is taking place, such as cases in which the second-stage injection tube 19 and economizer heat exchanger 20 are used either during the air-cooling operation alone or during the air-warming operation alone, for example.

(7) Modification 5

The refrigerant circuit 310 (see FIG. 22) and the refrigerant circuit 410 (see FIG. 31) in Modification 4 described above have configurations in which one usage-side heat exchanger 6 is connected, but alternatively may have configurations in which a plurality of usage-side heat exchangers 6 is connected, and these usage-side heat exchangers 6 can be started and stopped individually.

Figure 32:
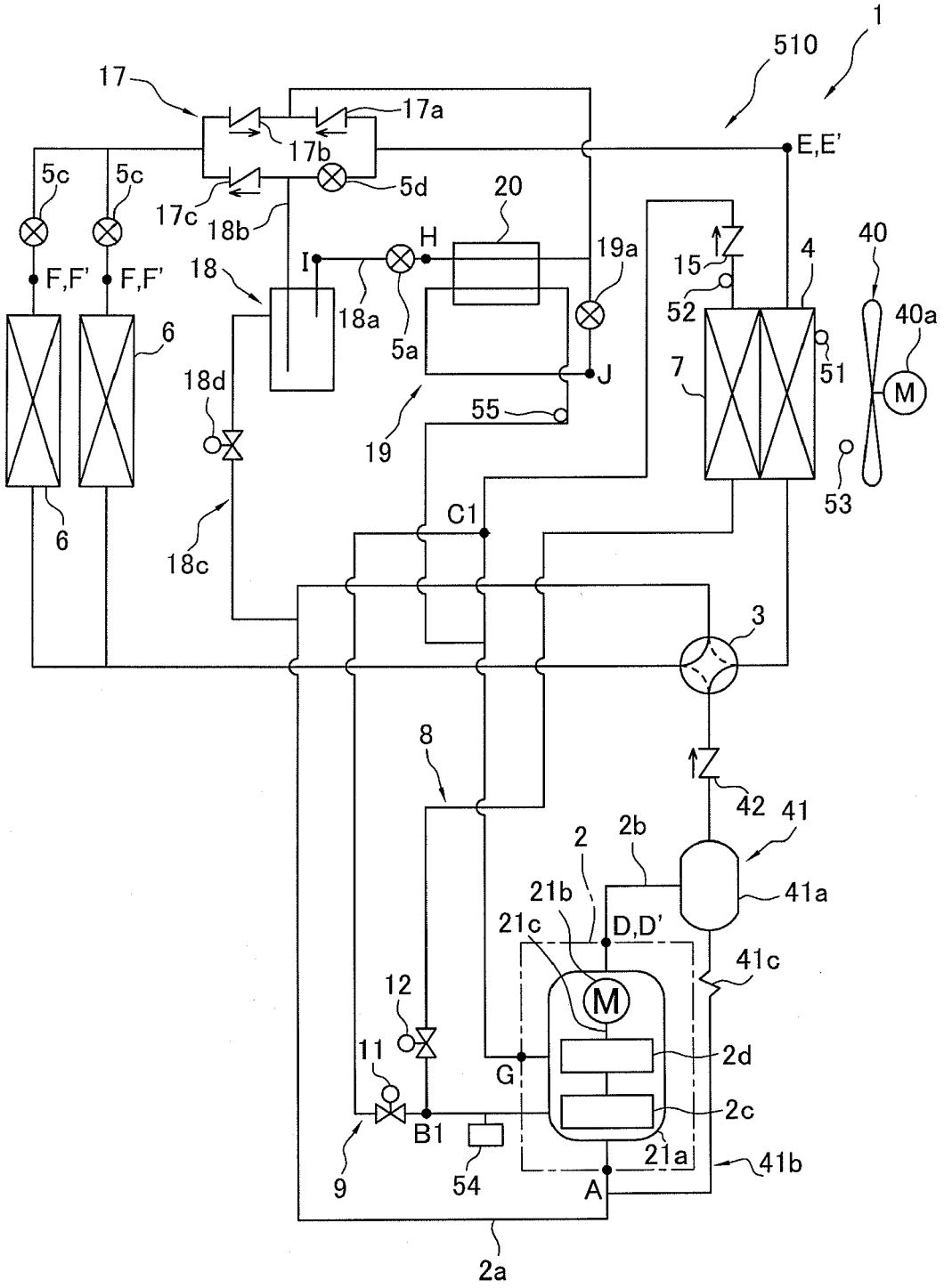
FIG. 32 is a schematic structural diagram of an air-conditioning apparatus according to Modification 5.
Figure 33:
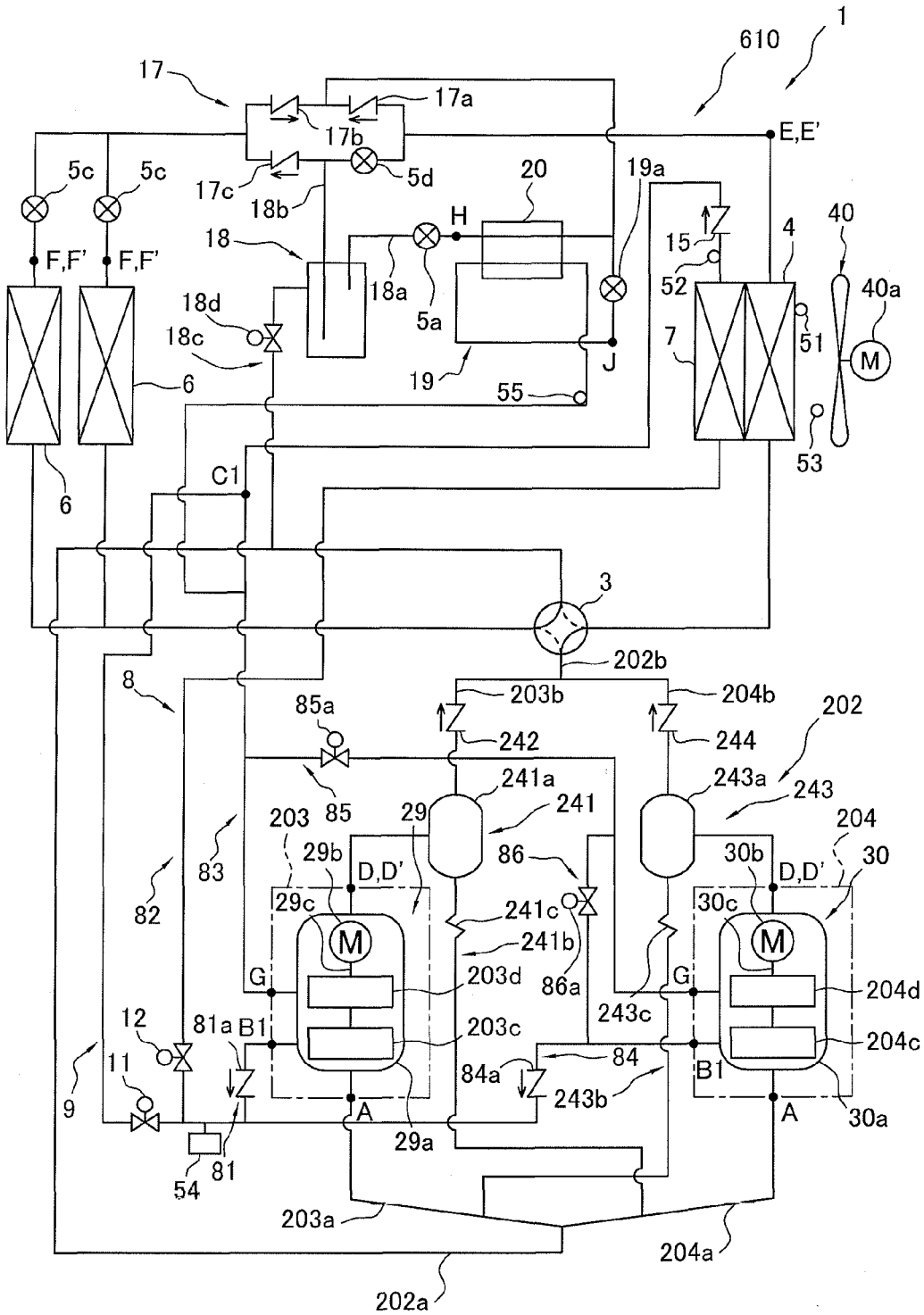
FIG. 33 is a schematic structural diagram of an air-conditioning apparatus according to Modification 5.

For example, the refrigerant circuit 310 (FIG. 22) of Modification 4, which uses a two-stage compression-type compression mechanism 2, may be fashioned into a refrigerant circuit 510 in which two usage-side heat exchangers 6 are connected, usage-side expansion mechanisms 5*c* are provided in correspondence with the ends of the usage-side heat exchangers 6 on the sides facing the bridge circuit 17, the receiver outlet expansion mechanism 5*b* previously provided to the receiver outlet tube 18*b* is omitted, and a bridge outlet expansion mechanism 5*d* is provided instead of the outlet non-return valve 17*d* of the bridge circuit 17, as shown in FIG. 32. Alternatively, the refrigerant circuit 410 (see FIG. 31) of Modification 4, which uses a parallel two-stage compression-type compression mechanism 202, may be fashioned into a refrigerant circuit 610 in which two usage-side heat exchangers 6 are connected, usage-side expansion mechanisms 5*c* are provided in correspondence with the ends of the usage-side heat exchangers 6 on the sides facing the bridge circuit 17, the receiver outlet expansion mechanism 5*b* previously provided to the receiver outlet tube 18*b* is omitted, and a bridge outlet expansion mechanism 5*d* is provided instead of the outlet non-return valve 17*d* of the bridge circuit 17, as shown in FIG. 33.

The configuration of the present modification has different actions during the air-cooling operations and defrosting operations of Modification 4 in that during the air-cooling operation, the bridge outlet expansion mechanism 5*d* is fully closed, and in place of the receiver outlet expansion mechanism 5*b* in Modification 4, the usage-side expansion mechanisms 5*c* perform the action of further depressurizing the refrigerant already depressurized by the receiver inlet expansion mechanism 5*a* to a lower pressure before the refrigerant is fed to the usage-side heat exchangers 6; but the other actions of the present modification are essentially the same as the actions during the air-cooling operations and defrosting operations of Modification 4 (FIGS. 22 through 24 and 27 through 30, as well as their relevant descriptions). The present modification also has actions different from those during the air-warming operations of Modification 4 in that during the air-warming operation, the opening degrees of the usage-side expansion mechanisms 5*c* are adjusted so as to control the flow rate of refrigerant flowing through the usage-side heat exchangers 6, and in place of the receiver outlet expansion mechanism 5*b* in Modification 4, the bridge outlet expansion mechanism 5*d* performs the action of further depressurizing the refrigerant already depressurized by the receiver inlet expansion mechanism 5*a* to a lower pressure before the refrigerant is fed to the heat source-side heat exchanger 4; however, the other actions of the present modification are essentially the same as the actions during the air-warming operations of Modification 4 (FIGS. 22, 25, 26, and their relevant descriptions).

The same operational effects as those of Modification 4 can also be achieved with the configuration of the present modification.

Though not described in detail herein, a compression mechanism having more stages than a two-stage compression system, such as a three-stage compression system (e.g., the compression mechanism 102 in Modification 2) or the like, may be used instead of the two-stage compression-type compression mechanisms 2, 203, and 204.

(8) Modification 6

In the embodiment described above and the modifications thereof, the intercooler 7 is integrated with the heat source-side heat exchanger 4, the intercooler 7 is disposed in the top part of the heat exchanger panel 70 in which the two components are integrated, and the intercooler 7 is integrated with the heat source-side heat exchanger 4 in a state of being disposed above the heat source-side heat exchanger 4 as shown in FIGS. 2 and 3, but since the temperature of the refrigerant flowing into the intercooler 7 is lower than the temperature of the refrigerant flowing into the heat source-side heat exchanger 4, it is more difficult to ensure a temperature difference between the refrigerant flowing through the intercooler 7 and the air as the heat source than it is to ensure a temperature difference between the refrigerant flowing through the heat source-side heat exchanger 4 and the air as the heat source, and the heat transfer performance of the intercooler 7 tends to be compromised readily.

Figure 34:
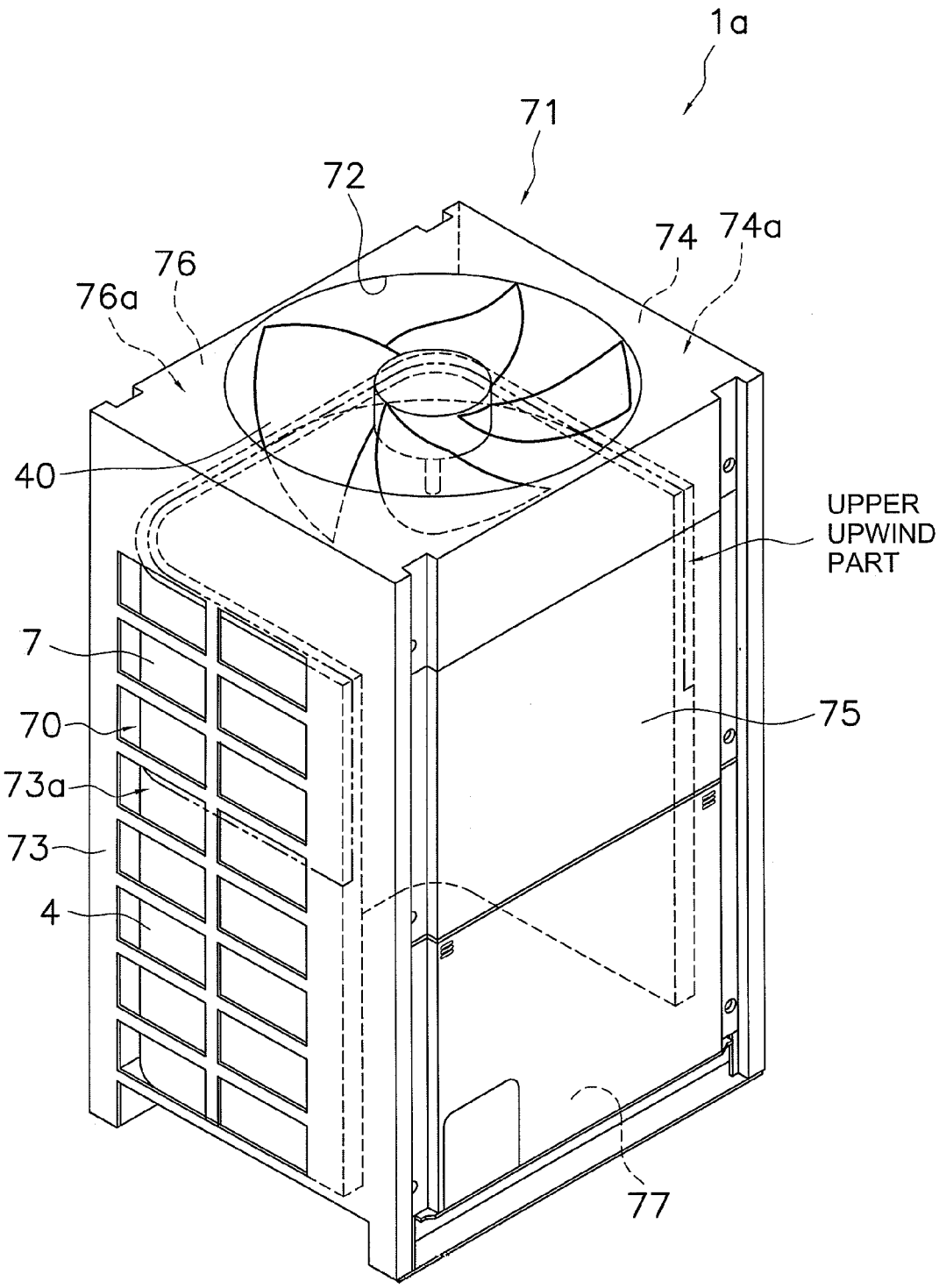
FIG. 34 is an external perspective view of a heat source unit (with the fan grill removed) according to Modification 6.

In view of this, in the present modification, the intercooler 7 is disposed in the top part of the heat exchanger panel 70 as shown in FIG. 34, and is also disposed in an upper upwind part, which is a section in the upper part of the heat exchanger panel 70 upwind of the flow direction of the air as the heat source (in other words, the intercooler is not disposed in a downwind part which is a section downwind of the airflow direction).

It is thereby possible in the present modification to achieve the operational effects of the embodiment described above and the modifications thereof, to increase the temperature difference between the refrigerant flowing through the intercooler 7 and the air as the heat source, and hence to improve the heat transfer performance of the intercooler 7.

The heat exchanger panel 70 in the present modification herein uses a configuration in which heat transfer tubes are arrayed in a plurality of rows (three herein) relative to the flow direction of the air as the heat source, and a plurality of vertical columns (fourteen herein). In this case, for example, the heat exchanger panel 70 can be configured so as to have a first high-temperature heat transfer channel 70*a* having two rows of seven (a total of fourteen) heat transfer tubes disposed downwind in the intercooler 7, a second high-temperature heat transfer channel 70*b* having two rows of seven (a total of fourteen) heat transfer tubes disposed on the lower side of the first high-temperature heat transfer channel 70*a*, a first low-temperature heat transfer channel 70*c* having one row of four (a total of four) heat transfer tubes disposed on the lower side of the intercooler 7, a second low-temperature heat transfer channel 70*d* having one row of four (a total of four) heat transfer tubes disposed on the lower side of the first low-temperature heat transfer channel 70*c*, and an intercooling heat transfer channel 70*e* having one row of six (a total of six) heat transfer tubes disposed on the upper side of the first low-temperature heat transfer channel 70*c*, as shown in FIG. 35.

In a heat exchanger panel 70 having these heat transfer channels 70*a* to 70*e*, the intermediate-pressure refrigerant in a refrigeration cycle discharged from a first-stage compression element first flows into the intercooling heat transfer channel 70*e* where it is cooled by heat exchange with air as a heat source, and the refrigerant is then fed to a second-stage compression element. Next, the high-pressure and high-temperature refrigerant in the refrigeration cycle discharged from the second-stage compression element is branched off two ways to flow into the first and second high-temperature heat transfer channels 70*a*, 70*b*, and the refrigerant is cooled by heat exchange with air that has passed through the intercooling heat transfer channel 70*e* and the low-temperature heat transfer channels 70*c*, 70*d*. The refrigerant cooled in the first high-temperature heat transfer channel 70*a* flows into the first low-temperature heat transfer channel 70*c* where it is further cooled, the refrigerant cooled in the second high-temperature heat transfer channel 70*b* flows into the second low-temperature heat transfer channel 70*d* where it is further cooled by heat exchange with the air as the heat source, the two refrigerants are remixed together, and the refrigerant mixture is fed to an expansion mechanism or the like.

Figure 35:
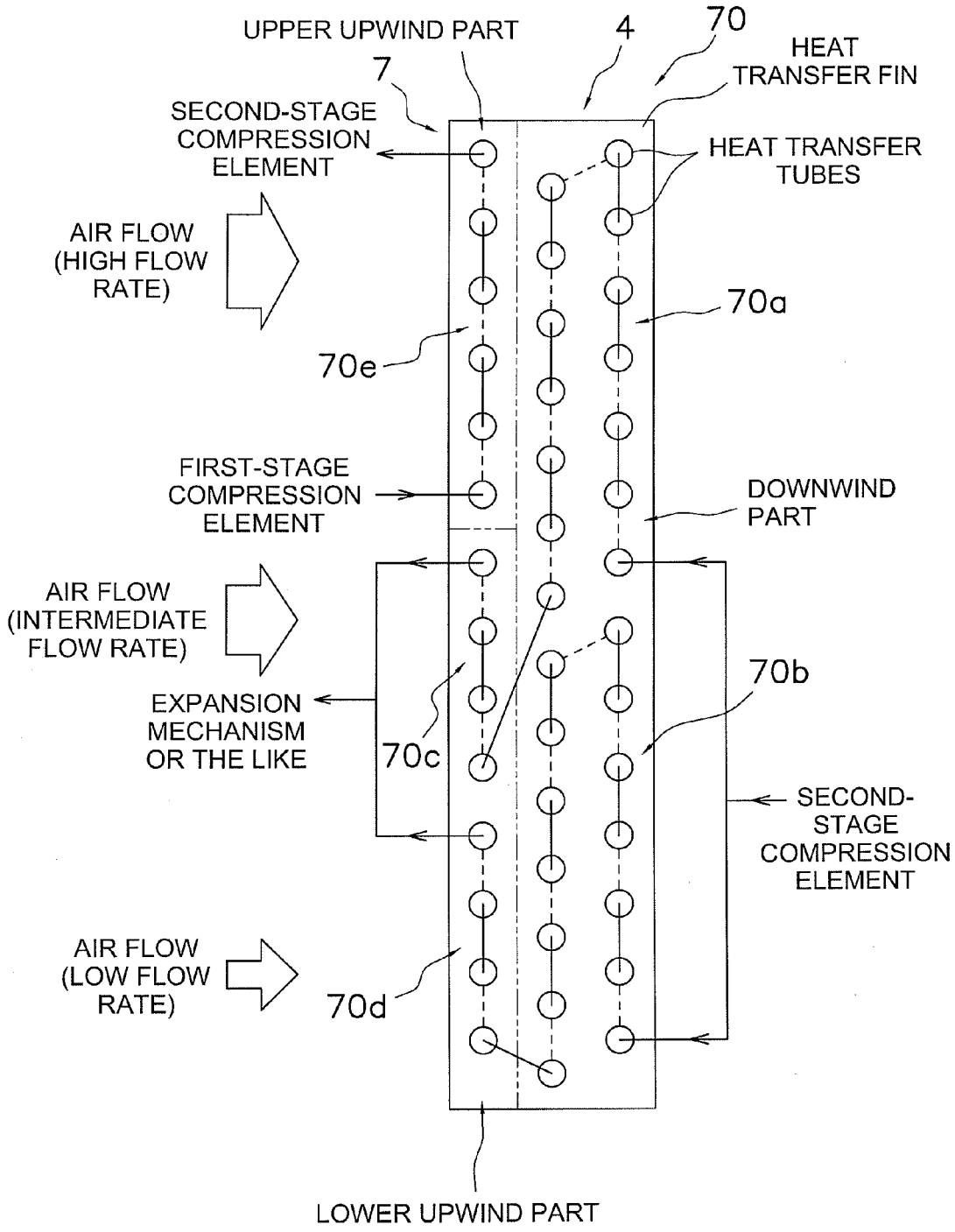
FIG. 35 is a schematic view showing the heat transfer channels of the heat exchanger panel according to Modification 6.

Thus, in the heat exchanger panel 70 shown in FIG. 35, not only is the intercooling heat transfer channel 70*e* constituting the intercooler 7 disposed in the upper upwind part, which is a section in the upper part of the heat exchanger 70 upwind of the flow direction of the air as the heat source, but the heat source-side heat exchanger 4 has the high-temperature heat transfer channels 70*a*, 70*b* for passing the high-pressure, high-temperature refrigerant in the refrigeration cycle discharged from the second-stage compression element, as well as the low-temperature heat transfer channels 70*c*, 70*d* for passing the high-pressure, low-temperature refrigerant that has been cooled in the high-temperature heat transfer channels 70*a*, 70*b*; and the low-temperature heat transfer channels 70*c*, 70*d* are disposed farther upwind in the flowing direction of the air as the heat source than the high-temperature heat transfer channels 70*a*, 70*b* (the high-temperature heat transfer channels 70*a*, 70*b* herein are disposed in a downwind part, which is a section in the heat exchanger panel 70 downwind of the airflow direction, and the low-temperature heat transfer channels 70*c*, 70*d* are disposed in a lower upwind part, which is a section in the heat exchanger panel 70 on the lower side of the intercooling heat transfer channel 70*e* and upwind of the airflow direction).

Therefore, in the configuration shown in FIG. 35, in addition to the operational effects described above, a high-temperature refrigerant exchanges heat with high-temperature air while a low-temperature refrigerant exchanges heat with low-temperature air, the temperature difference between the refrigerant and air in the heat transfer channels 70*a* to 70*d* is made uniform, and the heat transfer performance of the heat source-side heat exchanger 4 can be improved.

(9) Modification 7

In Modification 6 described above, since the intercooler 7 (more specifically, the intercooling heat transfer channel 70*e*) is disposed in the upper upwind part of the heat exchanger panel 70, the space where the heat source-side heat exchanger 4 (more specifically, the heat transfer channels 70*a* to 70*d*) is disposed in the upwind part of the heat exchanger panel 70 to yield effective heat exchange with air is limited to the lower upwind part on the lower side of the intercooler 7, and the heat transfer performance of the heat source-side heat exchanger 4 tends to be adversely affected.

Figure 36:
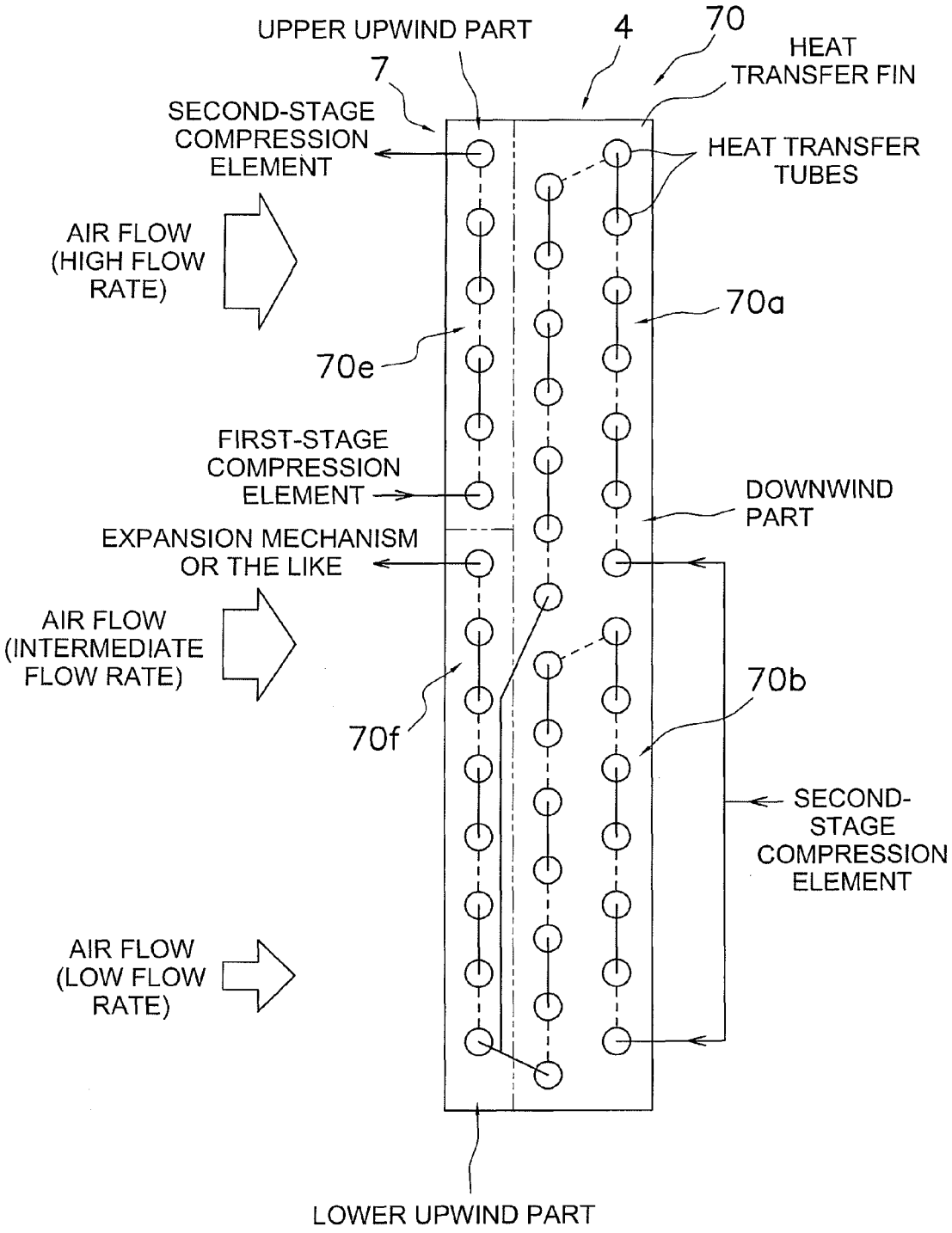
FIG. 36 is a schematic view showing the heat transfer channels of the heat exchanger panel according to Modification 7.

In view of this, in the present modification as shown in FIG. 36, unlike Modification 6, a heat source-side heat exchanger 4 is used wherein the number of low-temperature heat transfer channels is reduced from two to one, and is thus less than the number of high-temperature heat transfer channels 70*a*, 70*b* (two in this case) (in other words, there is only a low-temperature heat transfer channel 70*f* having one row of eight (a total of eight) heat transfer channels), the refrigerants fed from the high-temperature heat transfer channels 70*a*, 70*b* to the low-temperature heat transfer channel 70*f* flow together so as to equal the number of low-temperature heat transfer channels 70*f* (one in this case), and the refrigerant then flows into the low-temperature heat transfer channel 70*f*.

In the present modification, the lower upwind part of the heat exchanger panel 70 can thereby be used as the low-temperature heat transfer channel 70*f* for passing a low-temperature refrigerant having less flow resistance than a high-temperature refrigerant, and the refrigerants fed from the high-temperature heat transfer channels 70*a*, 70*b* flow together into the low-temperature heat transfer channel 70*f*; therefore, the flow rate at which refrigerant flows through the low-temperature heat transfer channel 70*f* can be increased to improve the heat transfer coefficient in the low-temperature heat transfer channel 70*f*, and the heat transfer performance of the heat source-side heat exchanger 4 can be further improved.

Figure 37:
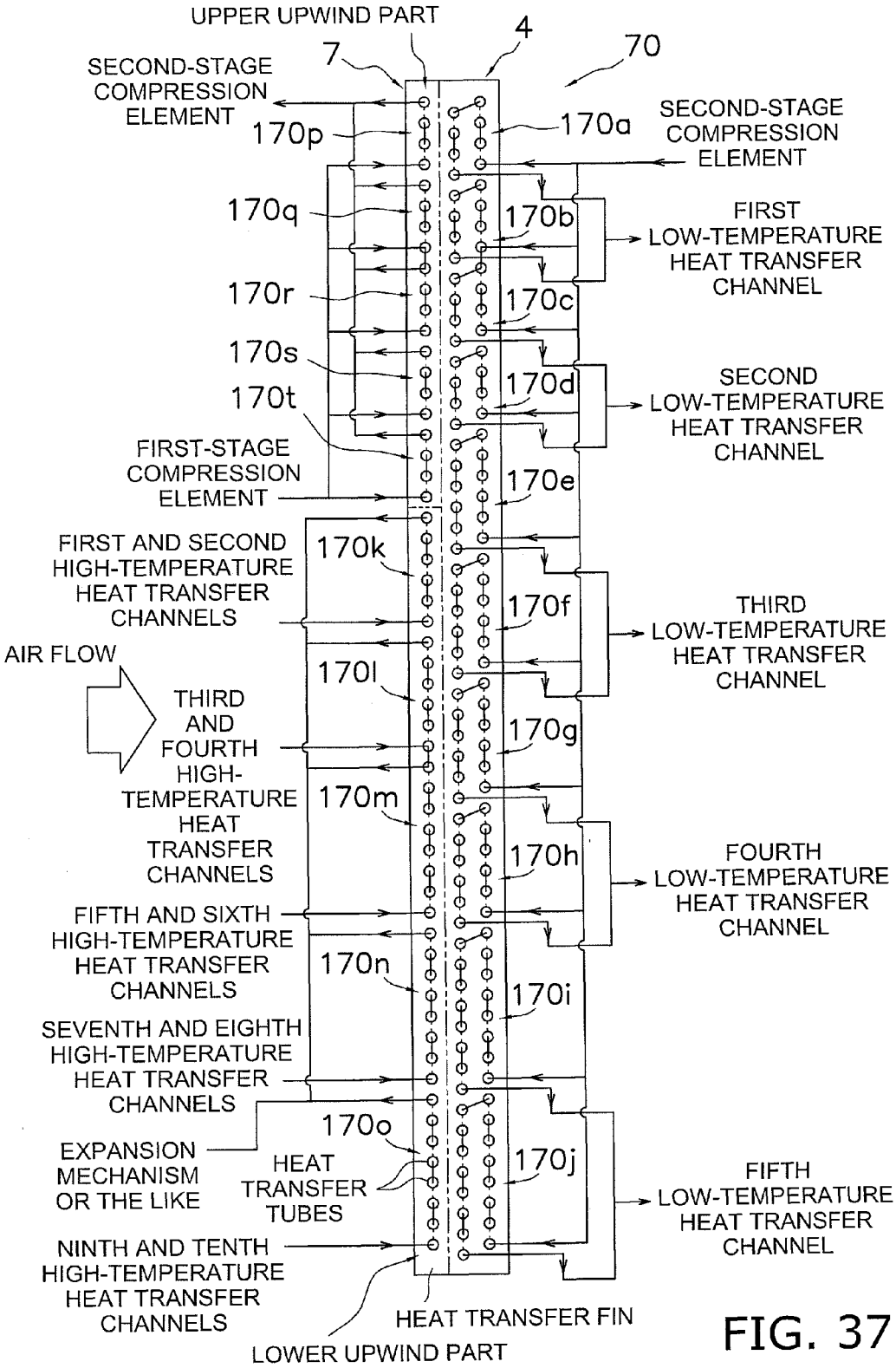
FIG. 37 is a schematic view showing the heat transfer channels of the heat exchanger panel according to Modification 7.

In the case that the heat exchanger panel 70 in the present modification has a configuration in which the number of vertically aligned columns has been increased (fifty-six in this case), the configuration can be made to have four first through fourth high-temperature heat transfer channels 170*a* to 170*d* having two rows of four (a total of eight) heat transfer channels disposed in the downwind side of the intercooler 7, four fifth through eighth high-temperature heat transfer channels 170*e* to 170*h* having two rows of six (a total of twelve) heat transfer channels disposed on the lower side of the fourth high-temperature heat transfer channel 170*d*, two ninth and tenth high-temperature heat transfer channels 170*i*, 170*j* having two rows of eight (a total of sixteen) heat transfer channels disposed on the lower side of the eighth high-temperature heat transfer channel 170*h*, two first and second low-temperature heat transfer channels 170*k*, 170*l* having one row of six (a total of six) heat transfer channels disposed on the lower side of the intercooler 7, three third through fifth low-temperature heat transfer channels 170*m* to 170*o* having one row of eight (a total of eight) heat transfer channels disposed on the lower side of the second low-temperature heat transfer channel 170*l*, and five first through fifth intercooler heat transfer channels 170*p* to 170*t* having one row of four (a total of four) heat transfer channels disposed on the upper side of the first low-temperature heat transfer channel 170*k*, as shown in FIG. 37, for example.

In the heat exchanger panel 70 having these heat transfer channels 170*a* to 170*t*, first, the intermediate-pressure refrigerant in the refrigeration cycle discharged from a first-stage compression element is branched off five ways to flow into the first through fifth intercooler heat transfer channels 170*p* to 170*t*, where it is cooled by heat exchange with air as a heat source and remixed together, and the refrigerant is then fed to a second-stage compression element. Next, the high-pressure, high-temperature refrigerant in the refrigeration cycle discharged from the second-stage compression element is branched off ten ways to flow into the first through tenth high-temperature heat transfer channels 170*a* to 170*j*, where it is cooled by heat exchange with air that has passed through the intercooler heat transfer channels 170*p* to 170*t* and the low-temperature heat transfer channels 170*k* to 170*o*. The refrigerant cooled in the first and second high-temperature heat transfer channels 170*a*, 170*b* is mixed together and fed to the first low-temperature heat transfer channel 170*k*, the refrigerant cooled in the third and fourth high-temperature heat transfer channels 170*c*, 170*d* is mixed together and fed to the second low-temperature heat transfer channel 170*l*, the refrigerant cooled in the fifth and sixth high-temperature heat transfer channel 170*e*, 170*f* is mixed together and fed to the third low-temperature heat transfer channel 170*m*, the refrigerant cooled in the seventh and eighth high-temperature heat transfer channels 170*g*, 170*h* is mixed together and fed to the fourth low-temperature heat transfer channel 170*n*, and the refrigerant cooled in the ninth and tenth high-temperature heat transfer channels 170*i*, 170*j* is mixed together and fed to the fifth low-temperature heat transfer channel 170*o* (in other words, the number of channels is reduced from ten to five). The refrigerant fed to the first through fifth low-temperature heat transfer channels 170*k* to 170*o* is further cooled by heat exchange with the air as the heat source, and the refrigerant is mixed together and then fed to an expansion mechanism or the like.

Thus, in the heat exchanger panel 70 shown in FIG. 37, in addition to the characteristics in the configuration shown in FIG. 36, the number of columns of heat transfer channels (i.e., the number of heat transfer channels) constituting the high-temperature heat transfer channels 170*a* to 170*j* increases progressively downward, the number of columns of heat transfer channels (i.e., the number of heat transfer channels) constituting the low-temperature heat transfer channels 170*k* to 170*o* increases progressively downward, the heat transfer surface area is reduced in the heat transfer channels disposed in the upper part of the heat exchanger panel 70 where air flows at a high rate and air has a high heat transfer coefficient, and the heat transfer surface area is increased in the heat transfer channels disposed in the lower part of the heat exchanger panel 70 where air flows at a low rate and air has a low heat transfer coefficient.

Therefore, in the configuration shown in FIG. 37, in addition to the operational effects described above, it is possible to reduce the disparity in heat transfer performance between the upper part and lower part of the heat source-side heat exchanger 4.

(10) Other Embodiments

Embodiments of the present invention and modifications thereof are described above with reference to the drawings, but the specific configuration is not limited to these embodiments or their modifications, and can be changed within a range that does not deviate from the scope of the invention.

For example, in the above-described embodiment and modifications thereof, the present invention may be applied to a so-called chiller-type air-conditioning apparatus in which water or brine is used as a heating source or cooling source for conducting heat exchange with the refrigerant flowing through the usage-side heat exchanger 6, and a secondary heat exchanger is provided for conducting heat exchange between indoor air and the water or brine that has undergone heat exchange in the usage-side heat exchanger 6.

The present invention can also be applied to other types of refrigeration apparatuses besides the above-described chiller-type air-conditioning apparatus as long as the apparatuses have a refrigerant circuit configured to be capable of switching between a cooling operation and a heating operation, and perform a multistage compression refrigeration cycle by using a refrigerant that operates in a supercritical range. Instead of an air-conditioning apparatus capable of switching between a cooling operation and a heating operation, the present invention may also be applied to a cooling-only air-conditioning apparatus or other refrigeration apparatus in which the heat source-side heat exchanger does not require a defrosting operation. The effects of preventing a loss of heat transfer performance in the intercooler can be achieved in this case as well.

The refrigerant that operates in a supercritical range is not limited to carbon dioxide; ethylene, ethane, nitric oxide, and other gases may also be used.

INDUSTRIAL APPLICABILITY

If the present invention is used in a refrigeration apparatus in which a refrigerant that operates in a supercritical range is used to perform a multistage-compression-type refrigeration cycle, heat exchangers having air as a heat source are used as the intercooler and the heat source-side heat exchanger, and it is possible to minimize the loss of heat transfer performance and the icing-up phenomenon in the intercooler occurring due to integrating the intercooler and the heat source-side heat exchanger.

What is claimed is:

1. A refrigeration apparatus using a refrigerant operating in a supercritical range, the refrigeration apparatus comprising:

a compression mechanism having a plurality of compression elements including a first-stage compression element and a second-stage compression element, the compression mechanism being configured and arranged to sequentially compress refrigerant in the first-stage compression element and then in the second-stage compression element;

a heat source-side heat exchanger with air being used as a heat source;

an expansion mechanism configured and arranged to depressurize the refrigerant;

a usage-side heat exchanger; and an intercooler using air as a heat source, the intercooler being configured and arranged to cool refrigerant flowing through an intermediate refrigerant tube, the intermediate refrigerant tube drawing refrigerant discharged from the first-stage compression element into the second-stage compression, the intercooler being integrated with the heat source-side heat exchanger to form an integrated heat exchanger, the intercooler being disposed in an upper part of the integrated heat exchanger, and the intercooler being disposed in an upper upwind part, with the upper upwind part being a section in the upper part of the integrated heat exchanger arranged upwind relative to the flow direction of the air use as the heat source, the heat source-side heat exchanger having a plurality of high temperature heat transfer channels and plurality of low temperature heat transfer channels, the high and low temperature heat transfer channels being arranged vertically in multiple columns, the high-temperature heat transfer channels being disposed in a downwind part, the downwind part being a section in the heat transfer channels arranged farther downwind than the intercooler relative to the flow direction of the air used as the heat source, the low-temperature heat transfer channels being disposed in a lower upwind part, the lower upwind part being a section in a lower part of the intercooler arranged upwind of the high-temperature heat transfer channels relative to the flow direction of the air as the heat source, the number of low-temperature heat transfer channels being less than the number of high-temperature heat transfer channels, and due to the configuration of the heat source-side heat exchanger, refrigerant fed from the high-temperature heat transfer channels to the low-temperature heat transfer channels flows into the low-temperature heat transfer channels after being mixed in a number of flow paths equal the number of low-temperature heat transfer channels.

2. The refrigeration apparatus according to claim 1, wherein the heat source-side heat exchanger and the intercooler are fin-and-tube heat exchangers; and the intercooler is integrated with the heat source-side heat exchanger by sharing heat transfer fins with the heat source-side heat exchanger.

3. The refrigeration apparatus according to claim 1, wherein the refrigerant operating in the supercritical range is carbon dioxide.

4. A refrigeration apparatus using a refrigerant operating in a supercritical range, the refrigeration apparatus comprising:

a compression mechanism having a plurality of compression elements including a first-stage compression element and a second-stage compression element, the compression mechanism being configured and arranged to sequentially compress refrigerant in the first-stage compression element and then in the second-stage compression element;

a heat source-side heat exchanger with air being used as a heat source;

an expansion mechanism configured and arranged to depressurize the refrigerant;

a usage-side heat exchanger; and an intercooler using air as a heat source, the intercooler being configured and arranged to cool refrigerant flowing through an intermediate refrigerant tube, the intermediate refrigerant tube drawing refrigerant discharged from the first-stage compression element into the second-stage compression, the intercooler being integrated with the heat source-side heat exchanger to form an integrated heat exchanger, with the intercooler being disposed in an upper part of the integrated heat exchanger, and the heat source-side heat exchanger and the intercooler being fin-and-tube heat exchangers, the intercooler being integrated with the heat source-side heat exchanger by sharing heat transfer fins with the heat source-side heat exchanger, and the fins extending in a direction transverse to the tubes and across tubes of both the intercooler and the heat source-side heat exchanger.

5. The refrigeration apparatus according to claim 4, wherein the intercooler is disposed above the heat source-side heat exchanger.

6. The refrigeration apparatus according to claim 4, wherein the intercooler is disposed in an upper upwind part, the upper upwind part being a section in the upper part of the integrated heat exchanger arranged upwind relative to the flow direction of the air used as the heat source.

7. The refrigeration apparatus according to claim 4, wherein the heat source-side heat exchanger has a high-temperature heat transfer channel configured and arranged to carry flow of high-temperature refrigerant, and a low-temperature heat transfer channel configured and arranged to carry flow of low-temperature refrigerant; and the low-temperature heat transfer channel is disposed farther upwind than the high-temperature heat transfer channel relative to the flow direction of the air used as the heat source.

8. The refrigeration apparatus according to claim 5, wherein the heat source-side heat exchanger and the intercooler are fin-and-tube heat exchangers; and the intercooler is integrated with the heat source-side heat exchanger by sharing heat transfer fins with the heat source-side heat exchanger.

9. The refrigeration apparatus according to claim 5, wherein the refrigerant operating in the supercritical range is carbon dioxide.

10. The refrigeration apparatus according to claim 6, wherein the heat source-side heat exchanger and the intercooler are fin-and-tube heat exchangers; and the intercooler is integrated with the heat source-side heat exchanger by sharing heat transfer fins with the heat source-side heat exchanger.

11. The refrigeration apparatus according to claim 6, wherein the refrigerant operating in the supercritical range is carbon dioxide.

12. The refrigeration apparatus according to claim 7, wherein the heat source-side heat exchanger and the intercooler are fin-and-tube heat exchangers; and the intercooler is integrated with the heat source-side heat exchanger by sharing heat transfer fins with the heat source-side heat exchanger.

13. The refrigeration apparatus according to claim 7, wherein the refrigerant operating in the supercritical range is carbon dioxide.

14. The refrigeration apparatus according to claim 4, wherein the refrigerant operating in the supercritical range is carbon dioxide.

* * * * *